US009163182B2

(12) United States Patent
Long et al.

(10) Patent No.: US 9,163,182 B2
(45) **Date of Patent: *Oct. 20, 2015**

(54) PROCESS FOR CRACKING HYDROCARBON OILS

(75) Inventors: Jun Long, Beijing, CA (US); Yuxia Zhu, Beijing (CN); Huiping Tian, Beijing (CN); Yujian Liu, Beijing (CN); Zhenyu Chen, Beijing (CN); Yaoqing Guo, Beijing (CN); Zhijian Da, Beijing (CN); Jiushun Zhang, Beijing (CN); Mingyuan He, Beijing (CN)

(73) Assignees: China Petroleum & Chemical Corporation, Beijing (CN); Research Institute of Petroleum Processing, Sinopec, Beijing (CN)

( * ) Notice: Subject to any disclaimer, the term of this patent is extended or adjusted under 35 U.S.C. 154(b) by 531 days.

This patent is subject to a terminal disclaimer.

(21) Appl. No.: 12/027,123

(22) Filed: Feb. 6, 2008

(65) Prior Publication Data

US 2008/0289997 A1 Nov. 27, 2008

(30) Foreign Application Priority Data

Oct. 16, 2003 (CN) ..... 2003 1 0100429
Oct. 16, 2003 (CN) ..... 2003 1 0100430
Oct. 16, 2003 (CN) ..... 2003 1 0100431
Oct. 16, 2003 (CN) ..... 2003 1 0100432

(51) Int. Cl.
*C10G 51/02* (2006.01)
*C10G 11/14* (2006.01)
(Continued)

(52) U.S. Cl.
CPC ..... *C10G 11/14* (2013.01); *C10G 11/05* (2013.01); *C10G 11/16* (2013.01); *C10G 11/182* (2013.01);
(Continued)

(58) Field of Classification Search
CPC ..... C10G 51/00; C10G 51/02; C10G 51/023; C10G 51/026; C10G 51/04; C10G 65/10
USPC ..... 208/120.1, 49, 50, 52 R, 52 CT, 56, 57, 208/61, 58–59
See application file for complete search history.

(56) References Cited

U.S. PATENT DOCUMENTS 3,964,876 A * 6/1976 James ..... 208/155
4,013,546 A * 3/1977 Suggitt et al. ..... 208/120.01
(Continued)

FOREIGN PATENT DOCUMENTS

CN 1020280 4/1993
CN 1072109 5/1993
(Continued)

OTHER PUBLICATIONS

Residual Oil Processing Processes, Ed. by Lee Chun-Nian, China Petrochemical Publisher, 2002, pp. 282-338.

*Primary Examiner* — Michelle Stein
(74) *Attorney, Agent, or Firm* — Scully, Scott, Murphy & Presser P.C.

(57) ABSTRACT

A novel process for cracking olefins including contacting a hydrocarbon oil with a catalyst in a riser reactor having multiple reaction zones under cracking reaction conditions; separating reaction products and the catalyst; regenerating at least a part of spent catalyst obtained, contacting a part of the regenerated catalyst with the hydrocarbon in the first reaction zone; contacting the other part of the spent catalyst and/or regenerated catalyst in at least one reaction zone after the first reaction zone with the products obtained in previous reaction zones.

23 Claims, 16 Drawing Sheets

(51) Int. Cl.
*C10G 11/05* (2006.01)
*C10G 11/16* (2006.01)
*C10G 11/18* (2006.01)

(52) U.S. Cl.
CPC .. *C10G 2300/205* (2013.01); *C10G 2300/4006* (2013.01); *C10G 2300/4012* (2013.01); *C10G 2300/701* (2013.01); *C10G 2400/04* (2013.01)

(56) References Cited

U.S. PATENT DOCUMENTS

| | | | | | |
|---|---|---|---|---|---|
| 4,280,895 | A | | 7/1981 | Stuntz et al. | |
| 4,280,896 | A | | 7/1981 | Bearden et al. | |
| 4,298,459 | A | | 11/1981 | Tatterson et al. | |
| 4,325,811 | A | * | 4/1982 | Sorrentino | 208/113 |
| 4,345,992 | A | | 8/1982 | Washer et al. | |
| 4,452,693 | A | | 6/1984 | Schucker et al. | |
| 4,504,379 | A | | 3/1985 | Stuntz et al. | |
| 4,504,380 | A | | 3/1985 | Stuntz et al. | |
| 4,566,966 | A | | 1/1986 | Pafford et al. | |
| 4,623,443 | A | | 11/1986 | Washer | |
| 4,666,584 | A | | 5/1987 | Luckenbach et al. | |
| 4,717,466 | A | * | 1/1988 | Herbst et al. | 208/113 |
| 5,089,235 | A | | 2/1992 | Schwartz et al. | |
| 5,104,517 | A | | 4/1992 | Lomas et al. | |
| 5,154,818 | A | * | 10/1992 | Harandi et al. | 208/49 |
| 5,308,474 | A | | 5/1994 | Cetinkaya | |
| 5,376,608 | A | * | 12/1994 | Wormsbecher et al. | 502/61 |
| 5,968,342 | A | * | 10/1999 | Tsunoda et al. | 208/120.15 |
| 6,036,847 | A | | 3/2000 | Ziebarth et al. | |
| 6,113,776 | A | * | 9/2000 | Upson | 208/113 |
| RE37,789 | E | * | 7/2002 | Bertus et al. | 208/120.2 |
| 2001/0032803 | A1 | * | 10/2001 | Mon et al. | 208/74 |

FOREIGN PATENT DOCUMENTS

| | | |
|---|---|---|
| CN | 1428400 | 7/1993 |
| CN | 1069054 | 2/1996 |
| CN | 1031409 | 3/1996 |
| CN | 1034222 | 3/1997 |
| CN | 1194181 | 9/1998 |
| CN | 1261618 | 8/2000 |
| CN | 1281887 | 1/2001 |
| CN | 1286134 | 3/2001 |
| CN | 1295877 | 5/2001 |
| CN | 1076751 | 12/2001 |
| CN | 1078094 | 1/2002 |
| CN | 1334316 | 2/2002 |
| CN | 1089362 | 8/2002 |
| CN | 1552805 | 12/2004 |
| EP | 0052356 | 5/1982 |
| EP | 139392 | 5/1985 |
| EP | 0145466 | 6/1985 |
| EP | 163978 | 12/1985 |
| EP | 564678 | 10/1993 |
| EP | 593823 | 4/1994 |
| EP | 0798362 | 10/1997 |

* cited by examiner

PROCESS FOR CRACKING HYDROCARBON OILS

The present application is a 37 C.F.R. §1.53(b) continuation of U.S. patent application Ser. No. 10/964,644 filed Oct. 15, 2004, which claims priority on Chinese Patent Application No. 200310100429.X, filed Oct. 16, 2003, Chinese Patent Application No. 200310100430.2, filed Oct. 16, 2003, Chinese Patent Application No. 200310100431.7, filed Oct. 16, 2003, and Chinese Patent Application No. 200310100432.1, filed Oct. 16, 2003, the entire contents of each of which are hereby incorporated by reference.

FIELD OF THE INVENTION

The present invention relates to a process for cracking hydrocarbon oils.

BACKGROUND OF THE INVENTION

Processes for cracking hydrocarbon oils generally comprise contacting and reacting a hydrocarbon oil with a cracking catalyst in a cracking zone under cracking conditions, separating cracked products and the catalyst, circulating the catalyst to a regeneration zone to regenerate the catalyst and circulating at least a part of the regenerated catalyst back to the cracking zone. The object of regenerating the catalyst is to maintain the cracking activity of the catalyst.

Some hydrocarbon oils contain impurities, such as nickel, vanadium, iron and the like. If impurities contained in the hydrocarbon oil, such as nickel, vanadium, iron and the like, are deposited onto the catalyst containing a molecular sieve, the catalyst will thus be deactivated and the distribution of cracked products will be affected. In order to solve this problem, a reduction zone is added in some processes for cracking hydrocarbon oils. U.S. Pat. No. 4,345,992 discloses a process for cracking hydrocarbon oils. The process comprises, under cracking conditions, contacting an olefin oil with a catalytic cracking catalyst in the form of particles in a cracking zone; continuously transferring part of said cracking catalyst to a regeneration zone, removing the carbonaceous deposit on the catalyst in the regeneration zone by combustion, continuously transferring the regenerated catalyst to a reduction zone, contacting said catalyst with a reducing gas in the reduction zone under reduction conditions that enable the adverse effects of the metal impurities to be reduced, using a gaseous seal at the upstream of the reduction zone to assure that the major portion of the unconsumed reducing gas passes into the cracking zone, continuously transferring the reduced catalyst to the cracking zone. Said catalyst includes conventional cracking catalysts, such as zeolite-containing catalysts and amorphous aluminosilicate catalyst.

U.S. Pat. No. 4,623,443 discloses a process for hydrogenation of olefins. The process comprises cracking a hydrocarbon with a regenerated catalyst having a metal coat under cracking conditions in a cracking zone; transferring continuously said catalyst to a regeneration zone, contacting said catalyst with an oxygen-containing gas to regenerate said catalyst; transferring continuously a part of the regenerated catalyst to said cracking zone; meanwhile, transferring the other part of the regenerated catalyst to a reduction zone where said catalyst contacts with a reducing gas under conditions in which metals on the catalyst are reduced; transferring the cracked hydrocarbon to a separation zone where hydrogen and olefins are separated from the cracked products; contacting at least a part of said hydrogen and olefins with the reduced catalyst in a hydrogenation zone to hydrogenate the olefins; and finally transferring said catalyst to the regeneration zone.

U.S. Pat. No. 4,623,443 further discloses a process for continuous hydrogenation of olefins. The process comprises, under regeneration conditions, contacting a deactivated and metal-contaminated cracking catalyst with an oxygen-containing gas to obtain a regenerated and metal-contaminated catalyst; contacting the regenerated and metal-contaminated catalyst with a reducing gas under reduction conditions to obtain a reduced, regenerated and metal-contaminated catalyst and finally immediately contacting the reduced, regenerated and metal-contaminated cracking catalyst with a mixture of hydrogen and olefins to hydrogenate said olefins under hydrogenation conditions.

U.S. Pat. No. 4,623,443 also discloses a process for converting hydrocarbons. The process comprises (1) contacting a hydrocarbon which contains metals with an active catalyst in a reaction zone under cracking conditions to obtain cracked products and a catalyst that has been partially deactivated and metal-contaminated; (2) separating the cracked products and the partially deactivated and metal-contaminated catalyst; (3) fractionating said cracked products into hydrogen, olefins and other hydrocarbons; (4) contacting said partially deactivated and metal-contaminated cracking catalyst with an oxygen-containing gas under regeneration conditions to obtain a regenerated and metal-contaminated catalyst; (5) circulating a part of said regenerated and metal-contaminated catalyst to said reaction zone (6) contacting the other part of the regenerated and metal-contaminated catalyst with a reducing gas under reduction conditions to obtain a reduced, regenerated and metal-contaminated catalyst; (7) contacting said reduced, regenerated and metal-contaminated catalyst with hydrogen and olefins under hydrogenation conditions to obtain hydrogenated olefins and a reduced, regenerated and metal-contaminated catalyst that is partially coked; (8) separating said hydrogenated olefins and said partially coked, reduced, regenerated and metal-contaminated catalyst; (9) circulating the hydrogenated olefins to the fraction system according to (3); (10) circulating the partially coked, reduced, regenerated and metal-contaminated catalyst to (4) to carry out regeneration.

In recent years, requirements of fuel standards worldwide become more and more stringent for the sake of environmental protection. For instance, in China, "Criteria for Controlling Hazardous Materials in Automobile Gasoline" was regulated by the National Quality Monitoring Bureau in 1999. Sulfur content in gasoline should be less than 800 ppm according to the requirement of the Criteria. More stringent requirement of gasoline sulfur content i.e. less than 30 ppm, is regulated according to the Europe III Emission Standard of Fuel Oil. In fact, more than 90% of sulfur in gasoline is from FCC gasoline. In the other hand, more and more sour crude from the middle-east countries are processed in many Chinese refineries as FCC feedstock; meanwhile, crudes are getting more and more heavier in recent years. Therefore, there needs to develop a cracking catalyst with higher cracking activity and desulfurizing ability and a cracking process with higher ability for cracking and desulfurizing of heavy oil.

U.S. Pat. No. 6,036,847 and its European counterpart patent EP 0,798,362A2 disclose a process for fluidized catalytic cracking of hydrocarbons, wherein said hydrocarbon feedstock is cracked in a cracking zone without adding hydrogen, and all particles, including catalyst particles, are circulated continuously between a cracking zone and a regeneration zone. In said process, besides said particles, there are additional particles which have a lower activity for cracking hydrocarbon oils than the catalyst particles, said activity being based on the fresh catalyst particles. The particles consist essentially of titanium oxide and an inorganic oxide other than non-titanium oxides. Said inorganic oxide other than non-titanium oxides contains a Lewis acid supported on alumina, and the Lewis acid is one selected from the group consisting of the following elements and their compounds: nickel, copper, zinc, silver, cadmium, indium, tin, mercury, thallium, led, bismuth, boron, aluminum (non alumina) and germanium. The sulfur content of FCC gasoline as the cracked product is decreased because of the use of a titanium oxide-containing additive.

CN1078094C discloses a riser reactor for fluid catalytic cracking that comprises, vertically from bottom to top along said rector, a coaxial pre-lifting section, a first reaction zone, a second reaction zone with an expanded diameter and an outlet zone with a reduced diameter, and a horizontal pipe connected to the end of said outlet zone. The first reaction zone and the second reaction zone of the reactor can not only process under different conditions of, but also feedstock oils with different properties can be processed in separate stages.

CN1076751C discloses a catalytic conversion process for preparing isobutane and isoalkane-rich gasoline, comprising feeding a preheated feedstock oil to a reactor having two reaction zones, contacting it with a hot cracking catalyst in the presence of a steam, carrying out primary and secondary reactions under cracking reaction conditions of a temperature of 530°-620° C. for 0.5-2 seconds in the first reaction zone and a temperature of 460-530° C. for 2-30 seconds in the second reaction zone, separating reaction products, feeding the spent catalyst that has been stripped to a regenerator, recycling the catalyst after coke thereon is burned.

SUMMARY OF THE INVENTION

The object of the present invention is to provide a novel process for cracking hydrocarbon oils, having higher ability of cracking and desulfurizing heavy oils.

The process of the present invention comprises contacting a hydrocarbon oil with a catalyst in a reactor having multiple reaction zones under cracking reaction conditions, separating reaction products and the catalyst to obtain a spent catalyst, regenerating at least a part of the spent catalyst, wherein said catalyst is a cracking catalyst containing metal component or a catalyst mixture of a cracking catalyst containing metal component and a cracking catalyst free of a metal component, wherein said metal component is present in maximum valence state or reduction valence state; based on said cracking catalyst containing metal component and calculated by oxide of the metal component in the maximum oxidation state, the content of metal component is 0.1-30 wt %; said metal component is one or more metals selected from the group consisting of non-aluminum metals of Group III A, metals of Group IVA, Group VA, Group IB, Group IIB, Group VB, Group VIB and Group VIIB, non-noble metals of Group VIII, and rare-earth metals in the Periodic Table of Elements; contacting a part of the spent catalyst and/or the regenerated catalyst with the hydrocarbon oil in the first reaction zone; contacting and reacting the other part of the spent catalyst and/or the regenerated catalyst in at least one of reaction zones after the first reaction zone with the products obtained in previous reaction zone; said process comprising further a step which comprises contacting the spent catalyst and/or the regenerated catalyst, or the mixture of the spent catalyst and/or the regenerated catalyst with a fresh catalyst with an atmosphere containing a reducing gas, prior to contacting and reacting with hydrocarbon oil or products obtained in previous reaction zones in at least a reaction zone; wherein the catalyst contacts with the atmosphere containing a reducing gas at a temperature of 100-900° C., at a pressure 0.1-0.5 MPa for at least 1 second and the amount of the atmosphere containing a reducing gas is no less than 0.03 cubic meters of the reducing gas per ton of the cracking catalyst containing metal component per minute.

The process of present invention has a higher ability of heavy oil cracking and gasoline desulfurizing.

In the process of the present invention, operational conditions for each reaction zone can be properly changed by increasing or reducing the number of the reaction zones according to market demand, such as, adjusting reaction temperature, catalyst/oil weight ratio (weight ratio of a catalyst to a hydrocarbon oil), reaction time and the like, to prepare different target products. For example, the yield of LPG and gasoline can be increased by increasing the temperature of each reaction zone and/or increasing the number of the reaction zones; and the temperature of the reaction zones after the first reaction zone may be lowered to reduce LPG output and produce maximally gasoline and/or diesel oil.

DETAILED DESCRIPTION OF THE INVENTION

1. Reduction Process

Figure 1:
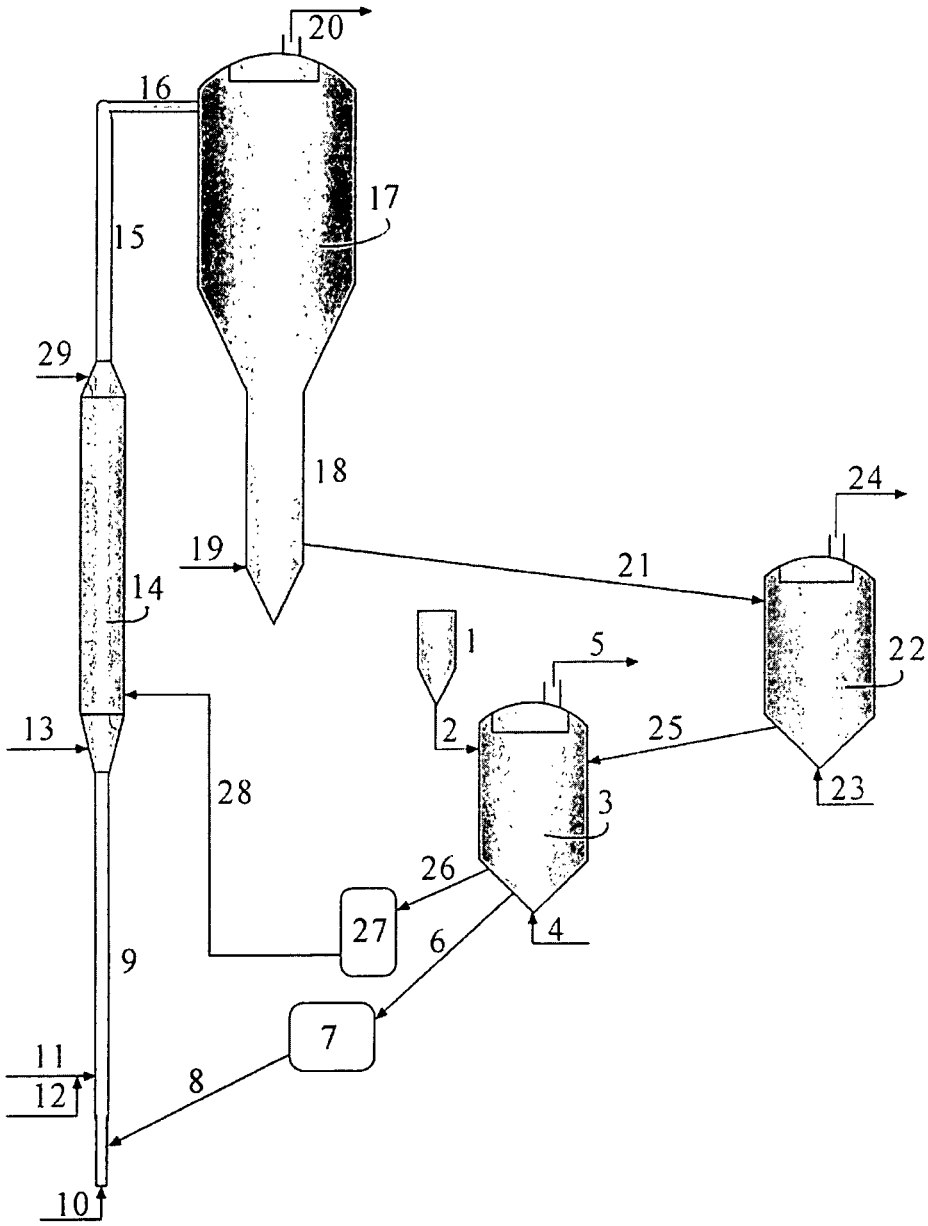
FIGS. 1-16 illustrate the schemes of the process according to the present invention.

According to the process of the present invention, contacting said catalyst with an atmosphere containing a reducing gas may be carried out in situ or by circulating the catalyst to a reduction reactor, dependent upon the type of cracking reactor in which the reaction is conducted. When the cracking reactor is a fixed bed, a fluidized bed reactor or a moving-bed reactor, the catalyst is regenerated directly in situ without being circulated, and then an atmosphere containing a reducing gas is introduced to contact with the catalyst. The recycle of the catalyst can be realized by using cyclically a reactor filled with the catalyst that has contacted with an atmosphere containing a reducing gas. However, when a riser reactor is used as the cracking reactor, the catalyst is circulated into a regenerator, followed by circulating the regenerated catalyst into a reduction reactor where the catalyst contacts with the atmosphere containing a reducing gas.

The regenerated catalyst includes completely regenerated catalyst, partially regenerated catalyst, or a mixture thereof.

The catalyst entering the reduction reactor may be a regenerated catalyst directly from the regenerator or a regenerated catalyst from the regenerator that has been cooled or heated after being regenerated. The catalyst that has contacted with the atmosphere containing a reducing gas may be introduced directly into a riser reactor or be introduced into a riser reactor after being cooled or heated. The regenerated catalyst and the catalyst that has contacted with the atmosphere containing a reducing gas may be cooled or heated by any present heat-exchange apparatuses, such as shell-tube exchanger, plate heat exchanger, floating coil heat exchanger and/or hot air heater. These heat-exchange apparatuses are well known for one skilled in the art.

In the reduction reactor, the catalyst may contact with the atmosphere containing a reducing gas at a temperature ranging from 100-900° C., preferably 400-700° C., at a pressure of 0.1-0.5 MPa, preferably 0.1-0.3 MPa, for at least 1 second, preferably from 10 seconds to 1 hr, more preferably from 1-40 minutes. The amount of the atmosphere containing a reducing gas is not less than 0.03 cubic meters of the reducing gas per ton of the cracking catalyst containing metal component per minute, preferably 0.05-15 cubic meters of the reducing gas per ton of the cracking catalyst containing metal component per minute, more preferably 1-8 cubic meters of the reducing gas per ton of the cracking catalyst containing metal component per minute. Said atmosphere containing a reducing gas refers to a pure reducing gas or an atmosphere containing a reducing gas and an inert gas.

Examples of said pure reducing gas include one or more gases selected from hydrogen, carbon monoxide and hydrocarbons containing 1-5 carbon atoms, preferably one or more gases selected from hydrogen, carbon monoxide, methane, ethane, propane, butane, pentane and their isomers.

Said inert gas refers to gas that does not react with a composition or metal compounds, such as one or more gases selected from the group consisting of Group zero gases in the Periodic Table of Elements, nitrogen, and carbon dioxide.

Examples of the atmosphere containing a reducing gas and inert gas include a mixture of one or more gases selected from hydrogen, carbon monoxide, and hydrocarbons containing from 1 to 5 carbon atoms with one or more inert gases, or dry gas from refinery (e.g. catalytic cracking tail gas, catalytic reforming tail gas, hydrocracking tail gas and/or delayed coking tail gas and the like).

In said atmosphere containing a reducing gas, the concentration of the reducing gas is not particularly limited. The content of reducing gas is preferably at least 10%, more preferably 50% by volume of said atmosphere containing a reducing gas.

2. Cracking Reaction—Regeneration Process

According to the process of the present invention, a reactor comprises multiple reaction zones, i.e. are a first reaction zone, a second reaction zone, a third reaction zone . . . arranged along the direction in which hydrocarbon oils flow. The number of reaction zones can be increased or reduced according to different requirements, and the number of reaction zones is preferably 2 to 5, more preferably 2 to 3, wherein the first reaction zone is a first cracking reaction zone, the second reaction zone is a secondary reaction zone, and the following reaction zones are zones for multiple reactions.

Said reactor may be a reactor of any form or combination of reactors. For example, the reactor may be one of reactors in any form and having multiple reaction zones, or a combination of reactors in any form and having multiple reaction zones, or a combination of reactors in any from and having multiple reaction zones with reactors having a single reaction zone, or a combination of reactors having a single reaction zone.

More specifically, said reactor may be a riser reactor, a fixed-bed reactor, a fluidized bed reactor, a moving-bed reactor or combination thereof.

More preferred reactor is a riser reactor or a combination of riser reactors, such as, an ordinary riser reactor, a riser reactor having multiple reaction zones (the riser reactor for fluid catalytic cracking disclosed in CN1078094C), or a combination of riser reactors mentioned above. An ordinary riser reactor, such as an equal-diameter riser reactor or an equal-linear speed riser reactor, may be used as a reactor with multiple zones for the present invention.

Cracking reaction conditions in each reaction zone may be the same, or different which can all be conventional cracking reactions. Said conventional conditions for cracking reaction include a reaction temperature of 350-700° C., preferably 400-650° C., a reaction pressure of 0.1-0.8 MPa, preferably 0.1-0.5 MPa and a catalyst/oil weight ratio of 1-30, preferably 2-15.

For example, when the reactor is a riser reactor having multiple reaction zones, cracking reaction conditions in each reaction zone may be adjusted by conventional measures, such as injecting a chilling agent into a region connecting two adjacent reaction zones and placing a heat exchanger in front of reaction zones requiring the same to adjust the temperature of a catalyst entering a corresponding reaction zone and/or the temperature for feeding hydrocarbon oils, so as to adjust the reaction temperature in each reaction zone, and adjusting the reaction time by adjusting the feeding rate of hydrocarbon oils. For example, adjusting the temperature of a catalyst entering a corresponding reaction zone could be realized by placing a heat exchanger in front of said reaction zone. Said heat exchanger may be a shell-tube exchanger, a plate heat exchanger, a floating coil heat exchanger and/or a hot air heater. Said heat exchanger and chilling agent are well known for one skilled in the art.

In order to inhibit overcracking and thermal cracking reactions in a certain reaction zone and an outlet zone in the riser reactor, gas-solid rapid separation method may be used, or a chilling agent or a terminator may be injected into a region connecting said reaction zone with an adjacent previous reaction zone, or a region connecting the last reaction zone with an outlet zone, so as to reduce the temperature of the reaction zone and the outlet zone in the riser reactor. In this way, the product distribution can be improved, and the yield of gasoline and diesel oil can be increased. For gas-solid rapid separation methods, please see EP163978, EP139392, EP564678, U.S. Pat. No. 5,104,517 and U.S. Pat. No. 5,308,474. For methods of adding a chilling agent, please see U.S. Pat. No. 5,089,235 and EP593823. Said chilling agent and terminator may be one or more selected from the group consisting of crude gasoline, gasoline, diesel oil, cycle oil from a fractionator, and water.

When said reactor is a riser reactor, preferably, cracking reaction conditions in the first reaction zone are a reaction temperature of 450-650° C., preferably 490-620° C., a reaction pressure of 0.1-0.5 MPa, preferably 0.1-0.3 MPa, a contact time of 0.4-6 seconds, preferably 0.8-4 seconds, a catalyst/oil weight ratio of 1-30, preferably 2-15, and the amount of atomizing steam is 1-30%, preferably 2-15%, by weight of hydrocarbon oil. Here, the catalyst/oil weight ratio in a certain reaction zone refers to a weight-ratio of the amount a catalyst circulated in the reaction zone to the amount of a hydrocarbon oil introduced into a first reaction zone within unit time.

Cracking reaction conditions in the second reaction zone are adjusted according to the type of catalyst and hydrocarbon oil and requirements of the composition and properties of products. In the second reaction zone, the reaction temperature is 470-650° C., preferably 480-580° C., the reaction pressure is 0.1-0.5 MPa, preferably 0.1-0.3 MPa, the contact time is 1-15 seconds, preferably 2-10 seconds and the catalyst/oil weight ratio is from above 1-3 times, preferably 1.1-2 times of that in the first reaction zone.

In the third reaction zone and subsequent reaction zones, reactants are reaction products obtained by cracking reactions in the first and second riser reactors. Cracking reaction conditions are relatively mild in order to avoid overcracking. Cracking reaction conditions in the third reaction zone and subsequent reaction zones are a reaction temperature of 450-550° C., preferably 470-520° C., a reaction pressure of 0.1-0.5 MPa, preferably 0.1-0.3 MPa, a contact time of 1-4 seconds, preferably 1-2 seconds and a catalyst/oil weight ratio is 1-3 times, preferably 1.1-2 times of that in the first reaction zone.

Conditions in the outlet zone of the riser reactor are conventional conditions, including a temperature of 460-590° C., preferably 470-570° C., a contact time of 0.1-1 second, preferably is 0.1-0.8 second. The conditions in the outlet zone of the riser reactor are well known for one skilled in the art.

When the reactor is a fixed-bed reactor, a fluidized bed reactor or a moving-bed reactor, said fixed-bed reactor having multiple zones may comprise multiple fixed beds in series, multiple fluidized-bed reactors in series, multiple moving-bed reactors in series, or a combination of a fixed-bed reactor, fluidized-bed reactor and moving-bed reactor in series, wherein one reactor is a reaction zone. Cracking reaction conditions in each reactor (relative to each reaction zone) may be adjusted by conventional methods, such as adjustment of reaction temperature in each fixed-bed reactor (relative to each reaction zone) by heating or cooling.

Generally, with regard to a fixed bed, fluidized bed and moving-bed reactor, the cracking conditions in each reaction zone are a reaction temperature of 350-700° C., preferably 400-650° C., a reaction pressure of 0.1-0.8 MPa, preferably 0.1-0.5 MPa, a WHSV of 1-40 $hrs^{-1}$, preferably 2-30 $hrs^{-1}$ and a catalyst/oil weight ratio of 1-30, preferably 2-15. Cracking reaction conditions in the first reaction zone, second reaction zone and subsequent reaction zones may be respectively adjusted within the ranges of cracking conditions mentioned above, according to the type of catalyst and hydrocarbon oils and the requirement for the composition and properties of products for each reaction zone.

When the cracking reactor is a riser reactor, the process of the present invention can be performed by directly using a present reaction-regeneration system, with an addition of a reduction reactor. Various modes of a present reaction-regeneration system are well known for one skilled in the art. For example, a present reaction-regeneration system may be a side-by-side type with the same height, a side-by-side type with different heights, or a coaxial type of reaction-regeneration system, according to the arrangement of disengager and regenerator. The riser reactor can be inserted into the disengager along the axial direction of the disengager and stripping section, or an external riser reactor. Said riser reactor comprises any form of feed nozzle, a Mixing Temperature Control device, a facility for terminating reactions, and the like. A summary description of the present catalytic cracking reaction-regeneration systems has been made in Residual Oil Processing Processes, (pp. 282-338, Ed. by Lee Chun-nian, China Petrochemical Publisher, 2002). The book describes ROCC-V process unit; a total Daqing vacuum residue catalytic cracking (VR-RFCC) process unit; a residual oil fluid catalytic cracking (RFCC) unit having a two-stage regeneration of Total Corp, US; an atmospheric heavy oil conversion RCC process unit having a two-stage regeneration jointly developed by Ashland Corp and UOP; a highly efficient regeneration FCC process unit with a coke-burning tank of UOP; a flexible riser reactor catalytic cracking unit of a combination of a riser reactor with a bed reactor of Flexicracking IIIR process of Exxon; and an one section counter flow regeneration unit and an ultra-orthoflow FCC process unit of heavy oil cracking process (HOC) of kellogg corporation. Said reaction-regeneration systems are not restricted to the aforesaid examples.

Said regenerator may be a single-stage regenerator or a two-stage regenerator. Said single-stage regenerator may be a single-stage regenerator with a turbulent bed or a single-stage regenerator with a rapid bed. Said two-stage regenerator may be a two-stage regenerator with a turbulent bed, a two-stage regenerator formed by a coke-burning tank in combination with a conventional turbulence bed, a two-stage regenerator with a rapid bed, or a tubular regenerator. Said two-stage regenerator with a turbulent bed may be a twin counter flow two-stage regenerator, or a twin cross flow two-stage regenerator. Said two-stage regenerator formed by a coke-burning tank in combination with a conventional turbulent bed may be a two-stage regenerator with a pre-positioned coke-burning tank or a two-stage regenerator with a post-positioned coke-burning tank. If desired, said regenerator may comprise an internal heat sink or external heat sink. Said internal sink may be cooling coils arranged horizontally or vertically in the bed. Said external sink may be of up-flow type, down-flow type, back-mixing flow type, or pneumatic controlled type. A summary description of regenerators has also been made in Residual Oil Processing Process (pp. 282-338, Ed. by Lee Chun-nian, China Petrochemical Publisher 2002).

In the first preferred embodiment according to the present invention, the process of the present invention comprises contacting a hydrocarbon oil with said catalyst in a reactor having multiple reaction zones under cracking reaction conditions; separating reaction products and said catalyst to obtain a spent catalyst; regenerating the spent catalyst; contacting the regenerated catalyst with said atmosphere containing a reducing gas; contacting and reacting a part of the catalyst that has contacted with the atmosphere containing a reducing gas with hydrocarbon oil in the first reaction zone; in at least one of reaction zones after the first reaction zone, contacting and reacting the other part of the catalyst that has contacted with the atmosphere containing a reducing gas with the product obtained in previous reaction zones in sequence.

In the second preferred embodiment according to the present invention, the process of the present invention comprises contacting the hydrocarbon oil with said catalyst in a riser reactor having multiple reaction zones under cracking reaction conditions; separating reaction products and catalyst to obtain a spent catalyst; circulating the spent catalyst to a regenerator to regenerate, recycling the regenerated catalyst; introducing the regenerated catalyst or a mixture of the regenerated catalyst with a fresh catalyst into a reduction reactor to contact with said atmosphere containing a reducing gas, wherein the reduction reactor is set between the regenerator and riser reactor; circulating a part of the catalyst that has contacted with the atmosphere containing a reducing gas into the first reaction zone to contact and react with the hydrocarbon oil; circulating the other part of the catalyst that has contacted with the atmosphere containing a reducing gas to at least one of reaction zones after the first reaction zone to contact and react with the products obtained in previous reaction zone.

In the third preferred embodiment according to the present invention, the process of the present invention comprises contacting the hydrocarbon oil with said catalyst in a reactor having multiple reaction zones under cracking reaction conditions; separating reaction products and the catalyst to obtain a spent catalyst; regenerating a part of the spent catalyst; contacting the regenerated catalyst or a mixture of the regenerated catalyst and a fresh catalyst with said atmosphere containing a reducing gas, contacting and reacting in the first reaction zone the catalyst that has contacted with the atmosphere containing a reducing gas with the hydrocarbon oil; contacting and reacting the other part of the separated spent catalyst in at least one of reaction zones after the first reaction zone with the products obtained in previous reaction zone in sequence.

In the fourth preferred embodiment according to the present invention, the process of the present invention comprises contacting the hydrocarbon oil with said catalyst in a riser reactor having multiple reaction zones under cracking reaction conditions, separating reaction products and the catalyst to obtain a spent catalyst, circulating a part of the spent catalyst to a regenerator to regenerate, circulating the regenerated catalyst or a mixture of the regenerated catalyst and the fresh catalyst to a reduction reactor to contact with said atmosphere containing a reducing gas, wherein the reduction reactor is set between the regenerator and riser reactor; circulating the catalyst that has contacted with the atmosphere containing a reducing gas into the first reaction zone to contact and react with said hydrocarbon oil; circulating the other part of the spent catalyst into at least one of reaction zones after the first reaction zone to contact and react with the reaction products obtained in previous reaction zone.

In the fifth preferred embodiment according to the present invention, the process of the present invention comprises contacting the hydrocarbon oil with said catalyst in a reactor having multiple reaction zones under cracking reaction conditions; separating reaction products and the catalyst to obtain a spent catalyst; regenerating the spent catalyst; contacting a part of the regenerated catalyst or a mixture of a part of the regenerated catalyst and the fresh catalyst with said atmosphere containing a reducing gas; contacting and reacting the catalyst that has contacted with the atmosphere containing a reducing gas with said hydrocarbon oil in the first reaction zone; contacting and reacting the other part of the regenerated catalyst in at least one of reaction zones after the first reaction zone with the reaction products obtained in previous reaction zone in sequence.

In the sixth preferred embodiment according to the present invention, the process of the present invention comprises contacting the hydrocarbon oil with said catalyst in a riser reactor having multiple reaction zones under cracking reaction conditions; separating reaction products and the catalyst to obtain a spent catalyst; circulating the spent catalyst to a regenerator to regenerate, recycling the regenerated catalyst; circulating a part of the regenerated catalyst or a mixture of a part of the regenerated catalyst with the fresh catalyst to a reduction reactor to contact with said atmosphere containing a reducing gas, wherein the reduction reactor is set between the regenerator and the riser reactor; circulating the catalyst that has contacted with the atmosphere containing a reducing gas to the first reaction zone to contact and react with said hydrocarbon oil; contacting and reacting the other part of the regenerated catalyst in at least one of reaction zones after the first reaction zone with the reaction product obtained in previous reaction zone in sequence.

In the seventh preferred embodiment according to the present invention, the process of the present invention comprises contacting the hydrocarbon oil with said catalyst in a reactor having multiple reaction zones under cracking reaction conditions; separating reaction products and the catalyst to obtain a spent catalyst; regenerating the spent catalyst; contacting and reacting a part of the regenerated catalyst with said hydrocarbon oil in the first reaction zone; contacting the other part of the regenerated catalyst or a mixture of the other part of the regenerated catalyst and the fresh catalyst with said atmosphere containing a reducing gas; in at least one of reaction zones after the first reaction zone, contacting and reacting the catalyst that has contacted with the atmosphere containing a reducing gas with the products obtained in previous reaction zone in sequence.

In the eighth preferred embodiment according to the present invention, the process of the present invention comprise contacting the hydrocarbon oil with said catalyst in a riser reactor having multiple reaction zones under cracking reaction conditions; separating reaction products and the catalyst to obtain a spent catalyst; circulating the spent catalyst to a regenerator to regenerate, circulating a part of the regenerated catalyst to the first reaction zone to contact and react with said hydrocarbon oil, circulating the other part of the regenerated catalyst or a mixture of the other part of the regenerated catalyst with the fresh catalyst to a reduction reactor to contact with said atmosphere containing a reducing gas wherein the reduction reactor is set between the regenerator and the riser reactor; circulating the catalyst that has contacted with the atmosphere containing a reducing gas to at least one of reaction zones after the first reaction zone to contact and react with the product obtained in previous reaction zone in sequence.

Some specific embodiments of the present invention are explained hereinafter in combination with the drawings.

These embodiments are only some typical ones among the many embodiments of the present invention. The type, size, shape, parameters of reactor and other apparatus and number of reaction zones may be designed according to these embodiments based on practical situations.

According to the first specific embodiment of the present invention, the process of the present invention can be carried out according to the scheme shown in FIG. 1. Reactor is a riser reactor for fluid catalytic cracking as disclosed in CN 1078094C. The reactor comprises vertically from bottom to top along said rector, a coaxial pre-lifting section, a first reaction zone, a second reaction zone with an expanded diameter and an outlet zone with a reduced diameter, and a horizontal pipe connected to the end of said outlet zone. Preferably, in said reactor, the diameter ratio of the first reaction zone to the pre-lifting section is 1-1.2, the diameter ratio of the second reaction zone to the first reaction zone is 1.5-5.0, the diameter ratio of the outlet zone to the first reaction zone is 0.8-1.5. The pre-lifting section has a height 5-20% of total height of the reactor. The first reaction zone has a height 10-30% of total height of the reactor. The second reaction zone has a height 30-60% of total height of the reactor. The outlet zone has a height of 0-20% of total height of the reactor. The region connecting the first reaction zone and the second reaction zone is in truncated cone having a longitudinal section as an isosceles trapezoid with a top angle $\alpha$ of 30°-80°, the region connecting the second reaction zone and the outlet zone is also in truncated cone having a longitudinal section as an isosceles trapezoid with a base angle $\beta$ of 45-85°.

According to the first specific embodiment of the present invention, the process of the present invention can be carried out according to the scheme shown in FIG. 1. A part of a catalyst that has contacted with an atmosphere containing a reducing gas from reduction reactor 3 is optionally introduced into heat exchanger 7 via line 6 to carry out heat-exchange. The optionally heat-exchanged catalyst is introduced into the pre-lifting section of reactor via line 8, then driven by pre-lifting steam from line 10 to move upward into the first reaction zone 9. Meanwhile, the preheated hydrocarbon oil from line 11 is mixed with the atomizing steam from 12 and introduced into the first reaction zone 9, where said hydrocarbon oil contacts with the catalyst to carry out a cracking reaction. The reaction stream continues to move upward into the second reaction zone 14, meanwhile, the other part of the catalyst that has contacted with the atmosphere containing a reducing gas from reduction reactor 3 is optionally introduced into heat exchanger 27 via line 26 to carry out heat-exchange. The optionally heat-exchanged catalyst is introduced into the second reaction zone 14 via line 28. In the second reaction zone 14, the reaction stream from the first reaction zone 9 contacts with the catalyst from line 28 to carry out a second reaction. If cooling is required, a chilling agent from line 13 may be injected into the region connecting the reaction zone 9 with the second reaction zone 14 to mix with the reaction stream. After the second reaction, the stream continues to move upward through outlet zone 15 into settler 17 of the separation system via a horizontal pipe 16. The catalyst and cracked products are separated in settler 17 by the cyclone separator. In order to inhibit overcracking and thermal cracking in the outlet zone of the riser, the temperature of reaction stream can be decreased by using gas-solid rapid separation or adding a terminator via line 29 to the region connecting the outlet zone 15 and the second reaction zone 14. The separated catalyst is introduced into stripper 18 of the separation system to contact in counter flow with steam from line 19, and cracked products remained on the catalyst are stripped out to obtain a spent catalyst. The cracked products obtained by separation and stripped products are mixed and discharged via line 20, then continue to be separated into various distillates in the separation system. The spent catalyst is introduced into regenerator 22 via sloped tube 21, in regenerator 22 the spent catalyst contacts with the oxygen-containing atmosphere from line 23 at regeneration temperature to remove coke thereon, and flue gas formed is vented from line 24. The regenerated catalyst is introduced into reduction reactor 3 via line 25, where the regenerated catalyst or the mixture of the regenerated catalyst with a fresh catalyst from storage tank 1 via line 2 contacts with the atmosphere containing a reducing gas from line 4 under reduction conditions. The waste gas formed is vented out via line 5. In this case, when the temperature of the reduction reactor 3 is at a reaction temperature required for the first or second reaction zone, the catalyst that has contacted with the atmosphere containing a reducing gas can be introduced directly into the pre-lifting section of the reactor or the second reaction zone without passing through the heat exchanger 7 or heat exchanger 27.

Figure 2:
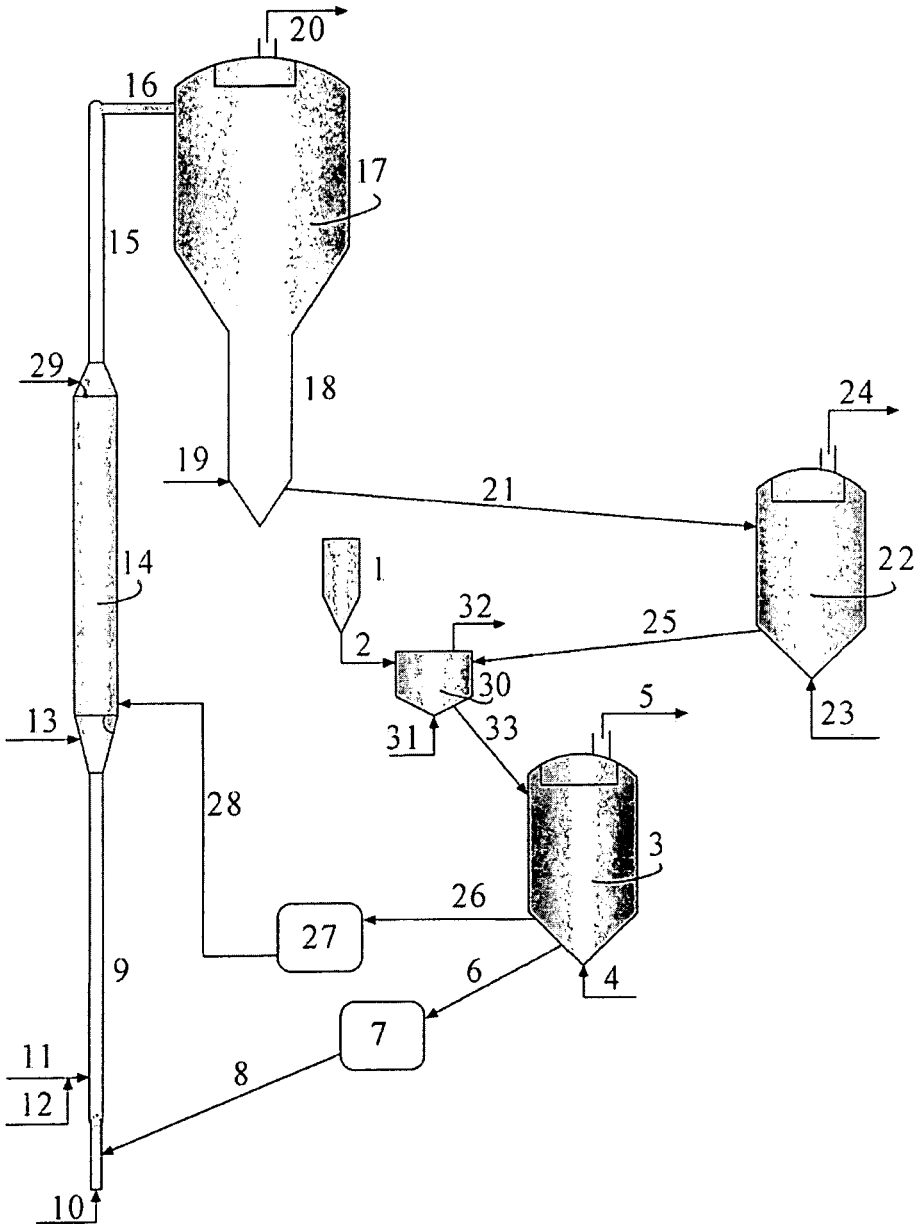

According to the second specific embodiment of the present invention, the process of the present invention can be carried out according to the scheme shown in FIG. 2. The reactor is that described in the first specific embodiment.

A part of catalyst that has contacted with the atmosphere containing a reducing gas from reduction reactor 3 is optionally introduced into heat exchanger 7 via line 6 to carry out heat-exchange. The optionally heat-exchanged catalyst is introduced into the pre-lifting section of the reactor via line 8, then driven by pre-lifting steam from line 10 to move upward into the first reaction zone 9. Meanwhile, the preheated hydrocarbon oil from line 11 is mixed with the atomizing steam from 12, and introduced into the first reaction zone 9, where said hydrocarbon oil contacts with the catalyst to carry out a first cracking reaction. The reaction stream continues to move upward to the second reaction zone 14, meanwhile, the other part of the catalyst that has contacted with the atmosphere containing a reducing gas from reduction reactor 3 is optionally introduced into heat exchanger 27 via line 26 to carry out heat-exchange. The optionally heat-exchanged catalyst is introduced into the second reaction zone 14, where the reaction stream from the first reaction zone 9 contacts with the catalyst from line 28 to carry out a second reaction. If cooling is required, a chilling agent from line 13 may be injected into the region connecting the reaction zone 9 with the second reaction zone 14 to mix with the reaction stream. After the second reaction, the stream continues to move upward through outlet zone 15 into settler 17 of the separation system via a horizontal pipe 16. The catalyst and cracked products are separated in settler 17 by the cyclone separator. In order to inhibit overcracking and thermal cracking in outlet zone of the riser, the temperature of reaction stream can be decreased by using gas-solid rapid separation or adding a terminator via line 29 to the region connecting the outlet zone 15 and the second reaction zone 14. The separated catalyst is introduced into stripper 18 of the separation system to contact in counter flow with steam from line 19, and cracked products remained on the catalyst are stripped out to obtain a spent catalyst. The cracked products obtained by separation and stripped products are mixed and discharged via line 20, then continue to be separated into various distillates in the separation system. The spent catalyst is introduced into regenerator 22 via sloped tube 21. In regenerator 22, the spent catalyst contacts with the oxygen-containing atmosphere from line 23 at the regeneration temperature to remove coke thereon, and flue gas formed is vented out from line 24. The regenerated catalyst via line 25 is introduced into gas displacement tank 30, where the oxygen-containing gas entrained by the regenerated catalyst or the mixture of the regenerated catalyst with a fresh catalyst from storage tank 1 via line 2 is displaced with an inert gas from line 31. The displacing gas used is vented out via line 32, and the gas-displaced catalyst is introduced into reduction reactor 3 via line 33. In the reduction reactor 3, the catalyst that has been displaced with gas contacts with the atmosphere containing a reducing gas from line 4 and the waste gas formed is vented out via line 5. When the temperature of reduction reactor 3 is at a reaction temperature required for the first or second reaction zone, the catalyst that has contacted with the atmosphere containing a reducing gas can be introduced directly into the pre-lifting section of the reactor or the second reaction zone without passing through the heat exchanger 7 or heat exchanger 27. Introduction of gas displacement tank 30 can make the oxygen-containing atmosphere entrained by the regenerated catalyst be displaced and the reduction reaction in reduction reactor 3 be carried out more sufficiently and reduce the consumption of reducing gas.

Figure 3:
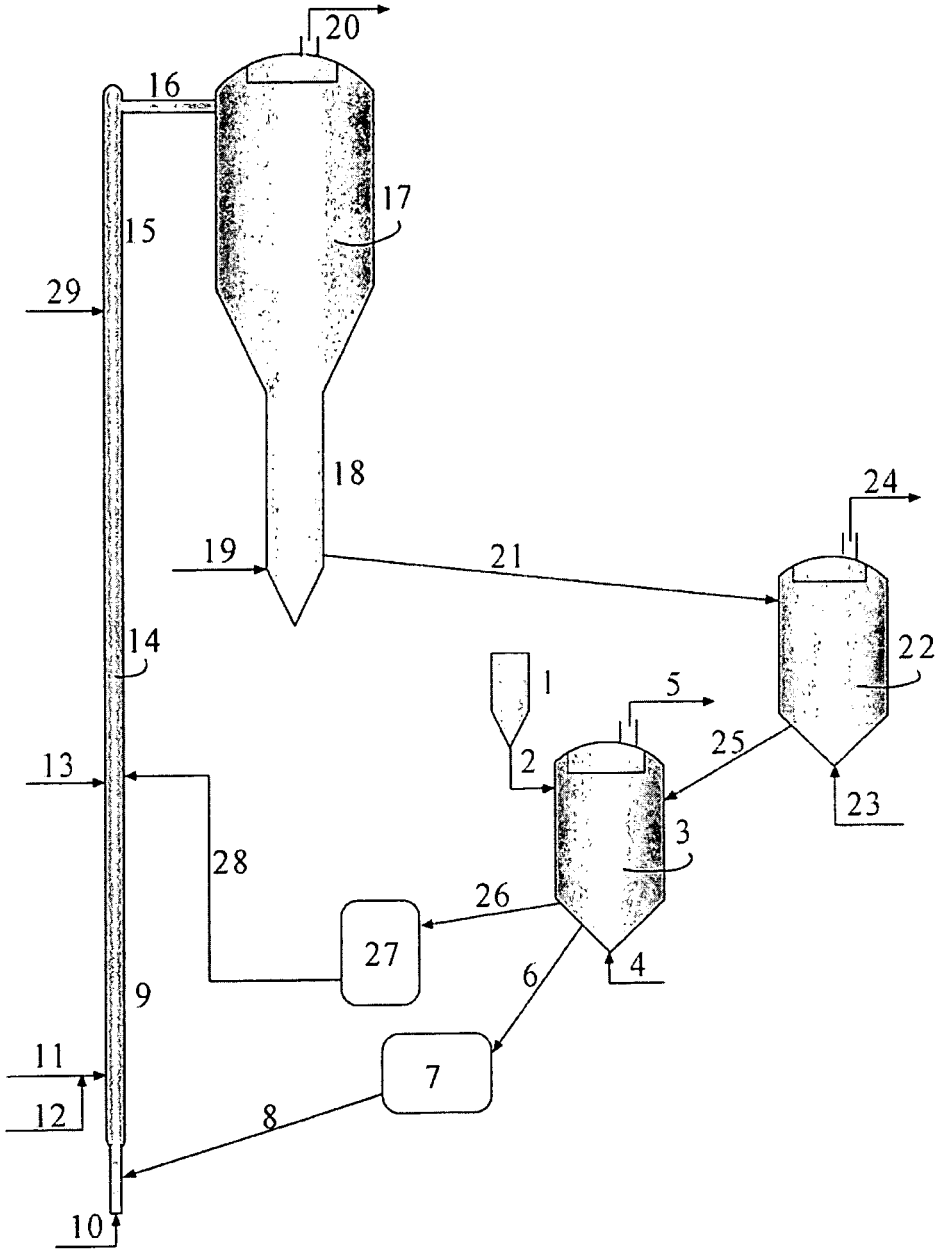

According to the third specific embodiment of the present invention, the process of the present invention can be carried out according to the scheme shown in FIG. 3. This embodiment has the same scheme as the first specific embodiment, except that a common riser reactor is used in stead of said reactor in the first specific embodiment.

Figure 4:
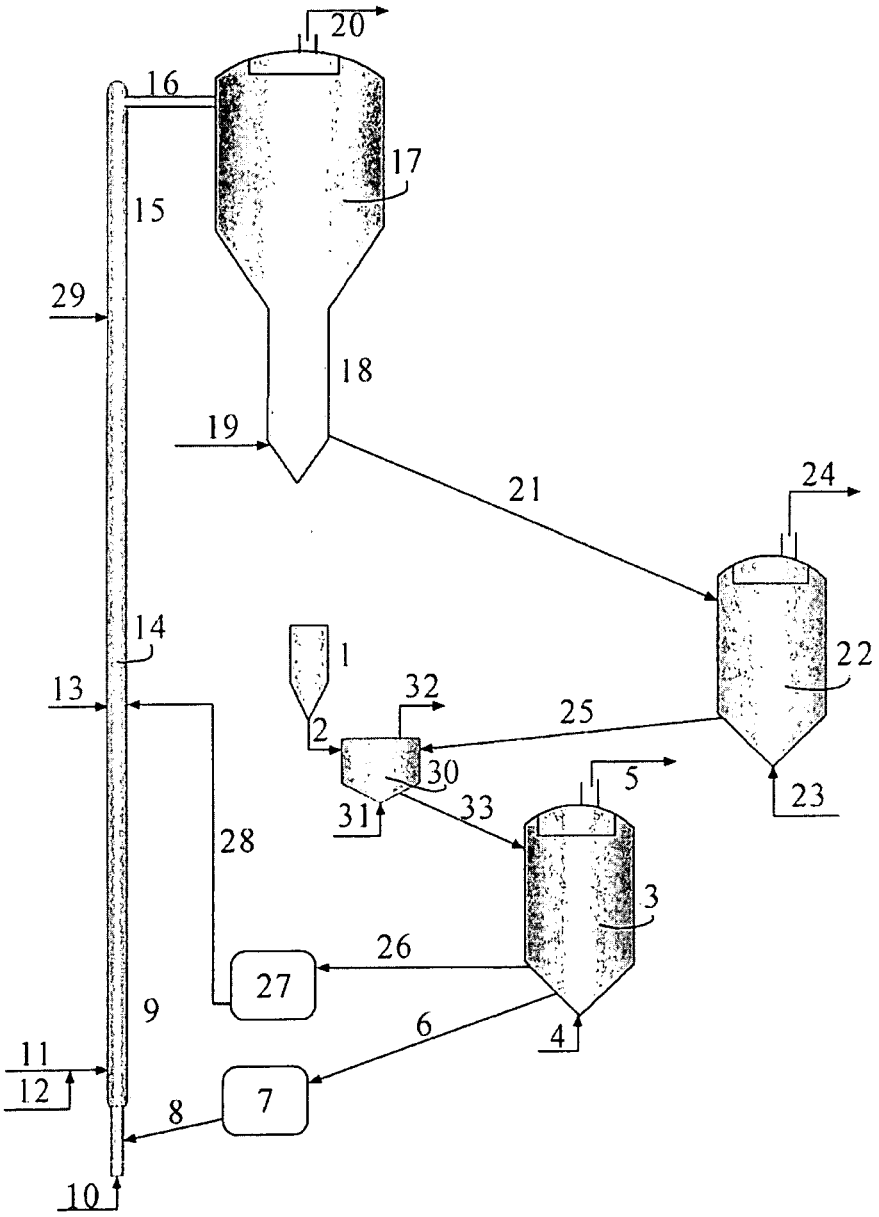

According to the fourth specific embodiment of the present invention, the process of the present invention can be carried out according to the scheme shown in FIG. 4. This embodiment has the same scheme as the second specific embodiment, except that a common riser reactor is used in stead of said reactor in the first specific embodiment.

Figure 5:
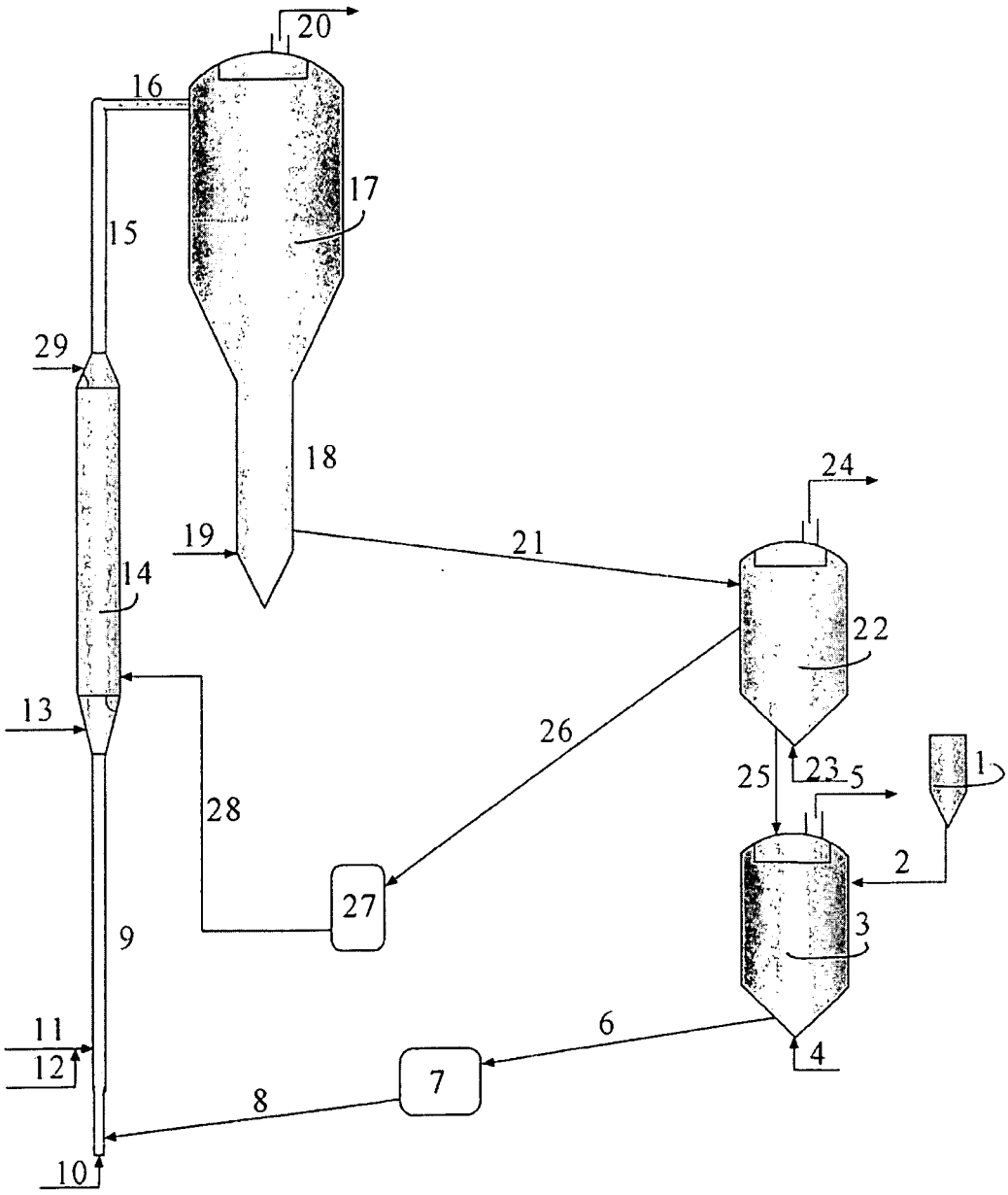

According to the fifth specific embodiment of the present invention, the process of the present invention can be carried out according to the scheme shown in FIG. 5. The reactor is as described in the first specific embodiment.

The catalyst that has contacted with the atmosphere of reducing gas is introduced into the pre-lifting section of the reactor from line 8, and then driven by pre-lifting steam from line 10 to move upward into the first reaction zone 9. Meanwhile, the preheated hydrocarbon oil from line 11 is mixed with the atomizing steam from 12 and introduced into the first reaction zone 9, where said hydrocarbon oil contacts with the catalyst to carry out a first cracking reaction. The reaction stream continues to move upward to the second reaction zone 14, where it contacts with the spent catalyst from line 28 to carry out a second reaction. If cooling is required, a chilling agent from line 13 may be injected into the region connecting the reaction zone 9 and the second reaction zone 14 to mix with the reaction material. After the second reaction, the stream continues to move upward through outlet zone 15 into settler 17 of the separation system via a horizontal pipe 16. The catalyst and cracked products are separated in settler 17 by the cyclone separator. In order to inhibit overcracking and thermal cracking in outlet zone of the riser, the temperature of reaction stream can be decreased by using gas-solid rapid separation or adding a terminator via line 29 to the connection region of outlet zone 15 and the second reaction zone 14. The separated catalyst is introduced into stripper 18 of the separation system to contact in counter flow with steam from line 19, and cracked products remained on the catalyst are stripped out to obtain a spent catalyst. The cracked products obtained by separation and stripped products are mixed and discharged via line 20, then continue to be separated into various distillates in the separation system. The spent catalyst is introduced into regenerator 22 via sloped tube 21. In regenerator 22, a part of the spent catalyst contacts with the oxygen-containing atmosphere from line 23 at the regeneration temperature to remove coke thereon, and flue gas formed is vented out from line 24. The regenerated catalyst is introduced via line 25 into reduction reactor 3, where the regenerated catalyst or the mixture of the regenerated catalyst with a fresh catalyst from storage tank 1 via line 2 contacts with the atmosphere containing a reducing gas from line 4 under reduction conditions, and the waste gas formed is vented out via line 5. The catalyst that has contacted with the atmosphere containing a reducing gas from reduction reactor 3 is optionally introduced into heat exchanger 7 via line 8 to carry out heat-exchange, the optionally heat-exchanged catalyst is introduced into the pre-lifting section of reactor via line 8. The other part of the spent catalyst is introduced into regenerator 22, and then optionally introduced rapidly into heat exchanger 27 via line 26. The spent catalyst that has been optionally heat-exchanged is introduced into the second reaction zone via line 28 to contact and react with the reaction products from the first reaction zone. When the temperature of reduction reactor 3 is at a reaction temperature required for the first reaction zone, the catalyst that has contacted with the atmosphere containing a reducing gas can be introduced directly into the pre-lifting section of the reactor without passing through the heat exchanger 7. When the temperature of the spent catalyst from line 28 is at a reaction temperature required for the second reaction zone, the spent catalyst can be introduced directly into the second reaction zone without passing through heat exchanger 27.

Figure 6:
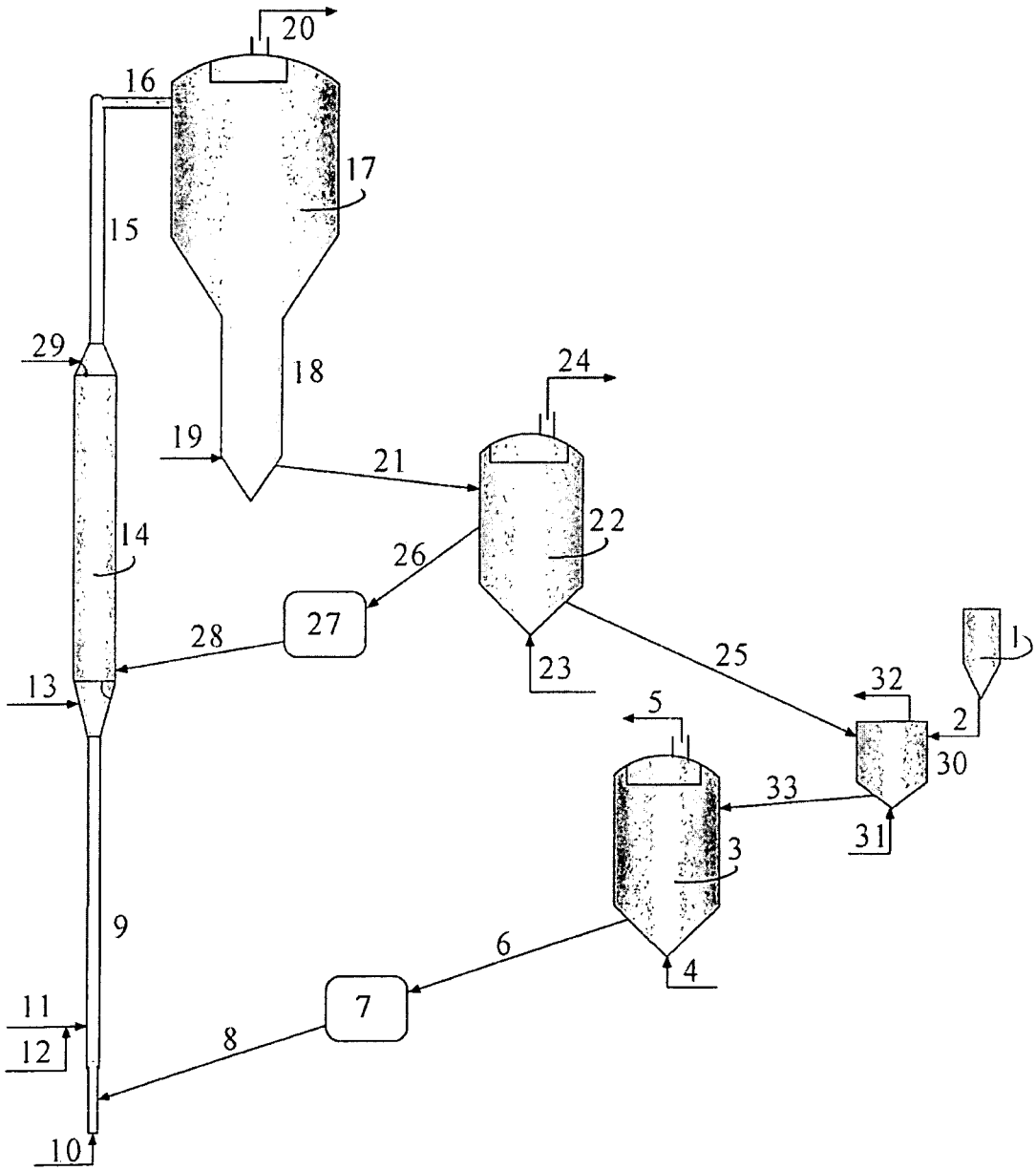

According to the sixth specific embodiment of the present invention, the process of the present invention can be carried out according to the scheme shown in FIG. 6. The reactor is as described in the first specific embodiment.

The catalyst that has contacted with the atmosphere containing a reducing gas is introduced into the pre-lifting section of the reactor from line 8, and then driven by pre-lifting steam from line 10 to move upward into the first reaction zone 9. Meanwhile, the preheated hydrocarbon oil from line 11 is mixed with the atomizing steam from 12 and introduced into the first reaction zone 9, where said hydrocarbon oil contacts with the catalyst to carry out a first cracking reaction. The reaction stream continues to move upward to the second reaction zone 14, where it contacts with the spent catalyst from line 28 to carry out a second reaction. If cooling is required, a chilling agent from line 13 may be injected into the region connecting the reaction zone 9 and the second reaction zone 14 to mix with the reaction material. After the second reaction, the stream continues to move upward through outlet zone 15 into settler 17 of the separation system via a horizontal pipe 16. The catalyst and cracked products are separated in settler 17 by the cyclone separator. In order to inhibit overcracking and thermal cracking in outlet zone of the riser, the temperature of reaction stream can be decreased by using gas-solid rapid separation or adding a terminator via line 29 to the region connecting outlet zone 15 and the second reaction zone 14. The separated catalyst is introduced into stripper 18 of the separation system to contact in counter flow with steam from line 19, and cracked products remained on the catalyst are stripped out to obtain a spent catalyst. The cracked products obtained by the separation and stripped products are mixed and discharged via line 20, then continue to be separated into various distillates in the separation system. The spent catalyst is introduced into regenerator 22 via sloped tube 21. In regenerator 22 a part of the spent catalyst contacts with the oxygen-containing atmosphere from line 23 at the regeneration temperature to remove coke thereon, and flue gas formed is vented out from line 24. The regenerated catalyst via line 25 is introduced into gas displacement tank 30, where the oxygen-containing gas entrained by the regenerated catalyst or the mixture of the regenerated catalyst with a fresh catalyst from storage tank 1 via line 2 is displaced with an inert gas from line 31. The displacing gas used is discharged out via line 32, and the gas-displaced catalyst is introduced into reduction reactor 3 via line 33. In reduction reactor 3 the gas-displaced catalyst contacts with the atmosphere containing a reducing gas from line 4 under reduction conditions, and the waste gas formed is vented via line 5. The catalyst that has contacted with the atmosphere containing a reducing gas from reduction reactor 3 is optionally introduced into heat exchanger 7 via line 6 to carry out heat-exchange, the optionally heat-exchanged catalyst is introduced into the pre-lifting section of reactor via line 8. The other part of the spent catalyst is introduced into regenerator 22, and then optionally introduced rapidly into heat exchanger 27. The spent catalyst that has been optionally heat-exchanged is introduced into the second reaction zone via line 28 to contact and react with the reaction products of the first reaction zone. Introduction of gas displacement tank 30 can make the oxygen-containing atmosphere entrained by the regenerated catalyst be displaced the reduction reaction in reduction tank 3 be carried out more sufficiently and decrease the consumption of reducing gas. When the temperature of reduction reactor 3 is at a reaction temperature required for the first reaction zone, the catalyst that has contacted with the atmosphere containing a reducing gas can be introduced directly into the pre-lifting section of the reactor without passing through the heat exchanger 7. When the temperature of the spent catalyst from line 28 is at a reaction temperature required for the second reaction zone, the spent catalyst can be introduced directly into the second reaction zone without passing through heat exchanger 27.

Figure 7:
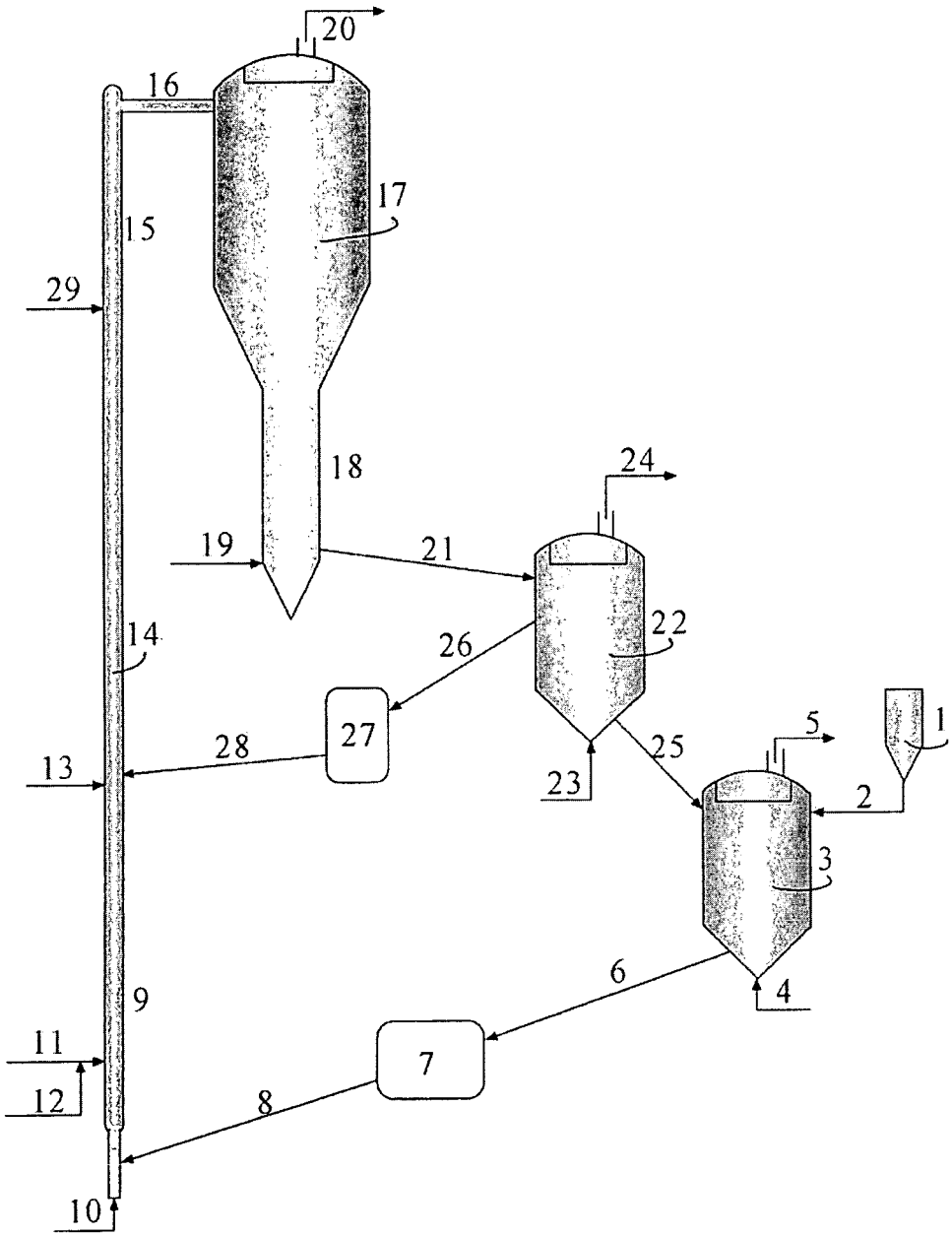

According to the seventh specific embodiment of the present invention, the process of the present invention can be carried out according to the scheme shown in FIG. 7. This embodiment has the same scheme as the fifth specific embodiment, except that a common riser reactor is used in stead of said reactor in the first specific embodiment.

Figure 8:
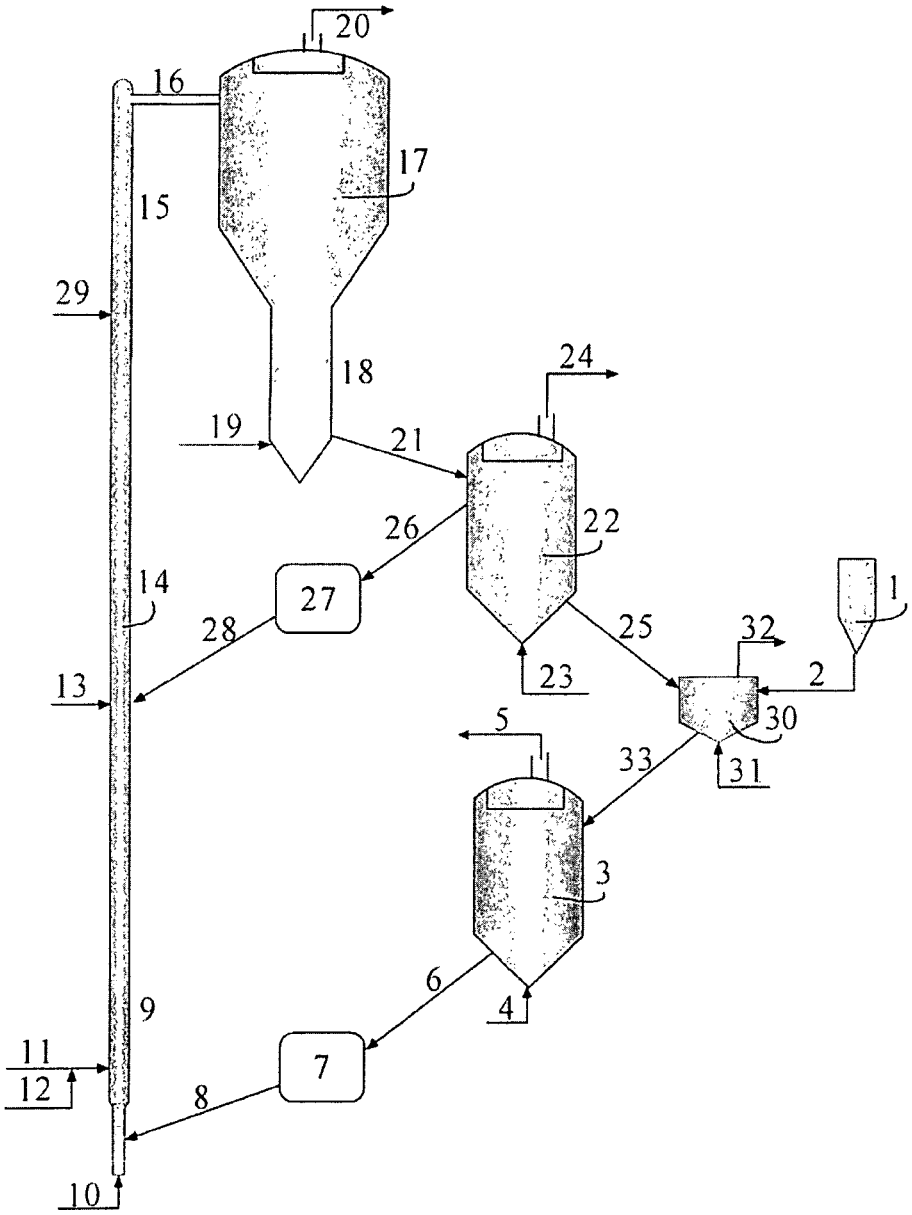

According to the eighth specific embodiment of the present invention, the process of the present invention can be carried out according to the scheme shown in FIG. 8. This embodiment has the same scheme as the sixth specific embodiment except that a common riser reactor is used in stead of said reactor in the first specific embodiment.

Figure 9:
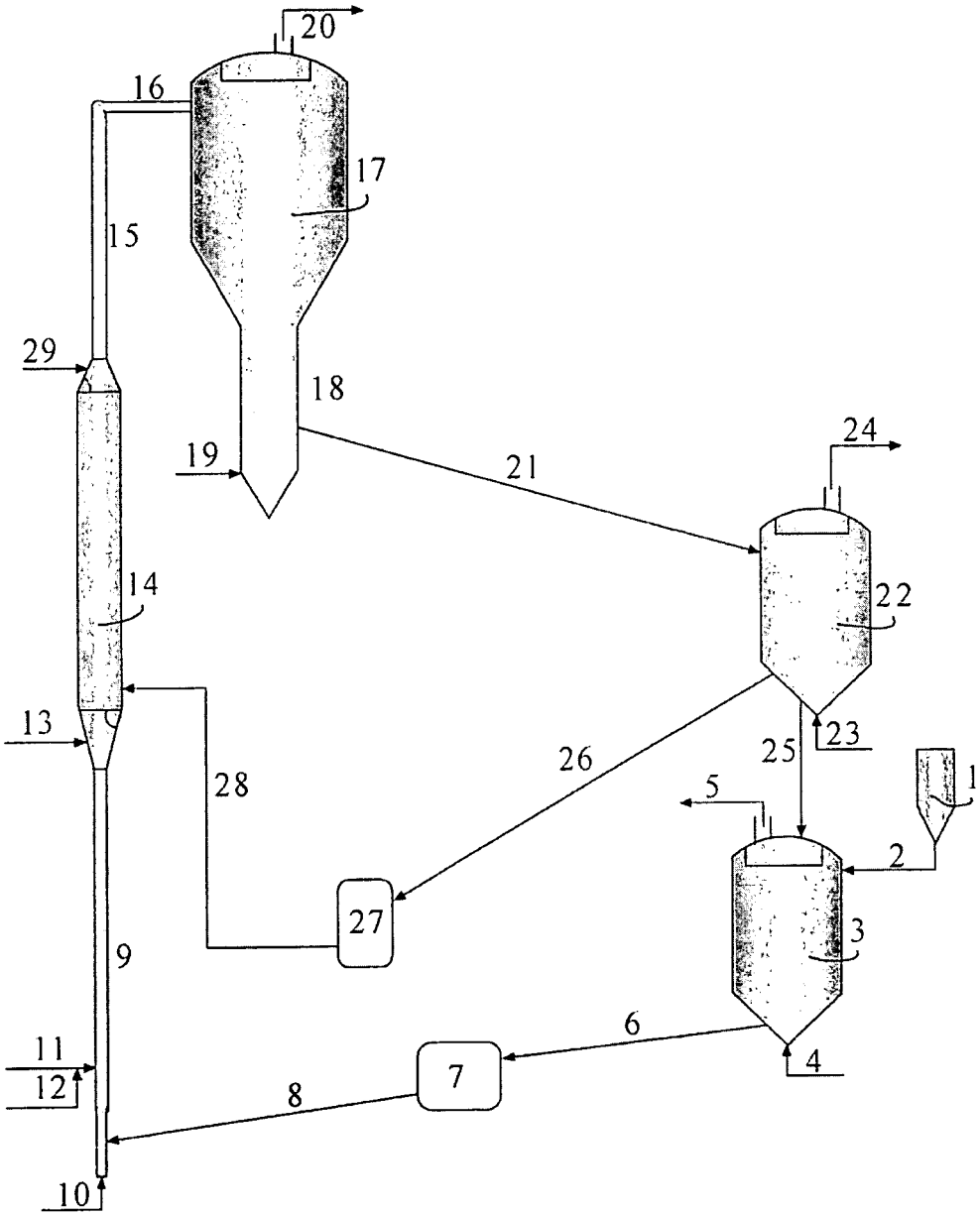

According to the ninth specific embodiment of the present invention, the process of the present invention can be carried out according to the scheme shown in FIG. 9. The reactor is as described in the first specific embodiment.

The catalyst that has contacted with the atmosphere containing a reducing gas is introduced into the pre-lifting section of the reactor from line 8, and then driven by pre-lifting steam from line 10 to move upward into the first reaction zone 9. Meanwhile, the preheated hydrocarbon oil from line 11 is mixed with the atomizing steam from 12, and introduced into the first reaction zone 9, where said hydrocarbon oil contacts with the catalyst to carry out a first cracking reaction. The reaction stream continues to move upward to the second reaction zone 14, where it contacts with the regenerated catalyst from line 28 to carry out a second reaction. If cooling is required, a chilling agent from line 13 may be injected into the region connecting the reaction zone 9 and the second reaction zone 14 to mix with the reaction material. After the second reaction, the stream continues to move upward through outlet zone 15 into settler 17 of the separation system via a horizontal pipe 16. The catalyst and cracked products are separated in settler 17 by the cyclone separator. In order to inhibit overcracking and thermal cracking in outlet zone of the riser, the temperature of reaction stream can be decreased by using gas-solid rapid separation or adding a terminator via line 29 to the region connecting outlet zone 15 and the second reaction zone 14. The separated catalyst is introduced into stripper 18 of the separation system to contact in counter flow with steam from line 19, and cracked products remained on the catalyst are stripped out to obtain a spent catalyst. The cracked products obtained by separation and stripped products are mixed and discharged via line 20, then continue to be separated into various distillates in the separation system. The spent catalyst is introduced into regenerator 22 via sloped tube 21. In regenerator 22 the spent catalyst contacts with the oxygen-containing atmosphere from line 23 at the regeneration temperature to remove coke thereon, and flue gas formed is vented out from line 24. A part of the regenerated catalyst is introduced via line 25 into reduction reactor 3, where the regenerated catalyst or the mixture of the regenerated catalyst with a fresh catalyst from storage tank 1 via line 2 contacts with the atmosphere containing a reducing gas from line 4 under reduction conditions. The waste gas formed is vented out via line 5. The catalyst that has contacted with the atmosphere containing a reducing gas is optionally introduced into heat exchanger 7 via line 6 to carry out heat-exchange, the optionally heat-exchanged catalyst is introduced into the pre-lifting section of reactor. The other part of the regenerated catalyst is optionally introduced into heat exchanger 27 via line 26 to carry out heat-exchange, the regenerated catalyst that has been optionally heat-exchanged is introduced into the second reaction zone via line 28. When the temperature of reduction reactor 3 is at a reaction temperature required for the first reaction zone, the catalyst that has contacted with the reducing gas can be introduced directly into the pre-lifting section of the reactor without passing through the heat exchanger 7. When the temperature of the regenerated catalyst from line 26 is at a reaction temperature required for the second reaction zone, the regenerated catalyst can be introduced directly into the second reaction zone without passing through heat exchanger 27.

Figure 10:
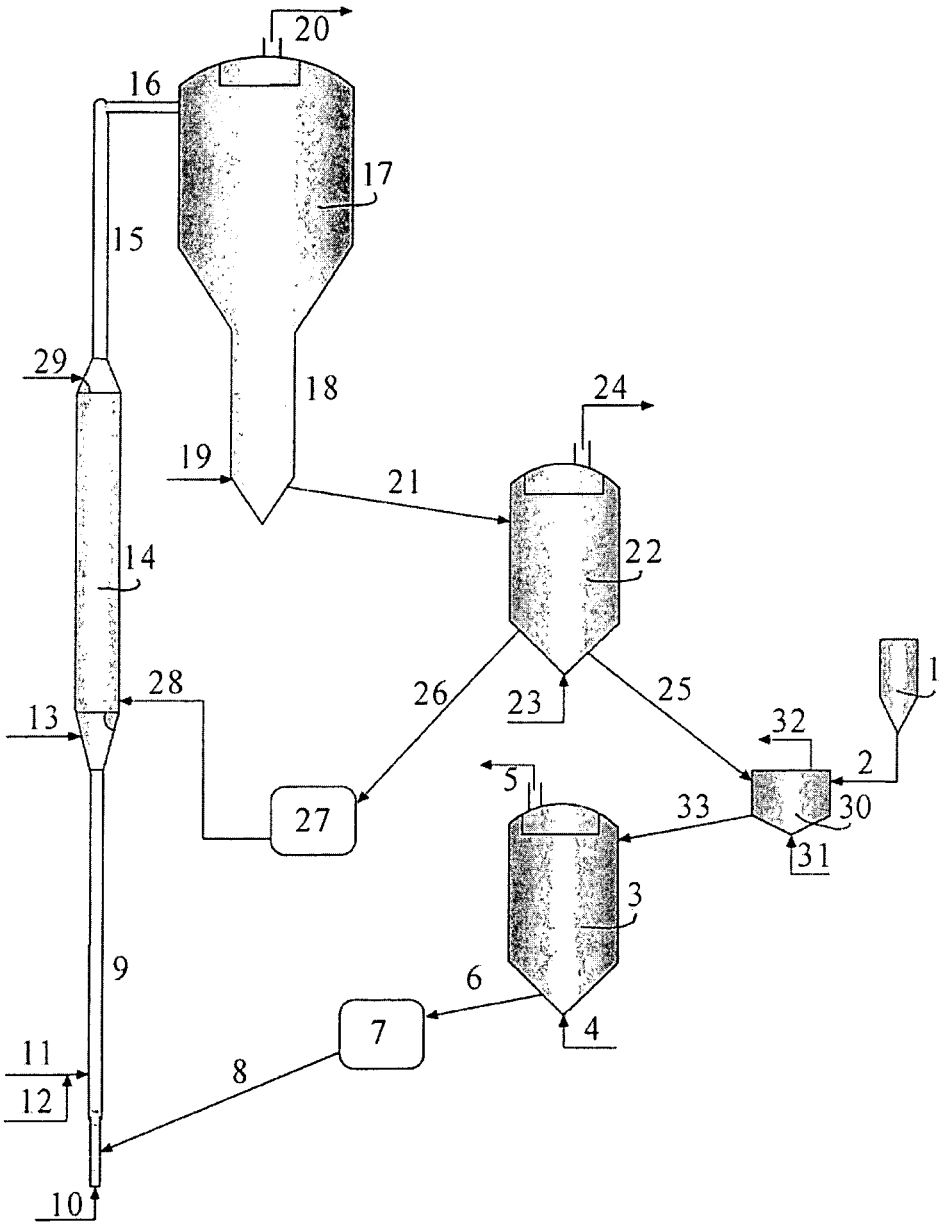

According to the tenth specific embodiment of the present invention, the process of the present invention can be carried out according to the scheme shown in FIG. 10. The reactor is as described in the first specific embodiment.

The catalyst that has contacted with the atmosphere containing a reducing gas is introduced into the pre-lifting section of the reactor from line 8, and then driven by pre-lifting steam from line 10 to move upward into the first reaction zone 9. Meanwhile, the preheated hydrocarbon oil from line 11 is mixed with the atomizing steam from 12, and introduced into the first reaction zone 9, where said hydrocarbon oil contacts with the catalyst to carry out a first cracking reaction. The reaction stream continues to move upward to the second reaction zone 14, where it contacts with the regenerated catalyst from line 28 to carry out a second reaction. If cooling is required, a chilling agent from line 13 may be injected into the region connecting the reaction zone 9 and the second reaction zone 14 to mix with the reaction material. After the second reaction, the stream continues to move upward through outlet zone 15 into settler 17 of the separation system via a horizontal pipe 16, in settler 17 the catalyst and cracked products are separated by the cyclone separator. In order to inhibit overcracking and thermal cracking in outlet zone of the riser, the temperature of reaction stream can be decreased by using gas-solid rapid separation or adding a terminator via line 29 to the region connecting outlet zone 15 and the second reaction zone 14. The separated catalyst is introduced into stripper 18 of the separation system to contact in counter flow with steam from line 19, and cracked products remained on the catalyst are stripped out to obtain a spent catalyst. The cracked products obtained by the separation and stripped products are mixed and discharged via line 20, then continue to be separated into various distillates in the separation system. The spent catalyst is introduced into regenerator 22 via sloped tube 21. In regenerator 22, the spent catalyst contacts with the oxygen-containing atmosphere from line 23 at the regeneration temperature to remove coke thereon, and flue gas formed is vented out from line 24. A part of the regenerated catalyst via line 25 is introduced into gas displacement tank 30, where the oxygen-containing gas entrained by the part of regenerated catalyst or the mixture of the part of the regenerated catalyst with the fresh catalyst from storage tank 1 via line 2 is displaced with inert gas from line 31. The displacing gas used is vented out via line 32, and the gas-displaced catalyst is introduced via line 33 into reduction reactor 3, where said catalyst contacts with the atmosphere containing a reducing gas from line 4 under reduction conditions. The waste gas formed is vented out via line 5. The catalyst that has contacted with the reducing gas is optionally introduced into heat exchanger 7 via line 6 to carry out heat-exchange, the optionally heat-exchanged catalyst is introduced into the pre-lifting section of the reactor. The other part of the regenerated catalyst is optionally introduced into heat exchanger 27 via line 26 to carry out heat-exchange, the regenerated catalyst that has been optionally heat-exchanged is introduced into the second reaction zone via line 28. Introduction of gas displacement tank 30 can make the oxygen-containing atmosphere entrained by the regenerated catalyst be displaced and the reduction reaction in reduction tank 3 be carried out more sufficiently and decrease the consumption of reduction gas. When the temperature of reduction reactor 3 is at a reaction temperature required for the first reaction zone, the catalyst that has contacted with the reducing gas can be introduced directly into the pre-lifting section of the reactor without passing through the heat exchanger 7. When the temperature of the regenerated catalyst from line 26 is at a reaction temperature required for the second reaction zone, the regenerated catalyst can be introduced directly into the second reaction zone without passing through heat exchanger 27.

Figure 11:
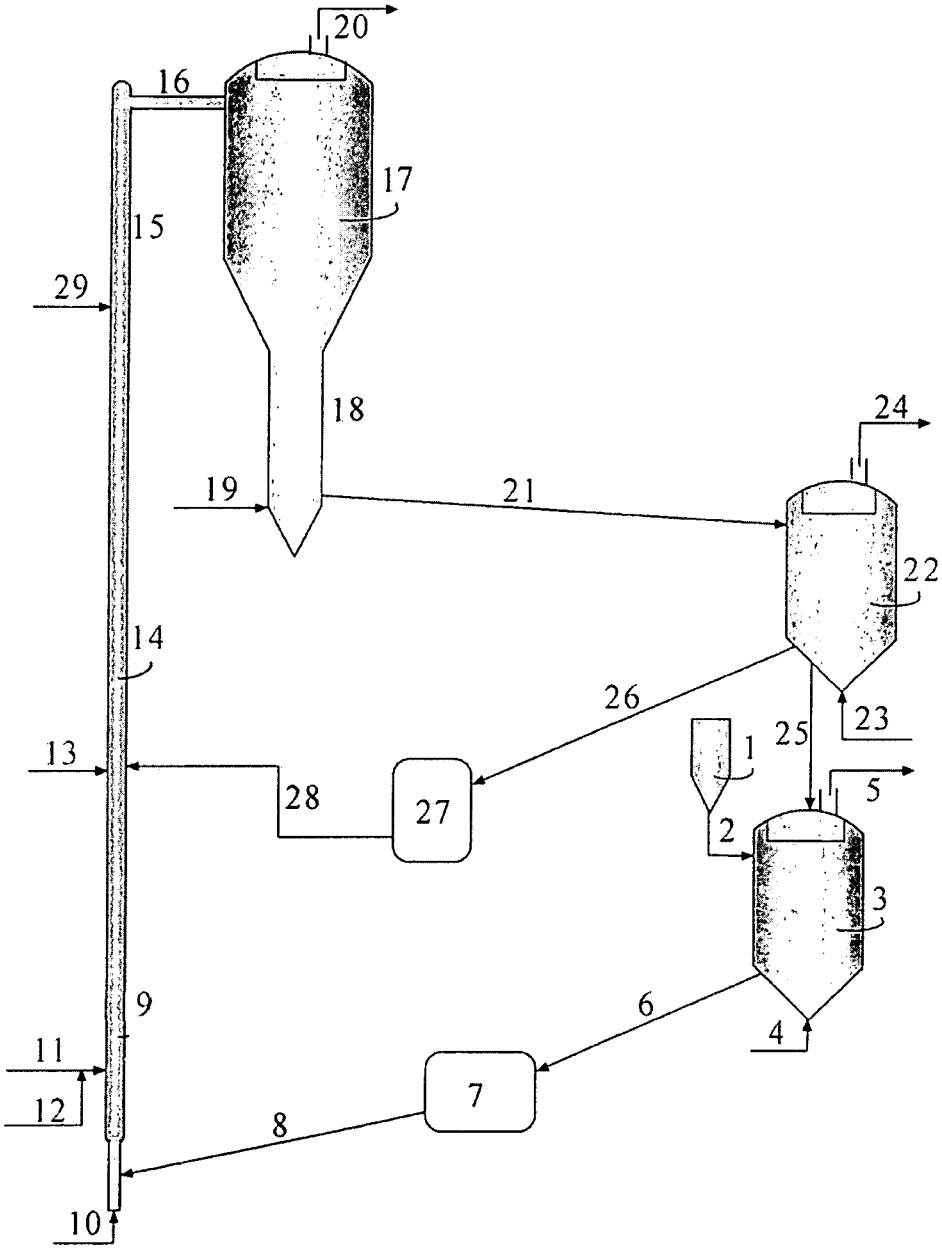

According to the eleventh specific embodiment of the present invention, the process of the present invention can be carried out according to the scheme shown in FIG. 11. This embodiment has the same scheme as the ninth specific embodiment, except that a common riser reactor is used in stead of said reactor in the first specific embodiment.

Figure 12:
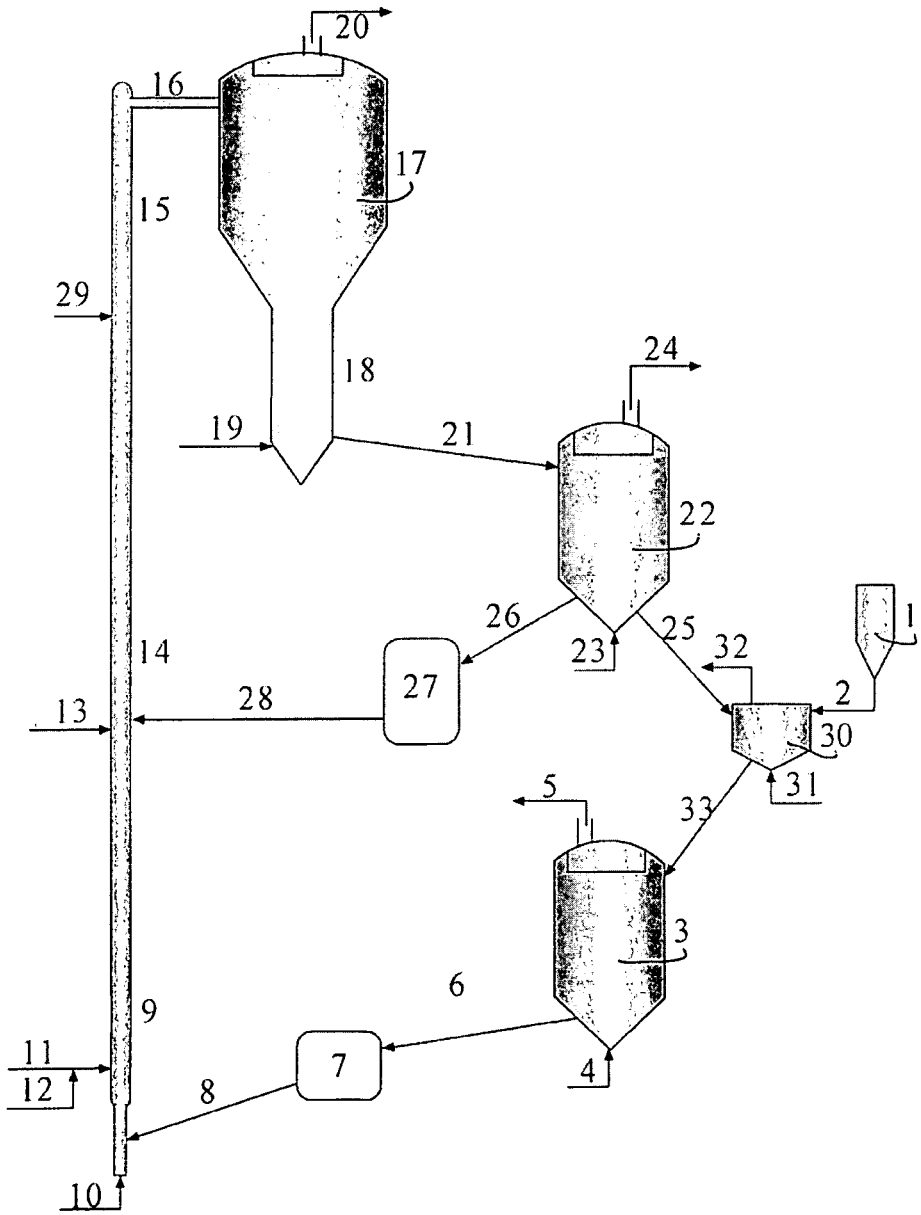

According to the twelfth specific embodiment of the present invention, the process of the present invention can be carried out according to the scheme shown in FIG. 12. This embodiment has the same scheme as the tenth specific embodiment, except that a common riser reactor is used in stead of said reactor in the first specific embodiment.

Figure 13:
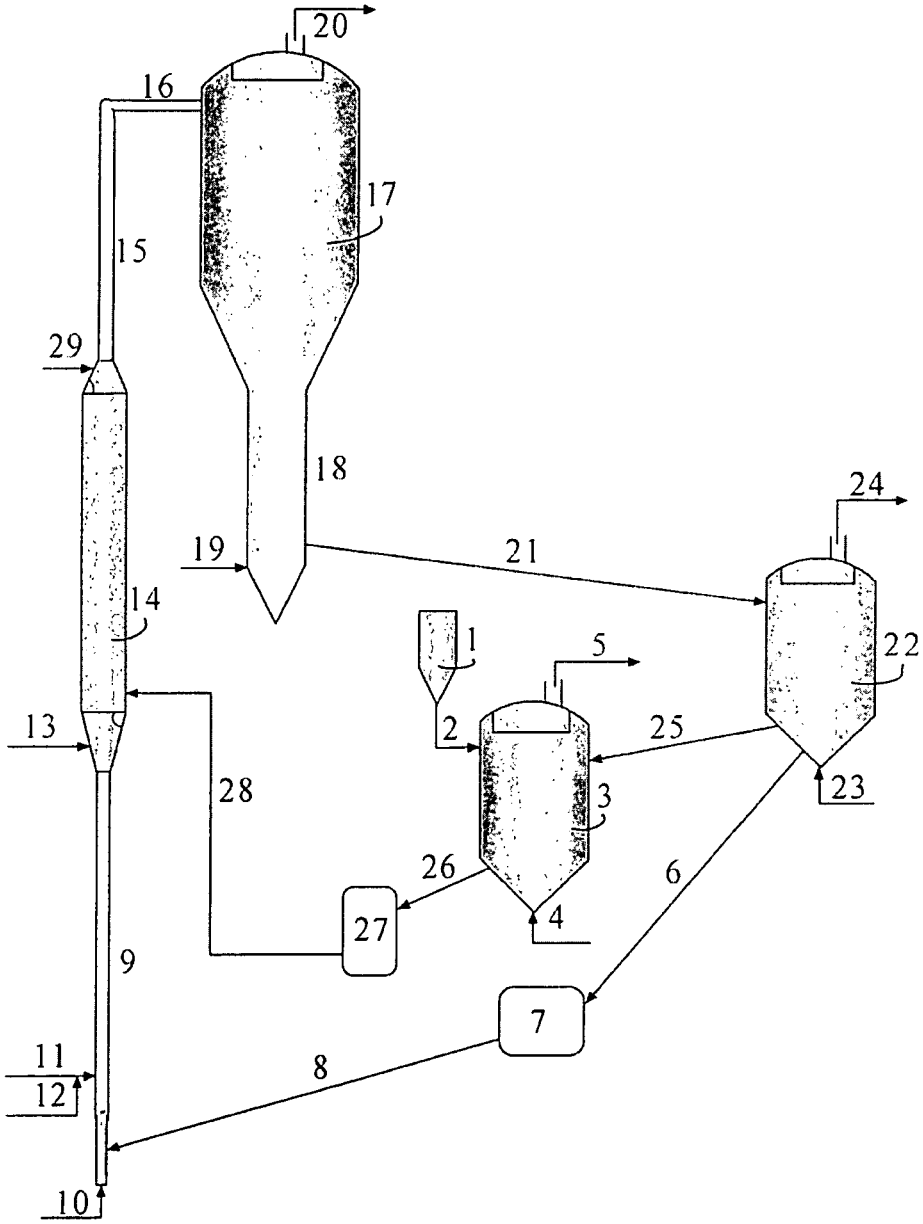

According to the thirteenth specific embodiment of the present invention, the process of the present invention can be carried out according to the scheme shown in FIG. 13. The reactor is as described in the first specific embodiment.

A part of the regenerated catalyst from regenerator 22 is optionally introduced into heat exchanger 7 via line 6. The optionally heat-exchanged catalyst is introduced into the pre-lifting section of the reactor via line 8, and then driven by pre-lifting steam from line 10 to move upward into the first reaction zone 9. Meanwhile, the preheated hydrocarbon oil from line 11 is mixed with the atomizing steam from 12, and introduced into the first reaction zone 9, where said hydrocarbon oil contacts with the catalyst to carry out a first cracking reaction. The reaction stream continues to move upward to the second reaction zone 14. Meanwhile, the other part of the regenerated catalyst from regenerator 22 is introduced via line 25 into reduction reactor 3, where the regenerated catalyst or the mixture of the regenerated catalyst with a fresh catalyst from storage tank 1 via line 2 contacts with the atmosphere containing a reducing gas from line 4 under reduction conditions. The waste gas formed is vented out via line 5. The catalyst that has contacted with the atmosphere containing a reducing gas is optionally introduced into heat exchanger 27 via line 26. The optionally heat-exchanged catalyst is introduced into the second reaction zone 14 via line 28, in the second reaction zone 14 the reaction stream from the first reaction zone 9 contacts with the catalyst from line 28 to carry out a second reaction. If cooling is required, a chilling agent from line 13 may be injected into the region connecting the reaction zone 9 and the second reaction zone 14 to mix with the reaction material. After the second reaction, the stream continues to move upward through outlet zone 15 into settler 17 of the separation system via a horizontal pipe 16, in settler 17 the catalyst and cracked products are separated by the cyclone separator. In order to inhibit overcracking and thermal cracking in outlet zone of the riser, the temperature of reaction stream can be decreased by using gas-solid rapid separation or adding a terminator via line 29 to the region connecting outlet zone 15 and the second reaction zone 14. The separated catalyst is introduced into stripper 18 of the separation system to contact in counter flow with steam from line 19, and cracked products remained on the catalyst are stripped out to obtain a spent catalyst. The cracked products obtained by separation and stripped products are mixed and discharged via line 20, and then continue to be separated into various distillates in the separation system. The spent catalyst is introduced into regenerator 22 via sloped tube 21, in regenerator 22 the spent catalyst contacts with the oxygen-containing atmosphere from line 23 at the regeneration temperature to remove coke thereon, and the flue gas formed is vented out from line 24. In this case, when the temperature of reduction reactor 3 is at a reaction temperature required for the second reaction zone 14, the catalyst that has contacted with the atmosphere containing a reducing gas can be introduced directly into the second reaction zone 14 without passing through the heat exchanger 27. When the temperature of the regenerator 22 is at a reaction temperature required for the first reaction zone 9, the catalyst that has contacted with the atmosphere containing a reducing gas can be introduced directly into the pre-lifting section of the second reaction zone without passing through the heat exchanger 7.

Figure 14:
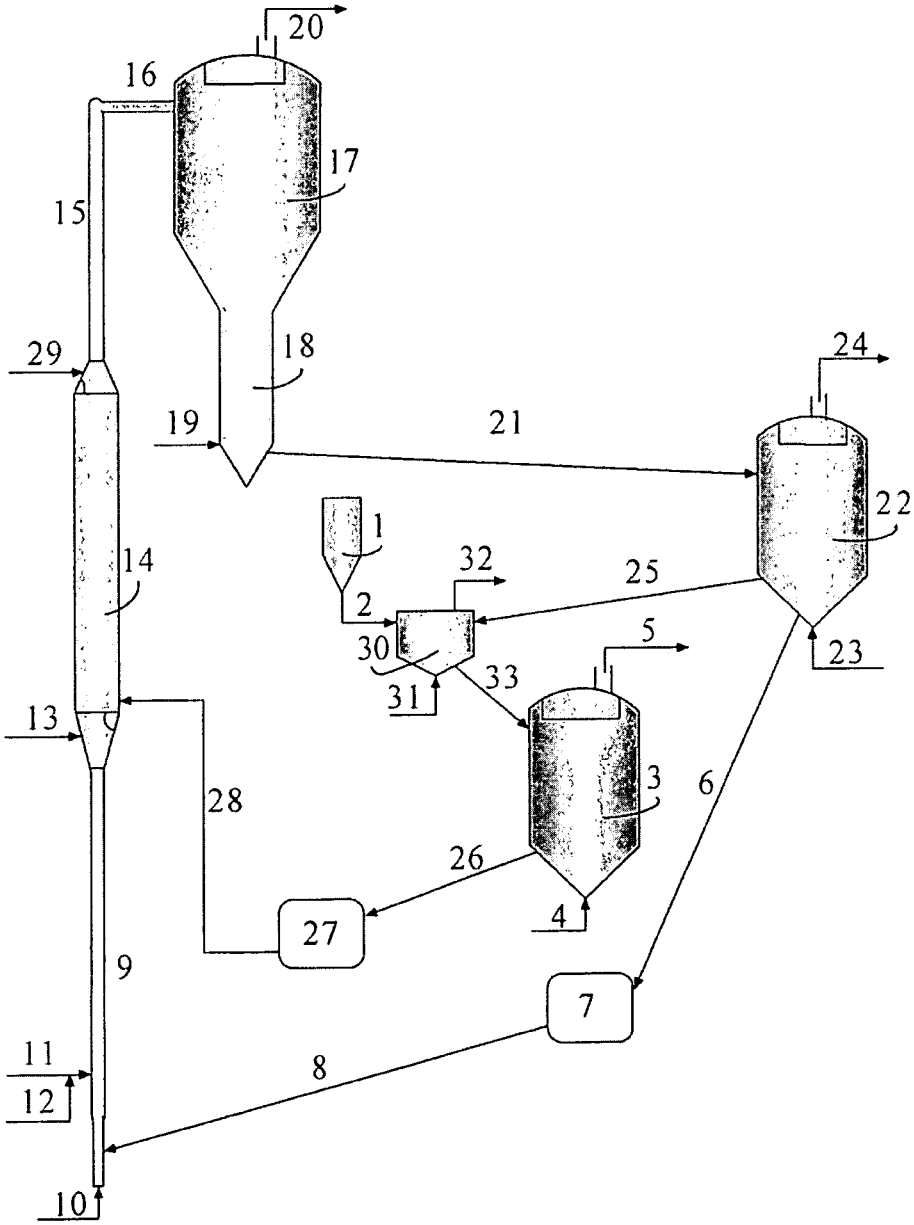

According to the fourteenth specific embodiment of the present invention, the process of the present invention can be carried out according to the scheme shown in FIG. 14. The reactor is as described in the first specific embodiment.

A part of the regenerated catalyst from regenerator 22 is optionally introduced into heat exchanger 7 via line 6, the optionally heat-exchanged catalyst is introduced into the pre-lifting section of the reactor and driven by pre-lifting steam from line 10 to move upward into the first reaction zone 9. Meanwhile, the preheated hydrocarbon oil from line 11 is mixed with the atomizing steam from 12, and then introduced into the first reaction zone 9, where said hydrocarbon oil contacts with the catalyst to carry out a first cracking reaction. The reaction stream continues to move upward to the second reaction zone 14. Meanwhile, the other part of the regenerated catalyst from regenerator 22 is introduced into gas displacement tank 30 via line 25, where the oxygen-containing gas entrained by the regenerated catalyst or the mixture of the regenerated catalyst with a fresh catalyst from storage tank 1 via line 2 is displaced out with an inert gas from line 31, and the displacing gas used is vented out via line 32. The gas-displaced catalyst is introduced via line 33 into reduction reactor 3, where the gas-displaced catalyst contacts with the atmosphere containing a reducing gas from line 4 under reduction conditions, and the waste gas formed is vented out via line 5. The catalyst that has contacted with the atmosphere containing a reducing gas is optionally introduced into heat exchanger 27 via line 26. The optionally heat-exchanged catalyst is introduced into the second reaction zone 14 via line 28. In the second reaction zone 14 the reaction stream from the first reaction zone 9 contacts with the catalyst from line 28 to carry out a second reaction. If cooling is required, a chilling agent from line 13 may be injected into the region connecting the reaction zone 9 with the second reaction zone 14 to mix with the reaction material. After the second reaction, the stream continues to move upward through outlet zone 15 into settler 17 of the separation system via a horizontal pipe 16, in settler 17 the catalyst and cracked products are separated by the cyclone separator. In order to inhibit overcracking and thermal cracking in outlet zone of the riser, the temperature of reaction stream can be decreased by using gas-solid rapid separation or adding a terminator via line 29 to the region connecting outlet zone 15 with the second reaction zone 14. The separated catalyst is introduced into stripper 18 of the separation system to contact in counter flow with steam from line 19, and cracked products remained on the catalyst are stripped out to obtain a spent catalyst. The cracked products obtained by the separation and stripped products are mixed and discharged via line 20, and then continue to be separated into various distillates in the separation system. The spent catalyst is introduced into regenerator 22 via sloped tube 21 for the spent catalyst. In regenerator 22 the spent catalyst contacts with the oxygen-containing atmosphere from line 23 at the regeneration temperature to remove coke thereon, and flue gas formed is vented out from line 24. In this case, when the temperature of reduction reactor 3 is at a reaction temperature required for the second reaction zone 14, the catalyst that has contacted with the atmosphere containing a reducing gas can be introduced directly into the second reaction zone 14 without passing through the heat exchanger 27. When the temperature of the regenerator 22 is at a reaction temperature required for the first reaction zone 9, the catalyst that has contacted with the atmosphere containing a reducing gas can be introduced directly into the pre-lifting section of the second reaction zone in the reactor without passing through the heat exchanger 7. Introduction of gas displacement tank 30 can make the oxygen-containing atmosphere entrained by the regenerated catalyst be displaced and the reduction reaction in reduction tank 3 be carried out more sufficiently and decrease the consumption of reduction gas.

Figure 15:
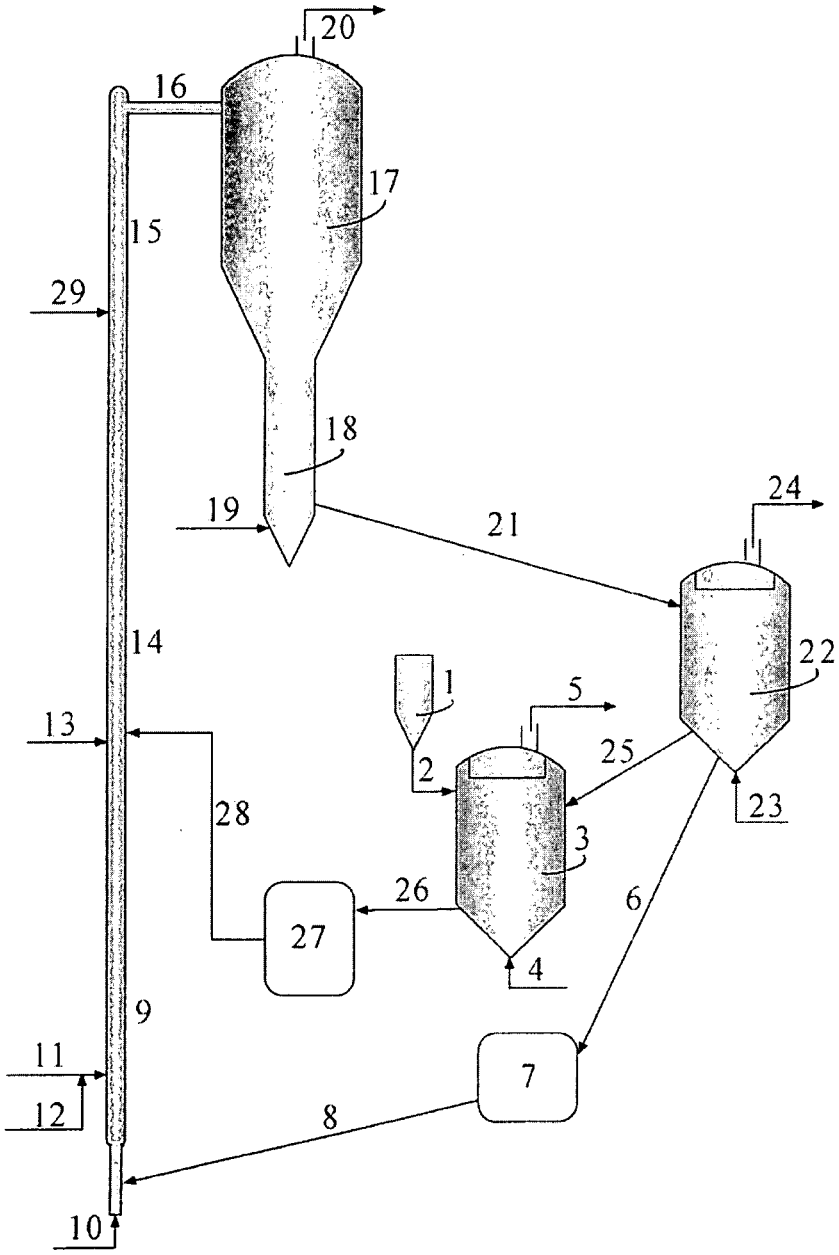

According to the fifteenth specific embodiment of the present invention, the process of the present invention can be carried out according to the scheme shown in FIG. 15. This embodiment has the same scheme as the thirteenth specific embodiment, except that a common riser reactor is used in stead of said reactor in the first specific embodiment.

Figure 16:
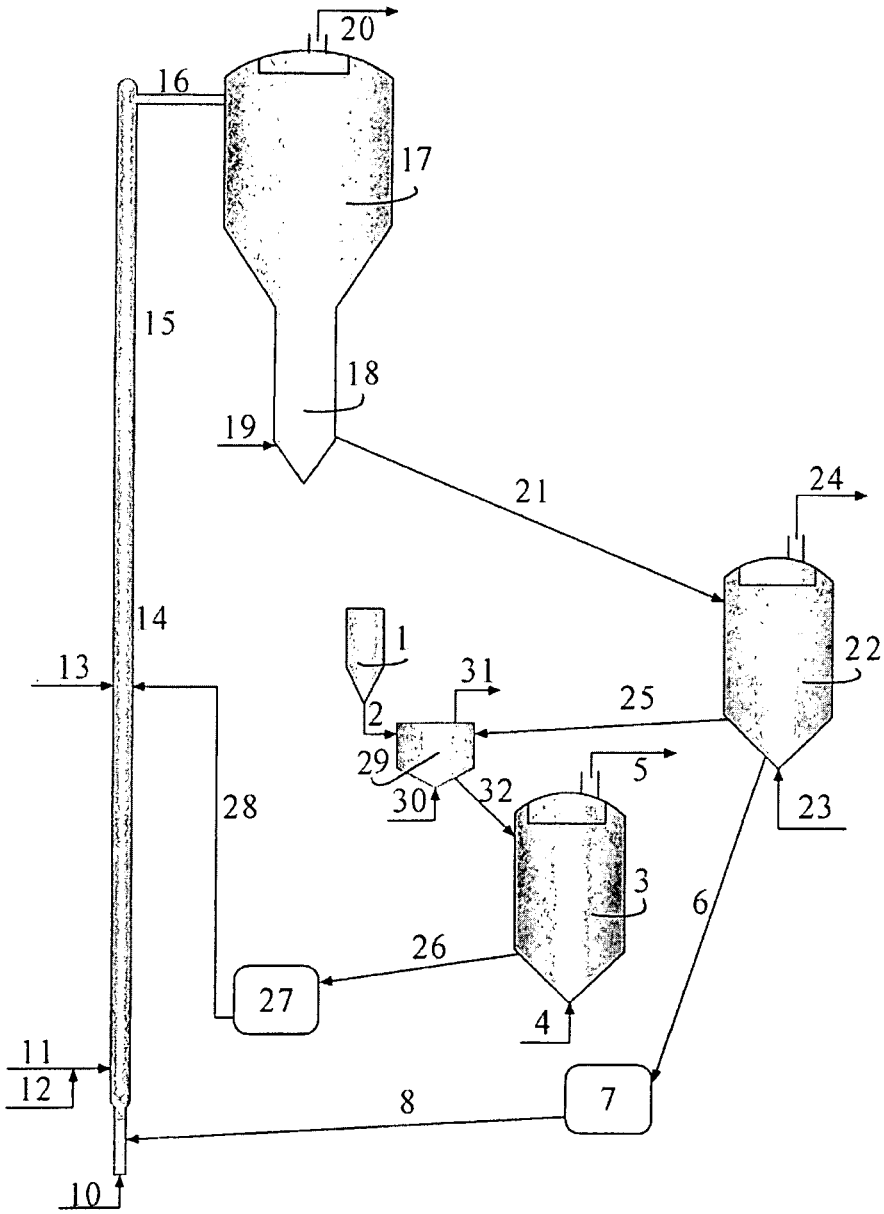

According to of the sixteenth specific embodiment of the present invention, the process of the present invention can be carried out according to the scheme shown in FIG. 16. This embodiment has the same scheme as the fourteenth specific embodiment, except that a common riser reactor is used in stead of said reactor in the first specific embodiment.

The common riser reactor may be any conventional common riser reactor, such as a conventional equal diameter riser reactor or an equal-linear speed riser reactor. The first reaction zone is the lower part of the riser reaction zone. The second reaction zone is the upper part of the riser reaction zone. The pre-lifting section has a length 5-20% of the total length of the riser reaction zone, and the first reaction zone has a length 10-30% of the total length of the riser reaction zone. The second reaction zone has a length 30-60% of the total length of the riser reaction zone, the outlet zone has a length 0-20% of the total length of the riser reaction zone.

The function of atomizing steam is to obtain a better effect of atomizing hydrocarbon oil, so that to the hydrocarbon oil and catalyst will be mixed more homogeneously. The function of steam used as a pre-lifting media is to make the catalyst take effect more quickly so as to form a catalyst piston flow with a uniform density in the pre-lifting section. The amount of said atomizing steam and pre-lifting steam is well known for one skilled in the art. Generally, the total amount of atomizing steam and pre-lifting steam is about 1-30%, preferably 2-15% by weight of hydrocarbon oil.

The function of stripping steam is to displace oil gas filled between granules of catalyst and in granular pores so as to increase the yield of oil products. The amount of stripping steam is well known for one skilled in the art. Generally, the amount of stripping steam is 0.1-0.8%, preferably 0.2-0.4% by weight of the circulation rate of the catalyst.

The pre-lifting steam may be replaced with other pre-lifting media, such as dry gases from refining factories, light paraffin, light olefins, or mixed gases of dry gas from refining, factories and steam.

Said oxygen-containing atmosphere may be oxygen or any mixed oxygen-containing gas, and a common oxygen-containing atmosphere is air. Said regeneration temperature is well known for one skilled in the art, which is, generally, 600-770° C., preferably 650-730° C.

Said inert gas comprises any gas or gaseous mixture that does not react with the catalyst such as one or more gas selected from group consisting of nitrogen, Group 0 gas in the Periodic Table of Elements/carbon dioxide. The amount of said inert gas is sufficient enough to displace the oxygen-containing gas entrained in the catalyst. Generally, the amount of the inert gas is 0.01-30 cubic meters, preferably 1-15 cubic meters, per ton catalyst per minute.

Since a small amount of catalyst will be lost after the catalyst is circulated for a given period of time, storage tank 1 plays a role of supplementing regularly or irregularly the consumed catalyst in the reaction. The metal component comprised in the catalyst in storage tank 1 may be in a reduced state or in an oxidation state.

3. Catalyst (1). Catalyst and Catalyst Mixture

In the process according to the present invention, the catalyst is a cracking catalyst containing metal component, or a catalyst mixture of a cracking catalyst free of a metal component and a cracking catalyst containing metal component. Said metal component may be present in the maximum oxidative valence state or as a reduction valence state. On the basis of said cracking catalyst containing metal component and calculated by the oxide of the metal component in the maximum oxidative valence state, the content of the metal component is 0.1-30 wt %. Said metal component is one or more selected from the group consisting of non-aluminum metals of Group IIIA, metals of Group IVA, Group VA, Group IB, Group IIB, Group VB, Group VIB and Group VIIB, non-noble metals of Group VIII and rare-earth metals. On the basis of said catalyst mixture, the content of the cracking catalyst containing metal component is at least 0.1 wt %, preferably at least 1 wt %, more preferably at least 3 wt %, desirably at least 10 wt %.

(2). Cracking Catalyst Containing Metal Component

1) Cracking Catalyst Containing Metal Component Present in the Maximum Oxidative Valence State Said cracking catalyst containing metal component comprises one or more of present cracking catalysts containing a metal component, such as a cracking catalyst containing said metal components, a molecular sieve, a refractory inorganic an oxide matrix, optionally a clay, and optionally a phosphor, wherein said metal is present in the maximum oxidative valence state. Based on said cracking catalyst containing metal component and calculated by the oxide with a metal in the maximum oxidative valence state, the content of said metal component is 0.1-30 wt %, and preferably 0.5-20 wt %. The contents of the other components in said cracking catalyst containing metal component are within the range of conventional contents of this type of catalyst, and are well known for one skilled in the art. For example, on the basis of said cracking catalyst containing metal component the content of said molecular sieve is 1-90 wt/%, the content of the refractory inorganic oxide is 2-80 wt %, the content of the clay is 0-80 wt % and the content of phosphor is 0-15 wt % calculated by phosphorus pentoxide. Preferably, the content of said molecular sieve is 10-60 wt %, the content of the refractory inorganic oxide is 10-50 wt %, the content of the clay is 20-70 wt %, and the content of phosphor is 0-8 wt %.

Said metal component is one or more selected from the group consisting of non-aluminum metals of Group III A, metals of Group IVA, Group VA, Group IB, Group IIB, Group VB, Group VIB and Group VIIB, non-noble metals of Group VIII and rare-earth metals in the Periodic Table of Elements.

Said non-aluminum metals of Group IIIA include gallium, indium and thallium. Said metals of Group IVA include germanium, tin and led. Said metals of Group VA include antimony and bismuth. Said metals of Group IB include copper and silver. Said metals of Group IIB include zinc and cadmium, and Said metals of Group VB include vanadium, niobium and tantalum. Said metals of Group VIB include chromium, molybdenum and tungsten. Said metals of Group VIIB include manganese, technetium and rhenium. Said non-noble metals of Group VIII include iron, cobalt and nickel. Said rare-earth metal is one or more selected from the group consisting of lanthanide series and actinium series, preferably one or more selected from lanthanum, cerium, praseodymium, neodymium, promethium, samarium, europium, gadolinium, terbium, dysprosium, holmium, erbium, thulium, ytterbium, lutetium, more preferably lanthanum, cerium, lanthanum-rich norium, or cerium-rich norium. Said metal component is preferably one or more selected from gallium, germanium, tin, antimony, bismuth, led, copper, silver, zinc, cadmium, vanadium, molybdenum, tungsten, manganese; iron, cobalt nickel, lanthanum, cerium, lanthanum-rich norium or cerium-rich norium; more preferably one or more selected from gallium, tin, copper, silver, zinc, vanadium, molybdenum, manganese, iron, cobalt, lanthanum, cerium, lanthanum-rich norium or cerium-rich norium.

Said metal component is distributed simultaneously on molecular sieve, refractory inorganic oxide and clay, or on optional two of the molecular sieve, refractory inorganic oxide and clay, or on optional one of the molecular sieve, refractory inorganic oxide and clay.

Said molecular sieve is one or more selected from the group consisting of zeolites and non-zeolite molecular sieves serving as an active component of a cracking catalyst. These zeolites and molecular sieves are well known for one skilled in the art.

Said zeolite is preferably one or more selected from macropore zeolites and mesopore zeolites. Said macropore zeolites are those having a porous structure with at least 0.7 nanometer of ring-open, such as one or more selected from faujasite, L-zeolite, beta zeolite, Ω-zeolite, mordenite, and ZSM-18 zeolite, especially one or more selected from Y-zeolite, phosphorus- and/or rare-earth-containing Y-zeolite, ultra-stable Y-zeolite, phosphorus- and/or rare-earth-containing ultra-stable Y-zeolite, and beta zeolite.

Said mesopore zeolites are those having a porous structure with ring-open higher than 0.56 nm but less than 0.7 nm, such as one or more selected from zeolites having MFI structure (e.g. ZSM-5 zeolite), phosphorus- and/or rare-earth-containing zeolites having MFI structure (e.g. a phosphorus- and/or rare-earth-containing ZSM-5 zeolites, phosphorus-containing zeolites having MFI structure as disclosed in CN1194181A), ZSM-22 zeolite, ZSM-23 zeolite, ZSM-35 zeolite, ZSM-50 zeolite, ZSM-57 zeolite, MCM-22 zeolite, MCM-49 zeolite, and MCM 56 zeolite.

Said non-zeolite molecular sieve refers to one or more molecular sieves in which aluminum and/or silicon are partially or completely substituted by one or more other elements such as phosphor, titanium, gallium and germanium. Examples of these molecular sieves include one or more molecular sieves selected from silicates having different silica-alumina ratios (e.g. Metallosilicate and titanosilicate), metalloaluminates (e.g. germaniumaluminates), metallophosphates, aluminophosphates, metalloaluminophosphates, metal integrated silicoaluminophosphates (MeAPSO and ELAPSO), silicoaluminophosphates (SAPO), and gallogermanates. especially one or more selected from SAPO-17 molecular sieve, SAPO-34 molecular sieve and SAPO-37 molecular sieve.

Preferably, said molecular sieve is one or more selected from the group consisting of Y-zeolite, phosphorus- and/or rare-earth-containing Y-zeolite, ultra-stable Y-zeolite, phosphorus- and/or rare-earth-containing ultra-stable Y-zeolite, beta zeolite, zeolites having MFI structure, phosphorus- and/or rare-earth-containing zeolites having MFI structure.

Said refractory inorganic oxide is one or more selected from the group consisting of the refractory inorganic oxides serving as a matrix material and a binder component in cracking catalysts, such as one or more selected from the group consisting of alumina, silica, amorphous silica/alumina, zirconia, titanium oxide, boron oxide, and oxides of alkaline earth metals, preferred one or more selected from alumina, silica, amorphous silica-alumina, zirconia, titanium oxide, magnesium oxide, and calcium oxide. The refractory inorganic oxides are well known for one skilled in the art.

Said clay is one or more selected from the group consisting of clays serving as the active component of cracking catalysts, such as one or more selected from the group consisting of kaolin, halloysite, montmorillonite, kieselguhr, halloysite, soapstone, rectorite, sepiolite, attapulgus, hydrotalcite and bentonite, more preferred kaolin. These clays are well known for one skilled in the art.

The following examples of some present cracking catalysts containing a metal component are listed in non exhaustive mode A. A catalyst containing rare-earth Y-zeolite, ultra-stable Y-type zeolite, kaolin, and alumina, under the commercial trademark of HGY-2000R;

B. A catalyst containing rare-earth Y-zeolite ultra-stable Y-type zeolite, kaolin, and alumina, under the a commercial trademark of MLC-500;

C. A cracking catalyst composition having desulfurization function, disclosed in U.S. Pat. No. 5,376,608;

D. A desulfurization catalyst disclosed in CN121887A;

E. A catalyst for desulfurization of products disclosed in CN1261618A.

2). Cracking Catalyst Containing Metal Component Present in Reduction State:

Said cracking catalyst containing metal component further includes cracking catalysts containing a metal component in reduction state, which are specifically described in the present applicant's China Patent Application No. 03137906.0. The catalyst contains a molecular sieve, a refractory inorganic oxide, a clay and a metal component wherein based on the total amount of the cracking catalyst containing metal component the content of the molecular sieve is 1-90 wt %, the content of the refractory inorganic oxide is 2-80 wt %, the content of the clay is 2-80 wt %, and the content of the metal component is 0.1-30 wt % calculated by metal oxides in the maximum oxidative valence state. Said metal component is essentially present in a reduction valence state, and is one or more selected from the group consisting of non-aluminum metals of Group IIIA, metals of Group IVA, Group VA, Group IB, Group IIB, Group VB, Group VIB and Group VIIB, and non-noble metals of Group VIII.

Said reduction valence state refers to a state in which the average valence of a metal is equal to zero or higher than zero but lower than the maximum oxidative valence state Preferably, the ratio of the average valence to the maximum oxidative valence of said metal is 0-0.95, more preferably 0.1-0.7.

Said maximum oxidative valence state of the metal described here refers to the highest oxidation state of said metal that can be present stably in metal oxide after being adequately oxidized. For example, the maximum oxidative valence state of non-aluminum metals of Group IIIA in the Periodic Table of Elements is generally +3 valence (e.g. gallium); the maximum oxidative valence state of Group IVA metals is generally +4 valence; the maximum oxidative valence state of Group VA metals is generally +5 valence; the maximum oxidative valence state of Group IB metals is generally +2 valence (e.g. copper) or +1 valence (e.g. silver); the maximum oxidative valence state of Group IIB metals is generally +2 valence; the maximum oxidative valence state of Group IIB metals is generally +5 valence; the maximum oxidative valence state of Group VIB metals is generally +6 valence; the maximum oxidative valence state of Group VIIB metals is generally +4 valence (e.g. manganese) or +7 valence (e.g. rhenium); the oxidation state of Group VIII non-noble metals is generally +3 valence (e.g. iron or cobalt) or +2 valence (e.g. nickel).

Method for measuring average valence of a metal is shown as follows:

weighing precisely about 0.4 g of a catalyst and placing it in a sample cell of TPD/R/O analysis instrument introducing a mixed gas of hydrogen and nitrogen, in which the hydrogen content is 5% by volume, into the sample cell in a hydrogen flow rate of 20 ml/min, heating the sample cell from room temperature to 1000° C. at a speed of 10° C./min to heat and reduce the catalyst in the cell by means of a temperature programming procedure, then measuring TPR characteristic peak of the metal component in the catalyst before and after being reduced respectively, and calculating the average valence state of the metal according to formula:

$$\beta_M=\beta_{M'}-2f(A_1-A)/N$$

wherein $\beta_M$ is an average valence of the metal component M in the catalyst; $\beta_{M'}$ is the maximum oxidative valence of the metal component M in the catalyst; A is the area of TPR characteristic peak of the metal M in the catalyst when the metal component M is present in a reduction valence state; $A_1$ is the area of TPR characteristic peak of metal M in the catalyst when the metal component is present in a maximum oxidative valence state; N is the content of the metal component M in the catalyst (in moles); f is a correction factor. The method for measuring f is as follows: weighing precisely about 6.5 mg of CuO and placing it in the sample cell of aforementioned TPD/R/O analysis instrument; measuring the area $K_2$ of TPR characteristic peak of CuO which is completely reduced under the same conditions as mentioned above; calculating the hydrogen consumption $K_1$ (in moles) according to the stoichiometric number of the reduction reaction. The ratio of the hydrogen consumption to TPR characteristic peak area is f, i.e. $f=K_1/K_2$, and expressed by the unit of mole/area of TPR characteristic peak.

Since TPR characteristic peak of each metal has a different position, TPR characteristic peak of each metal can also be measured even though the catalyst contains more than two metal components.

Said metal component is one or more selected from the group consisting of non-aluminum metals of Group IIIA, metals of Groups IVA, VA, IB, IIB, VB, VIB and VIIB, and non-noble metals of Group VIII in the Periodic Table of Elements. Said non-aluminum metals of Group IIIA include gallium, indium and thallium. Said metals of Group IVA include germanium, tin and led. Said metals of Group VA include antimony and bismuth. Said metals of Group IB include copper and silver. Said metals of Group IIB include zinc and cadmium. Said metals of Group VB include vanadium, niobium and tantalum. Said metals of Group VIB include chromium, molybdenum and tungsten. Said metals of Group VIIB include manganese, technetium and rhenium. Said non-noble metals of Group VIII include iron, cobalt and nickel. Said metal component is preferably one or more selected from gallium, germanium, tin, antimony, bismuth, led, copper, silver, zinc, cadmium, vanadium, molybdenum, tungsten, manganese, iron, cobalt and nickel, more preferably gallium, tin, copper, silver, zinc, vanadium, molybdenum, manganese, iron and cobalt.

Said metal component can be present simultaneously either in the molecular sieve, refractory inorganic oxide and clay, or in any two of the molecular sieve, refractory inorganic oxide and clay, or even in one of the molecular sieve, refractory inorganic oxides and clay.

The catalyst may further contain a rare-earth metal that may be present in form of a metal and/or a metal compound. Said rare-earth metal can be present simultaneously either in the molecular sieve, refractory inorganic oxide and clay, or in any two of the molecular sieve, refractory inorganic oxide and clay, or even in one of the molecular sieve, refractory inorganic oxide and clay. Said rare-earth metal is one or more selected from the group consisting of lanthanide-rare-earth metals and actinide-rare-earth metals, preferably one or more selected from lanthanum, cerium, praseodymium, neodymium, promethium, samarium, europium, gadolinium, terbium, dysprosium, holmium, erbium, thulium, ytterbium, lutetium, more preferably lanthanum, cerium, lanthanum-rich norium or cerium-rich norium. Based on the total amount of said cracking catalyst containing metal component and calculated by its oxide the content, of said rare-earth metal component is 0-50 wt %, preferably 0-15 wt %.

The catalyst may further contain phosphorus component that is present in a form of a phosphorous compound, such as an oxide of phosphor and/or phosphates. Said phosphorus component can be present simultaneously either in the molecular sieve, refractory inorganic oxide and clay, or in any two of the molecular sieve, refractory inorganic oxide and clay, or even in one of the molecular sieve, refractory inorganic oxide and clay. Based on the total amount of said catalytic cracking catalyst containing metal component and calculated by phosphorus pentoxide, the content of said phosphor component is 0-15 wt %, preferably 0-8 wt %.

The types of said molecular sieve, refractory inorganic oxide and clay are the same as those described in "Cracking catalyst containing metal component present in reduction state".

The method for preparing the catalyst comprises contacting a composition comprising a metal-containing compound, a molecular sieve, a refractory inorganic oxide and clay with an atmosphere containing a reducing gas. The contact temperature and contact time are sufficient enough to make the average valence lower than the maximum oxidative valence of said metal component. Said metal component is one or more selected from the group consisting of non-aluminum metals of Group IIIA, metals of Groups IVA, VA, IB, IIB, VB, VIB and VIIB, and non-noble metals of Group VIII in the Periodic Table of Elements. In the composition, the content of each component is in such an amount that the final catalyst contains, based on the total amount of said cracking catalyst containing metal component. 1-90 wt % of a molecular sieve, 2-80 wt % of a refractory of inorganic oxide, 2-80 wt % of and a clay and 0.1-30 wt % of a metal component calculated by oxide of said metal in maximum oxidative valence state.

The atmosphere containing a reducing gas refers to a pure reducing gas or an atmosphere containing a reducing gas and an inert gas.

Examples of said pure reducing gas include one or more selected from hydrogen, carbon monoxide and hydrocarbons containing 1-5 carbon atoms, preferably one or more selected from hydrogen, carbon monoxide, methane, ethane, propane, butane, pentane and their various isomers.

Said inert gas refers to a gas that does not react with a composition or a metal compound, such as one or more gases selected from the group consisting of Group zero gases in the Periodic Table of Elements, nitrogen, and carbon dioxide.

Examples of said atmosphere containing a reducing gas and an inert gas include mixtures of one or more selected from hydrogen, carbon monoxide, and hydrocarbons containing 1-5 carbon atoms and one or more of inert gases, or dry gases from refining factories (e.g. catalytic cracking tail gas, catalytic reforming tail gas, hydrocracking tail gas or delayed coking tail gas and the like).

In said atmosphere containing a reducing gas, the concentration of the reducing gas is not particularly limited. Preferably, the reducing gas is at least 10% by volume, more preferably 50% by volume of said atmosphere containing a reducing gas.

Said contact temperature and contact time are sufficient enough to decrease the ratio of the average valence to the maximum oxidative valence of said metal component to 0-0.95, preferably 0.1-0.7. In general, said contact temperature may be 100-900° C., preferably 400-700° C., and said contact time may be from 0.1 second to 10 hours, preferably from 1 second to 5 hours. Said contact may be one carried out in a static state, namely that the atmosphere containing a reducing gas contacts with said composition in a sealed vessel. Said contact may also be carried out in a dynamic state, namely that said atmosphere containing a reducing gas passes through the bed of said composition. Contact pressure is not limited, so that the contact may be carried out not only at an atmospheric pressure, but also at a pressure higher than or less then atmospheric pressure. Said atmosphere containing a reducing gas is in an amount not less than 5 ml of the reducing gas per gram of the catalyst per hour, preferably not less than 10 ml of the reducing gas per gram of the catalyst per hour, more preferably 100-2000 ml of the reducing gas per gram of the catalyst per hour.

Preferably, in the composition, each component has such a content that the final catalyst contains, based on the total amount of catalyst, 10-60 wt % of a molecular sieve, 10-50/w of a refractory inorganic oxide, 20-60 wt % of a clay, and 0.5-20 wt % of a metal component calculated by the oxide of said metal in maximum oxidative valence state.

Said composition containing a metal component compound, a molecular sieve, a refractory inorganic oxide and a clay may be a present cracking catalyst containing metal component, or a composition obtained by introducing a metal component compound into the cracking catalyst free of metal component.

Prior methods for preparing a cracking catalyst containing metal component are well known for one skilled in the art, and will not be described hereinafter.

Methods for introducing a metal component compound into a cracking catalyst free of metal component are also conventional. For example, a composition containing a metal component compound, a molecular sieve, a refractory inorganic oxide and a clay may be prepared by introducing a metal component into cracking catalyst free of metal component by using the following methods.

Method No. 1

(1) a). A molecular sieve, a refractory inorganic oxide, a precursor of a refractory inorganic oxide and/or a clay are impregnated with a solution containing a metal component compound, and then are optionally dried; b). or the molecular sieve, refractory inorganic oxide, precursor of the refractory inorganic oxide and/or clay are mixed with the solution containing a metal component compound, and then are optionally dried; c). or the metal component compound is mixed physically with the molecular sieve, refractory inorganic oxides, precursor of the refractory inorganic oxides and/or clay; d). or the solution containing a metal component compound is mixed with the molecular sieve, refractory inorganic oxide, precursor of the refractory inorganic oxide and/or clay, and then a precipitant of said metal component compound is added to precipitate said metal component onto the molecular sieve, refractory inorganic oxides, precursor of the refractory inorganic oxides and/or the clay, finally the resultant mixture is optionally dried; e). or the solution containing a metal component compound is mixed with the molecular sieve, refractory inorganic oxide, precursor of the refractory inorganic oxide and/or clay, and then the slurry obtained is processed into a colloid, f). or the metal component compound insoluble in water is mixed with the molecular sieve, refractory inorganic oxide, precursor of the refractory inorganic oxide and/or clay and deionized water, the slurry obtained is processed into a colloid, and finally the colloid is optionally dried;

(2) The molecular sieve, refractory inorganic oxide, precursor of the refractory inorganic oxide and/or clay, or said mixture, or colloid that have been introduced with said metal component compound, deionized water and the molecular sieve, refractory inorganic oxide, precursor of the refractory inorganic oxide and/or clay that are free of said metal component compound are slurried to prepare a slurry having a solid content of 10-60 wt %, preferably 20-50 wt %, and then the slurry obtained is dried, and optionally calcined.

Method No. 2

The molecular sieve, refractory inorganic oxide and/or precursor of the refractory inorganic oxide, clay and deionized water are slurried to prepare a slurry having a solid content of 10-60 wt %, preferably 20-50 wt %, and then the slurry obtained is dried and optionally calcined. Then, the dried solid is impregnated with the solution containing a metal component compound, or the solution containing a metal component compound is mixed with the dried solid, and then dried and optionally calcined.

Method No. 3

The molecular sieve, refractory inorganic oxide and/or precursor of the refractory inorganic oxide, clay, deionized water are slurried with said metal component compound to prepare a slurry having a solid content of 10-50 wt %, preferably 20-50 wt %, and then the slurry is dried and optionally calcined.

If the catalyst further contains a rare-earth metal component and/or a phosphorus component the rare-earth metal component and/or phosphorus component may be introduced separately or simultaneously with the aforementioned metal component into the catalyst by the aforementioned method, but said metal component compound should be replaced with the rare-earth compound and/or phosphorous compound. Said rare-earth metal component and/or phosphorus component may also be those contained in commercially available molecular sieve (such as rare-earth-containing and/or phosphorus-containing Y-zeolites or ultra-stable Y-zeolites).

Methods and conditions for drying after the introduction of said metal component compound and drying the slurry are well known for one skilled in the art. For example, the drying methods may be air-drying, oven-drying, air-blown drying, or spray drying. Method for drying the slurry is preferably spray drying. Temperature for drying may be in a range of from room temperature to 400° C., preferably 100-350° C. Conditions for calcining the dried slurry and the impregnated metal compound are also well known for one skilled in the art. Generally, the temperature for calcining the dried slurry and the impregnated metal compound is in the range of 400-700° C., preferably 450-650° C. The calcination is conducted at least for 0.5 hour, preferably 0.5-100 hours, more preferably 0.5-10 hours.

A precursor of a refractory inorganic oxide refers to one or more selected from substances capable of forming said refractory inorganic oxide during the preparation of said cracking catalyst. For example, a precursor of alumina may be selected from the group consisting of hydrated alumina (e.g. pseudo-boehmite) and/or alumina-sol. A precursor of silica may be one or more selected from the group consisting of silica-sot, silica gel and water glass. A precursor of amorphous silica-alumina may be one or more selected from the group consisting of silica-alumina sol, mixtures of silica-sol and alumina sol, or silica-alumina gel. A precursor of other refractory inorganic oxides may be selected from their hydroxides, such as hydroxides of zirconium, titanium, and earth alkaline metals, and boric acid.

A metal component compound may be a water-soluble compound of said metal, or a water-insoluble and/or non-soluble compound of said metal, for example, one or more nitrates, chlorides, hydroxides, oxides of metals selected from non-aluminum metals of Group IIIA, metals of Group IV, VA, IB, IIB, VB, VIB and VIIB, and non-noble metals of Group III in the Periodic Table Elements, especially, gallium, tin, copper, silver, zinc, vanadium, molybdenum, manganese, iron, cobalt.

A rare-earth metal compound may be a water-soluble compound of the rare-earth metals, or a water-insoluble and/or non-soluble compound of the rare-earth metals, such as one or more compounds selected from chlorides, nitrates, hydroxides, oxides of rare-earth metals.

A phosphorous compound may be a water-soluble compound of said phosphor, or a water-insoluble and/or non-soluble compound, such as one or more selected from phosphoric acid, phosphorous acid, ammonium phosphates, alkali-metal phosphates, oxides of phosphor, and aluminum phosphate.

(3). Cracking Catalyst Free of a Metal Component

A cracking catalyst free of a metal component may be any metal-free cracking catalyst of hydrocarbons and is well known for one skilled in the art, such as hydrocarbon cracking catalyst containing a molecular sieve, a refractory inorganic oxide, optionally a clay, and optionally a phosphor and a catalyst containing ultra-stable Y-type zeolite, kaolin and alumina under an industrial trademark of ZCM-7 (Chilu Catalyst Factory, Shangdong, China). The content range of each component is also well known for one skilled in the art.

(4). Mixture of a Catalyst and an Additive

In the process of the present invention, a catalyst mixture may also contain one or more of cracking additives. Said cracking additive may be one or more selected from combustion promoter, $SO_X$ transforming catalysts and octane promoter. These additives are described in previous patents and non-patent documents, such as, combustion promoters disclosed in CN 1034222C, CN 1072109A and CN 1089362C, $SO_X$ transforming catalysts disclosed in CN 1286134A, CN 1295877A and CN 1334316A, and octane promoter disclosed in CN 1020280C. CN 1031409C, and the like.

4. Application of the Present Invention

The process of the present invention is suitable for catalytically cracking any hydrocarbon oils so as to increase conversion ability of heavy oils. Said hydrocarbon oils may optionally contain metal impurities such as nickel, vanadium, iron and the like. The process of the present invention is especially suitable for catalytic cracking sulfur-containing or sulfur-free hydrocarbon oils comprising less than 50 ppm of metal impurities. The process of the present invention is especially suitable for catalytically cracking sulfur-containing hydrocarbon oils comprising less than 50 ppm of metal impurities so as to increase ability of converting heavy oils and of desulfurizing gasoline distillates.

A hydrocarbon oil may be a crude oil and a distillate thereof, especially crude oil and a distillate thereof with boiling range higher than 330° C., such as, one or more selected from the group consisting of sulfur-containing or sulfur-free atmospheric residue, vacuum residue, vacuum gas oil, atmospheric gas oil, virgin gas oil, propane light/heavy deasphalted oil and coking gas oil and hydrotreated atmospheric residue, vacuum residue, vacuum gas oil, and atmospheric gas oil.

The following reactor, which is a riser reactor having 2 reaction zones, is exemplified to illustrate in details the present invention. Similar effect will be also obtained by using other reactors. There may be more reaction zones according to the requirements of cracking products. Thus it should not be understood that the reactor used in the process of the present invention is only a riser reactor having only two reaction zones.

In the examples, unless otherwise stated, all regenerators used are two-stage regenerators with a pre-positioned coke-burning tank and all heat exchangers used are a shell-tube exchangers; the amount of stripping steam is about 0.4 wt % circulation rate of the catalyst; the amount of inert gas used for displacing gas is about 8 cubic meters per ton of catalyst per minute; Kaolin used is a product having a solid content of 76 wt %, manufactured by Suzhou Kaolin Corp.; pseudo-boehmite used is a product having a solid content of 62 wt % manufactured by 501 Factory in Zibo, Shandong; alumina sol used is a product having a $Al_2O_3$ content of 21 wt % manufactured by QLCC, silica sol used is a product having a $SiO_2$ content of 27 wt % manufactured by QLCC, SINOPEC; and metal component compounds used are all in a grade of chemical purity.

Example 1

This example describes the cracking catalyst containing metal component and the method for preparing the same according to the present invention.

Kaolin and pseudo-boehmite were mixed with an aqueous solution having a concentration of 30 wt % of cobalt nitrate, and then deionized water was added. After being mixed homogeneously. The resultant mixture was rapidly stirred and added slowly with a hydrochloric acid having a concentration of 36.5 vol %. The pH of the slurry was adjusted to 2.0. A phosphorus- and rare-earth-containing HY-zeolite (under commercial trademark of MOY, having a unit cell size of 24.59 Angstrom, 1.5 wt % of a $Na_2O$, 1.2 wt % of a phosphor calculated by phosphor pentoxide, and 8.5 wt % of a rare-earth oxide in which the content of lanthanum oxide was 4.5 wt %, the content of ceria was 1.1 wt %, and the content of other rare-earth oxides was 2.9 wt %, manufactured by QLCC, SINOPEC) was added and mixed homogeneously. The deionized water was used in such an amount that the slurry obtained had a solid content of 25 wt %. Kaolin, pseudo-boehmite, MOY-zeolite and the aqueous solution of cobalt nitrate were used in amounts such that the weight ratio between kaolin (dry base), $Al_2O_3$, MOY-zeolite (dry base) and $Co_2O_3$ was to 35.0:34.0:30.0:1.0.

The obtained slurry was spray dried at a temperature of 150° C., and then calcined at 550° C. for 1 hour. The obtained catalyst was placed in a fixed bed of a reduction reactor. Hydrogen was introduced into the reduction reactor at a temperature of 400° C. at a flow rate of 5 ml/minute/g.cat. to contact with a solid for 0.5 hour. Then the reactor was cooled to room temperature, and the reduced solid was taken down to obtain cracking catalyst C1 containing a metal component of this invention. The composition of catalyst C1 and the type, distribution, average valence state and the ratio of the average valence to the maximum oxidative valence state of the metal component are shown in Table 1. The catalyst compositions shown in Table 1 were obtained by calculation, and the metal component content was calculated by the oxide in the maximum oxidative valence state of said metal component.

Example 2

This example describes the cracking catalyst containing metal component and a method for preparing the same according to the present invention described.

Cracking catalyst C2 was obtained by using the same method for preparing a catalyst as described in example 1, except that the solid contacted with hydrogen at a temperature of 500° C. for 3 hours. The composition of catalyst C2 and the type, distribution, average valence and ratio of the average valence to the maximum oxidative valence of the metal component are shown in Table 1.

Example 3

This example describes the cracking catalyst containing metal component and a method for preparing the same according to the present invention.

A kaolin was impregnated by an aqueous solution having a concentration of 10 wt % of cobalt nitrate hexahydrate, wherein the weight ratio of the cobalt nitrate hexahydrate to kaolin (dry basis) is 1:0.8224, then dried at 120° C., and finally calcined at 600° C. for 1 hour to obtain a Kaolin containing 2.78 wt % of $CO_2O_3$.

Cracking catalyst C3 containing a metal component was obtained by using the same method for preparing a catalyst as described in Example 1, except that the kaolin in Example 1 was replaced with a kaolin containing 2.78 wt % of $Co_2O_3$ and that no aqueous solution of cobalt nitrate was added. The composition of Catalyst C3 and the type, distribution, average valence and ratio of the average valence to the maximum oxidative valence of the metal component are shown in Table 1.

Example 4

This example describes the cracking catalyst containing metal component and a method for preparing the same according to the present invention.

Catalyst C4 was obtained by the same method for preparing a catalyst as described in example 1, except that the step of contacting the solid with hydrogen was not carried out in the fixed-bed reactor. The composition of C4 is shown in Table 1.

Example 5

This example describes the cracking catalyst containing metal component and a method for preparing the same according to the present invention.

Catalyst C5 was obtained by using the same method for preparing a catalyst as described in example 3, except that the step of contacting the solid with hydrogen was not carried out in the fixed-bed reactor. The composition of C5 is shown in Table 1.

Example 6

This example describes the cracking catalyst containing metal component and a method for preparing the same according to the present invention.

(1) A kaolin was impregnated with an aqueous solution having a concentration of 7.0 wt % of zinc nitrate, wherein the weight ratio of aqueous zinc nitrate solution to kaolin (dry basis) was 1:0.940, then dried at 120° C. and finally calcined at 600° C. for 1 hour to obtain a kaolin containing 3.1 wt % of ZnO.

(2) HY-zeolite having 0.3 wt % of sodium oxide content was obtained by mixing NaY-zeolite (11 wt % of $Na_2O$, a silica-alumina ratio of 5.6, manufactured by Changling Catalyst Factory, SINOPEC) was mixed with an aqueous solution of ammonium chloride having a concentration of 0.15 mole/liter, wherein the mixing ratio was 20 g of NaY-zeolite per liter of the aqueous ammonium chloride solution. The mixture was ion exchanged at 60° C. for 1 hour, and then was filtered. The filtered cake was calcined at 550° C. for 2 hours. After repeating the ion exchange and calcination twice an HY-Zeolite having 0.3 wt % of sodium xide was obtained.

(3) The catalyst was obtained by using the same method as described in example 1, except that the kaolin in example 1 was replaced with the kaolin containing ZnO prepared in (1) and no cobalt nitrate was added; and that MOY was replaced with HY-zeolite prepared in (2). Said ZnO-containing kaolin, pseudo-boehmite, and HY-zeolite were used in such amounts that the weight ratio between kaolin (dry basis), $Al_2O_3$, HY-zeolite (dry basis) and ZnO was to 25.0:19.2:55.0:0.8. The reductive atmosphere was a mixed gas containing 50 vol % of hydrogen and 50 vol % of carbon monoxide, and the amount of the mixed gas was 10 ml/minute/g.cat. The solid contacted with the mixed gas at a temperature of 800° C. for 3 hours, and then cracking Catalyst C6 containing a metal component of this invention was obtained. The composition of catalyst C6 and the type, distribution, average valence and the ratio of the

TABLE 1

| | Example No. | | | | |
|---|---|---|---|---|---|
| | 1 | 2 | 3 | 4 | 5 |
| Catalyst No. | C1 | C2 | C3 | C4 | C5 |
| Type of molecular sieve | MOY | MOY | MOY | MOY | MOY |
| Content of molecular sieve, wt % | 30.0 | 30.0 | 30.0 | 30.0 | 30.0 |
| Kind of refractory inorganic oxide | $Al_2O_3$ | $Al_2O_3$ | $Al_2O_3$ | $Al_2O_3$ | $Al_2O_3$ |
| Content of refractory inorganic oxide, wt % | 34.0 | 34.0 | 34.0 | 34.0 | 34.0 |
| Type of clay | Kaolin | Kaolin | Kaolin | Kaolin | Kaolin |
| Clay content, wt % | 35.0 | 35.0 | 35.0 | 35.0 | 35.0 |
| Type of metal component | Co | Co | Co | Co | Co |
| Content of metal component, wt % | 1.0 | 1.0 | 1.0 | 1.0 | 1.0 |
| Average valence of metal component | +1.5 | 0 | +1.5 | +3 | +3 |
| Ratio of average valence to maximum valence of metal component | 0.5 | 0 | 0.5 | 1 | 1 |
| Distribution of metal component | Distributed homogeneously in catalyst | Distributed homogeneously in catalyst | Distributed homogeneously in clay | Distributed homogeneously in catalyst | Distributed homogeneously in clay |

average valence to the maximum oxidative valence of metal component are shown in Table 2.

Example 7

This example describes the cracking catalyst containing metal component and a method for preparing the same according to the present invention.

A kaolin was impregnated with an aqueous solution having a concentration of 10 wt % of ferric nitrate, wherein the weight ratio of the aqueous ferric nitrate solution to kaolin (dry basis) was 1:1.034, then dried at 120° C., and finally calcined at 600° C. for 2 hour to obtain a kaolin containing 3.1 wt % of $Fe_2O_3$ described.

The catalyst was prepared by using the same method as in example 1, except that the said kaolin in example 1 was replaced with the aforesaid $Fe_2O_3$-containing kaolin and no cobalt nitrate was added; and that MOY was replaced with HY-zeolite prepared by step (2) in Example 4. Said $Fe_2O_3$-containing kaolin, pseudo-boehmite, HY-zeolite were used in such amounts that the weight ratio between kaolin (dry basis), $Al_2O_3$, HY-zeolite (dry basis) and $Fe_2O_3$ was to 25.0:19.2:55.0:0.8. The reductive atmosphere was a mixed gas containing 50 vol % of hydrogen and 50 vol % of carbon monoxide, and the amount of the mixed gas was 6 ml/min/g.cat. The solid contacted with the mixed gas at a temperature of 600° C. for 0.5 hours, and then cracking catalyst C7 containing a metal component was obtained. The composition of catalyst C7 and the type, distribution, average valence and ratio of the average valence to the maximum oxidative valence of the metal component are shown in Table 2.

Example 8

This example describes the cracking catalyst containing metal component and a method for preparing the same according to the present invention.

A mixture of a kaolin and titania was impregnated with an aqueous solution having a concentration of 20.0 wt % of copper nitrate, wherein the weight ratio between the aqueous copper nitrate solution, kaolin (dry basis) and titania was 1:0.871:0.0223, then dried at 120° C., and finally calcined at 600° C. for 2 hour to obtain a mixture of a kaolin containing 8.68 wt % of CuO and titania.

The catalyst was prepared by using the same method as described in example 1, except that said kaolin in example 1 was replaced with aforesaid CuO-containing kaolin and no cobalt nitrate was added; and that MOY was replaced with ultra-stable Y-zeolite (commercial trademark DASY, having a unit cell size of 24.45 Angstrom, a $Na_2O$ content of 1.0 wt %, manufactured by QLCC, SINOPEC). The CuO-containing kaolin, pseudo-boehmite and DASY-zeolite were used in such amounts that the weight ratio of kaolin (dry basis), $TiO_2$, $Al_2O_3$ and DASY-zeolite (dry basis) and CuO was to 39.0:1.0:26.2:30:3-8. The reductive atmosphere was a mixed gas containing 50 vol % of hydrogen and 50 vol % of carbon monoxide, and the amount the mixed gas was 5 ml/min/g.cat. The solid contacted with the mixed gas at 400° C. for 0.5 hours; and cracking catalyst C8 containing a metal component was obtained. The composition of catalyst C8 and the type, distribution, average valence and ratio of the average valence to the maximum oxidative valence of the metal component are shown in Table 2.

Example 9

This example is provided to illustrate said describes the cracking catalyst containing metal component in the present invention and a method for preparing the same according to the present invention.

A kaolin was impregnated with an aqueous solution having a concentration of 5.0 wt % of manganese nitrate, wherein the weight the ratio between the aqueous manganese nitrate solution and kaolin (on dry basis) was 1:0.898, and then dried at 120° C., and finally calcined at 550° C. for 2 hour to obtain a kaolin containing 2.63 wt % of $MnO_2$.

The catalyst was prepared by using the same method as that described in Example example 1, except that aforesaid $MnO_2$-containing kaolin was replaced with the aforesaid $MnO_2$-containing kaolin and no cobalt nitrate was added; and that MOY was replaced with DASY-zeolite and phosphorus- and rare-earth-containing zeolite having MFI structure (commercial trademark ZRP-1, having 2.0 wt % of a phosphor content of based on phosphorus pentoxide, 1.0 wt % of a rare-earth oxide, wherein the content of lanthanum oxide was 0.53 wt %, the content of ceria was 0.13 wt %, the content of the other rare-earth oxides was 0.34 wt %, the content of $Na_2O$ was less than 0.1 wt %, and the molar ratio of $SiO_2$ to $Al_2O_3$ was 60, manufactured by QLCC, SINOPEC). The $MnO_2$-containing kaolin, pseudo-boehmite, DASY-zeolite and ZRP-1 zeolite were used in such amounts that the weight ratio of kaolin (on dry basis), $Al_2O_3$ and DASY-zeolite (on dry basis), ZRP-1 zeolite (on dry basis) and $MnO_2$ was 37.0:27.0:30.0:5.0:1.0. The reductive atmosphere was a mixed gas containing 80 vol % of hydrogen and 20 vol % of propane. The amount of the mixed gas was 7.5 ml/min/g.cat. The solids contacted with the mixed gas at a temperature of 500° C. for 1 hour; and catalyst C9 containing a metal component was obtained. The composition of Catalyst catalyst C9 and the type, distribution, average valence and ratio of the average valence to the maximum oxidative valence of the metal component are shown in Table 2.

TABLE 2

| | Example No. | | | |
|---|---|---|---|---|
| | 6 | 7 | 8 | 9 |
| Catalyst No. | C6 | C7 | C8 | C9 |
| Type of molecular sieve | HY | HY | DASY | DASY/ZRP |
| Content of molecular sieve, wt % | 55.0 | 55.0 | 30.0 | 35.0 |
| Kind of refractory inorganic oxide | $Al_2O_3$ | $Al_2O_3$ | $Al_2O_3$/TiO2 | $Al_2O_3$ |
| Content of refractory inorganic oxide, wt % | 19.2 | 19.2 | 27.2 | 27.0 |
| Type of clay | kaolin | kaolin | kaolin | kaolin |
| Clay content, wt % | 25.0 | 25.0 | 39.0 | 37.0 |
| Type of metal component | Zn | Fe | Cu | Mn |
| Content of metal component, wt % | 0.8 | 0.8 | 3.8 | 1.0 |

TABLE 2-continued

| | Example No. | | | |
|---|---|---|---|---|
| | 6 | 7 | 8 | 9 |
| Average valence of metal component | +1.4 | +2.0 | +0.6 | +1.5 |
| Ratio of average valence to the maximum valence of metal component | 0.70 | 0.67 | 0.3 | 0.38 |
| Distribution of metal component | Distributed homogeneously in clay | Distributed homogeneously in clay | Distributed in clay and refractory inorganic oxide | Distributed homogeneously in clay |

Example 10

This example describes the cracking catalyst containing metal component and a method for preparing the same according to the present invention.

A mixture of kaolin and kieselguhr (a solid content of 85.0 wt %, produced by Huali Kieselguhr Factory ChenZhou, Zhejiang Province) was impregnated with an aqueous solution having a concentration of 5.0 wt % of ammonium molybdate ($(NH_4)_6Mo_7O_{24}.H_2O$), and then dried at 120° C. The mixture was further impregnated with an aqueous solution having a concentration of 2.0 wt % of silver nitrate, wherein the weight ratio between the aqueous ammonium molybdate solution, kaolin (dry basis), kieselguhr (dry basis), and the aqueous silver nitrate solution was 1:0.932:0.155:0.747, then dried at 120° C., and finally calcined at 600° C. for 2 hours to obtain a mixture of kaolin and kieselguhr, which contained 3.58 wt % of $MoO_3$ and 0.90 wt % of $Ag_2O$.

The catalyst was prepared by using the same method as described in example 1, except that the kaolin in example 1 was replaced with said $MoO_3$- and $Ag_2O$-containing mixture of kaolin and kieselguhr and no cobalt nitrate was added, and that the $MoO_3$- and $Ag_2O$-containing mixture of kaolin and kieselguhr, pseudo-boehmite, MOY-zeolite were used in such amounts that the weight ratio between the mixture of kaolin and kieselguhr (dry basis), $Al_2O_3$, MOY-zeolite (dry basis), $MoO_3$ and $Ag_2O$ was 32.0:21.5:45.0:1.2:0.3. The reductive atmosphere was a mixed gas of nitrogen and 50 vol % hydrogen, and the amount of the mixed gas was 12.5 ml/min/g.cat. The solid contacted with the mixed gas at 650° C. for 1 hour, and cracking catalyst C10 containing a metal component was obtained. The composition of catalyst C10 and the type, distribution, average valence and ratio of the average valence to the maximum oxidative valence of metal component are shown in Table 3.

Example 11

This example describes the cracking catalyst containing metal component and a method for preparing the same according to the present invention.

A mixture of kaolin and magnesium oxide, while being stirred, was impregnated with an aqueous solution having a concentration of 2.0 wt % of ammonium metavanadate ($NH_4VO_3$), wherein the weight ratio of between the aqueous ammonium metavanadate solution ($NH_4VO_3$), kaolin (dry basis) and MgO was 1:1.011:0.027, and the resultant slurry was dried at 120° C. and calcined at 550° C. for 2 hours to obtain a kaolin containing 2.46 wt % of MgO and 1.48 wt % of $V_2O_5$.

The catalyst was prepared by using the same method as described in example 1, except that the kaolin in example 1 was replaced with said MgO- and $V_2O_5$-containing kaolin and no cobalt nitrate was added; and that MOY-zeolite was replaced with DASY-zeolite (the same as that in example 6). MgO- and $V_2O_5$-containing kaolin, pseudo-boehmite and DASY-zeolite were used in such amounts that the weight ratio between MgO- and $V_2O_5$-containing kaolin (dry basis), magnesium oxide, $Al_2O_3$, DASY-zeolite (on the weight of dry basis) and $V_2O_5$ was 39.0:1.0:24.4:35.0:0.6. The solid contacted with hydrogen at 550° C. for 1 hour, and cracking catalyst C11 containing a metal component was obtained. The composition of Catalyst C11, the type, distribution, average valence and ratio of the average valence to the maximum oxidative valence of metal component are shown in Table 3.

Example 12

This example describes the cracking catalyst containing metal component and a method for preparing the same according to the present invention.

A mixture of kaolin and pseudo-boehmite was impregnated with an aqueous solution having a concentration of 40 wt % of gallium chloride, wherein the weight ratio between the aqueous gallium chloride solution, kaolin and pseudo-boehmite was 1:1.095:0.314, then dried at 120° C., and finally calcined at 600° C. for 2 hour to obtain a mixture of kaolin with alumina, which contained 13.1 wt % of $Ga_2O_3$.

The mixture of kaolin containing $Ga_2O_3$ and alumina, silica-sol and deionized water were mixed homogeneously, and then DASY-zeolite and ZRP-1 zeolite were added and mixed homogeneously. The deionized water was used in such an amount that the slurry had a solid content of 25 wt %. The mixture of kaolin containing $Ga_2O_3$ and alumina, silica-sol, ultra-stable Y-zeolite and ZRP-1 zeolite were used in such amounts that the weight ratio between kaolin (dry basis), alumina, silica, DASY-zeolite (dry basis), ZRP-1 zeolite (dry basis) and $Ga_2O_3$ was 35.0:10:13.2:30:5:6.8.

The slurry was spray dried at a temperature of 150° C., and then calcined at 550° C. for 2 hours. The solid obtained was placed in a fixed bed of a reduction reactor, and hydrogen was introduced through the reactor at a temperature of 600° C. at a flow rate of 15 mL/min/g.cat. to contact said solid for 2 hours. After the reactor was cooled to room temperature, the reduced solid was taken down and cracking catalyst C12 containing a metal component was obtained. The composition of catalyst C12 and the type, distribution, average valence and ratio of the average valence to the maximum oxidative valence of the metal component are shown in Table 3.

Example 13

This example describes the cracking catalyst containing metal component and a method for preparing the same according to the present invention.

An aqueous solution having a concentration of 6.0 wt % of stannous chloride ($SnCl_2$) was mixed homogeneously with silica-sol and kaolin, wherein the weight ratio between the aqueous stannous chloride $SnCl_2$ solution, silica-sol (dry basis) and kaolin (dry basis) was 1:0.191:0.954, then dried at 120° C., and finally calcined at 550° C. for 3 hours to obtain a mixture of kaolin having 4.0 wt % of $SnO_2$ and silica.

The mixture of $SnO_2$-containing kaolin and silica, alumina-sol and deionized water were mixed homogeneously, and then DASY-zeolite and ZRP-1 zeolite were added and mixed homogeneously. The deionized water was used in such an amount that the slurry obtained had a solid content of 25 wt %. The mixture of $SnO_2$-containing kaolin and silica, alumina-sol, DASY and ZRP-1 zeolite were used in such amounts that the weight ratio between kaolin (dry basis), alumina, silica, DASY-zeolite (dry basis), ZRP-1 zeolite (dry basis) and $SnO_2$ was 40.0:20.0:8.0:25:5:2.0. The obtained slurry was spray dried at a temperature of 150° C., and then was calcined at 550° C. for 2 hours.

The obtained solid was placed in a fixed bed of a reduction reactor, and then hydrogen was introduced through the reactor at a temperature of 650° C. at a flow rate of 5 ml/min/g.cat. to contact with said solid for 1 hour. After the reactor was cooled to room temperature, and the reduced solid was taken down and cracking catalyst C13 containing a metal component was obtained. The composition of catalyst C13 and the type, distribution, average valence and ratio of the average valence to the maximum oxidative valence of metal component are shown in Table 3.

| | Example No. | | | |
|---|---|---|---|---|
| | 10 | 11 | 12 | 13 |
| Catalyst No. | C10 | C11 | C12 | C13 |
| Type of molecular sieve | MOY | DASY | DASY/ZRP-1 | DASY/ZRP-1 |
| Content of molecular sieve, wt % | 45.0 | 35.0 | 35.0 | 30.0 |
| Kind of refractory inorganic oxide | $Al_2O_3$ | $Al_2O_3/MgO$ | $Al_2O_3/SiO_2$ | $Al_2O_3/SiO_2$ |
| Content of refractory inorganic oxide, wt % | 21.5 | 25.4 | 23.2 | 28.0 |
| Type of clay | kaolin/kieselguhr | kaolin | kaolin | kaolin |
| Clay content, wt % | 32.0 | 39.0 | 35.0 | 40.0 |
| Type of metal component | Mo/Ag | V | Ga | Sn |
| Content of metal component, wt % | 1.2/0.3 | 0.6 | 6.8 | 2.0 |
| Average valence of metal component | +3.0/0 | +2.3 | +1.5 | +2.2 |
| Ratio of average valence to maximum valence of metal component | 0.5/0 | 0.46 | 0.5 | 0.55 |
| Distribution of metal component | Distributed homogeneously in clay | Distributed homogeneously in clay and refractory inorganic oxide | Distributed in clay and refractory inorganic oxide | Dispersed in clay and refractory inorganic oxide |

Examples 14-18

The following examples describe the process according to the present invention. This group of examples aims mainly at high production of gasoline.

The catalytic cracking of feedstock oil 1# shown in Table 4 was carried out in accordance with the scheme shown in FIG. 1. The catalysts used were catalysts C1-C5 prepared in examples 1-5, respectively. Said reactor was a changing diameter riser reactor as disclosed in CN1078094C. The reactor was 4000 mm high and had a pre-lifting section with a height of 500 mm and an inner diameter of 12 mm, a first reaction zone 9 with a height of 1200 mm and an inner diameter of 14 mm, a second reaction zone 14 with a height of 1550 mm and an inner diameter of 22 mm and an outlet zone 15 with a height of 750 mm and an inner diameter of 14 mm. The region connecting the first reaction zone 9 with the second reaction zone 14 is in truncated cone shape having a longitudinal section as an isosceles trapezoid with a top angle α of 60° and the region connecting the second reaction zone 15 and the outlet zone is also in truncated cone shape having longitudinal section as an isosceles trapezoid with a base angle β of 60°.

A part of the catalyst that had contacted with the atmosphere containing a reducing gas from reduction reactor 3 was optionally introduced into heat exchanger 7 via line 6 to carry out heat-exchange. The optionally heat-exchanged catalyst was introduced into the pre-lifting section of the reactor via a line, and driven by pre-lifting steam from line 10 to move upward into the first reaction zone 9. Meanwhile, the preheated hydrocarbon oil from line 11 was mixed with the atomizing steam from line 12 and introduced into the first reaction zone 9, where said hydrocarbon oil contacted with the catalyst to carry out a first cracking reaction. The reaction stream continued to move upward into the second reaction zone 14, meanwhile, the other part of the catalyst that had contacted with the atmosphere containing a reducing gas from reduction reactor 3 was optionally introduced into heat exchanger 27 via line 26 to carry out heat-exchange. The optionally heat-exchanged catalyst was introduced into the second reaction zone 14 via line 28. In the second reaction zone 14, the reaction stream from the first reaction zone 9 contacted with the catalyst from line 28 to carry out a second reaction. After the second reaction, the stream continued to move upward through outlet zone 15 into settler 17 of the separation system via horizontal pipe 16. The catalyst and cracked products were separated in settler 17 by the cyclone separator. The separated catalyst was introduced into stripper 18 of the separation system to contact in counter flow with steam from line 19, and cracked products remained on the catalyst were stripped out to obtain a spent catalyst. The cracked products obtained by separation and stripped products were mixed, and then discharged via line 20, and continued to be separated into various distillates in the separation system. The spent catalyst was introduced into regenerator 22 via sloped tube 21. In regenerator 22, the spent catalyst contacted with excess air from line 23 to remove coke thereon, and the flue gas formed was vented out from line 24. The regenerated catalyst was introduced into reduction reactor 3 via line 25, in reduction reactor 3 the regenerated catalyst contacted with the atmosphere containing a reducing gas from line 4 under reduction conditions. After reaction, the waste gas was vented out via line 5. Operation conditions are shown in Table 5 and the compositions of products are shown in Table 6.

Comparative Example 1

DB1

This comparative example describes a reference process for cracking olefin oils.

According to the process of example 18 the same feedstock oil were catalytically cracked with the same catalyst, except that the catalyst introduced into reduction reactor 3 did not contact with the atmosphere containing a reducing gas, namely that no atmosphere containing a reducing gas was introduced from line 4. Operation conditions are shown in Table 5 and the results are shown in Table 6.

TABLE 4

| | Feedstock oils No. | | |
|---|---|---|---|
| | 1# | 2# | 3# |
| Name of feedstock oil | Vacuum gas oil | Atmospheric residuum | Vacuum gas oil |
| Density (20° C.), g/cm$^3$ | 0.9154 | 0.8906 | 0.873 |
| Viscosity, mm$^2$/sec | | | |
| 50° C. | 34.14 | — | — |
| 100° C. | 6.96 | 24.84 | 8.04 |
| Asphaltenes, wt % | 0.0 | 0.8 | 0.0 |
| Conradson carbon residue content, wt % | 0.18 | 4.3 | 0.15 |
| S, Wt % | 2.0 | 0.13 | 0.07 |
| Metal impurities content, ppm | | | — |
| Ni, ppm | 0.4 | 25.5 | |
| V, ppm | — | 14.5 | |
| Distillation range, ° C. | | | |
| IBP | 329 | 282 | 346 |
| 10% | 378 | 370 | 411 |
| 50% | 436 | 553 | 462 |
| 90% | 501 | — | 523 |
| 95% | 518 | — | — |
| FBP | 550 | — | 546 |

TABLE 5

| | | Example No. | | | | | |
|---|---|---|---|---|---|---|---|
| | | 14 | 15 | 16 | 17 | 18 | DB1 |
| | Catalyst No. | C1 | C2 | C3 | C4 | C5 | C5 |
| Temperature, ° C. | First reaction zone 9 | 515 | 520 | 600 | 520 | 525 | 525 |
| | Second reaction zone 14 | 495 | 500 | 570 | 500 | 500 | 500 |
| | Outlet zone 15 | 475 | 480 | 550 | 480 | 480 | 480 |
| Pressure, Mpa | First reaction zone 9 | 0.18 | 0.18 | 0.15 | 0.18 | 0.18 | 0.18 |
| | Second reaction zone 14 | 0.15 | 0.15 | 0.13 | 0.15 | 0.15 | 0.15 |
| Reaction time, second | First reaction zone 9 | 2.0 | 1.0 | 0.8 | 1.0 | 1.0 | 1.0 |
| | Second reaction zone 14 | 5.5 | 5.5 | 6 | 5.5 | 5.5 | 5.5 |
| | Outlet zone 15 | 0.5 | 0.5 | 0.3 | 0.5 | 0.5 | 0.5 |
| Catalyst/oil weight ratio | First reaction zone 9 | 4.0 | 5.0 | 4.0 | 5.5 | 6.0 | 6.0 |
| | Times of Catalyst/oil weight ratio of second reaction zone 14 over Catalyst/oil weight ratio of first reaction zone 9 | 1.5 | 1.4 | 1.5 | 1.18 | 1.4 | 1.4 |
| Temperature of regenerator 22, ° C. | | 690 | 690 | 690 | 690 | 700 | 700 |
| Reduction reactor 3 | Temperature, ° C. | 600 | 600 | 600 | 680 | 650 | — |
| | Time, min | 30 | 20 | 10 | 20 | 20 | — |
| | Pressure, Mpa | 0.13 | 0.13 | 0.13 | 0.13 | 0.13 | — |
| | Atmosphere containing a reduction gas | $H_2$ | $H_2$ | $H_2$ | $H_2$ | $H_2$ | — |
| | Amount of atmosphere containing reduction gas, m$^3$/ton/min | 7 | 7 | 7 | 7 | 7 | — |
| Total amount of atomizing and pre-lifting steam relative to hydrocarbon oils, wt % | | 5 | 5 | 10 | 10 | 5 | 5 |
| Whether it is introduced into heat exchanger 7 to carry out heat exchange | | Yes | Yes | No | Yes | Yes | Yes |
| Whether it is introduced into heat exchanger 27 to carry out heat exchange | | Yes | Yes | Yes | Yes | Yes | Yes |

TABLE 6

| | Example No. | | | | | |
|---|---|---|---|---|---|---|
| | 14 | 15 | 16 | 17 | 18 | DB1 |
| Catalyst No. | C1 | C2 | C3 | C4 | C5 | C5 |
| Product distribution, wt % | | | | | | |
| Dry gas | 3.73 | 3.82 | 4.15 | 3.95 | 3.93 | 4.23 |
| LPG | 13.22 | 13.1 | 13.59 | 12.93 | 13.0 | 12.96 |
| Gasoline | 49.05 | 49.56 | 49.73 | 48.25 | 48.03 | 44.26 |
| Diesel oil | 24.74 | 24.54 | 23.52 | 25.06 | 25.02 | 24.49 |
| Heavy oil | 4.92 | 4.81 | 3.89 | 5.14 | 5.20 | 7.95 |
| Coke | 4.26 | 4.05 | 5.06 | 4.58 | 4.75 | 6.03 |
| Loss | 0.08 | 0.12 | 0.06 | 0.09 | 0.07 | 0.08 |
| Sulfur content in gasoline, mg/L | 327 | 300 | 326 | 500 | 516 | 1100 |

It can be seen from Table 6 that, compared with the reference process, when sulfur-containing hydrocarbon oil is catalytically cracked by the process of the present invention, the content of gasoline in cracked products is increased prominently, the content of diesel oil is also increased, the content of heavy oil and coke are reduced prominently, and the sulfur content in gasoline is decreased in a large extent. This shows that the process of the present invention has much higher ability of cracking and desulfurizing heavy oils and is suitable for high production of gasoline.

Examples 19 to 23

The following examples describe the process of the present invention. This group of examples aims mainly at high production of LPG and gasoline.

The feedstock oil 3# shown in Table 4 was catalytically cracked according to the scheme shown in FIG. 2. Catalyst used was C1-C5 prepared in examples 1-5 respectively. The reactor was described in examples 14-18.

A part of catalyst that had contacted with the atmosphere containing a reducing gas from reduction reactor 3 was optionally introduced into heat exchanger 7 via line 6 to carry out heat-exchange. The optionally heat-exchanged catalyst was introduced into the pre-lifting section of the reactor via line 8, and then driven by pre-lifting steam from line 10 to move upward into the first reaction zone 9. Meanwhile, the preheated hydrocarbon oil from line 11 and the atomizing steam from line 12 were mixed and introduced into the first reaction zone 9, where said hydrocarbon oil contacted with the catalyst to carry out a first cracking reaction. The reaction stream continued to move upward into the second reaction zone 14, meanwhile, the other part of the catalyst that had contacted with the atmosphere containing a reducing gas from reduction reactor 3 was optionally introduced into heat exchanger 27 via line 26 to carry out heat-exchange. The optionally heat-exchanged catalyst was introduced into the second reaction zone 14 via line 28. In the second reaction zone 14, the reaction stream from the first reaction zone 9 contacted with the catalyst from line 28 to carry out a second reaction. After the second reaction, the stream continued to move upward through outlet zone 15 into settler 17 of the separation system via horizontal pipe 16, in settler 17 the catalyst and cracked products are separated by the cyclone separator. The separated catalyst was introduced into stripper 18 of the separation system to contact in counter flow with steam from line 19 and cracked products remained on the catalyst were stripped out to obtain a spent catalyst. The cracked products obtained by separation and stripped products were mixed, and then discharged from line 20, and continued to be separated into various distillates in the separation system. The spent catalyst was introduced into regenerator 22 via sloped tube 21. In regenerator 22, the spent catalyst contacted with excess air from line 23 to remove coke thereon, and the flue gas formed was vented out from line 24. The regenerated catalyst was introduced via line 25 into gas displacement tank 30, where the air entrained by the regenerated catalyst was displaced with nitrogen from line 31. The displacing gas used was vented out via line 32, and the gas-displaced catalyst was introduced into reduction reactor 3 via line 33. In reduction reactor 3, the gas-displaced catalyst contacted with the atmosphere containing a reducing gas from line 4 under reduction conditions, and after reaction, the waste gas was vented out via line 5. Operation conditions are shown in Table 7 and the compositions of products are shown in Table 8.

Comparative Example 2

DB2

This comparative example describes a reference process for cracking olefin oils.

The same feedstock oil was catalytically cracked by the same catalyst according to the process used in example 21, except that the catalyst entering reduction reactor 3 did not contact with the atmosphere containing a reducing gas, namely that no atmosphere containing a reducing gas was introduced from line 4 into the reactor. Operation conditions are shown in Table 7 and the compositions of products are shown in Table 8.

TABLE 7

| | | Example No. | | | | | |
|---|---|---|---|---|---|---|---|
| | | 19 | 20 | 21 | DB2 | 22 | 23 |
| Catalyst No. | | C1 | C2 | C3 | C3 | C4 | C5 |
| Temperature, ° C. | First reaction zone 9 | 580 | 515 | 515 | 515 | 520 | 520 |
| | Second reaction zone 14 | 555 | 490 | 500 | 500 | 490 | 490 |
| | Outlet zone 15 | 530 | 480 | 480 | 480 | 480 | 480 |
| Pressure, Mpa | First reaction zone 9 | 0.18 | 0.15 | 0.20 | 0.20 | 0.25 | 0.25 |
| | Second reaction zone 14 | 0.15 | 0.13 | 0.17 | 0.17 | 0.23 | 0.23 |
| Contact time, sec | First reaction zone 9 | 1.5 | 1.5 | 1.5 | 1.5 | 1.8 | 1.8 |
| | Second reaction zone 14 | 5.8 | 6.2 | 6.2 | 6.2 | 6.2 | 6.2 |
| | Outlet zone 15 | 0.3 | 0.3 | 0.3 | 0.3 | 0.3 | 0.3 |

TABLE 7-continued

| | | Example No. | | | | | |
|---|---|---|---|---|---|---|---|
| | | 19 | 20 | 21 | DB2 | 22 | 23 |
| Catalyst/oil weight ratio | First reaction zone 9 | 4.5 | 4.5 | 4.5 | 4.5 | 5.0 | 4.0 |
| | Times of the Catalyst/oil weight ratio of second reaction zone 14 over the catalyst/oil weight ratio of first reaction zone 9 | 1.2 | 1.33 | 1.5 | 1.5 | 1.6 | 1.63 |
| Temperature of regenerator 22, ° C. | | 680 | 680 | 680 | 680 | 700 | 700 |
| Reduction reactor 3 | Temperature, ° C. | 680 | 620 | 650 | — | 600 | 600 |
| | Time, min | 10 | 20 | 20 | — | 30 | 30 |
| | Pressure, Mpa | 0.13 | 0.13 | 0.16 | — | 0.23 | 0.25 |
| | Atmosphere containing a reducing gas | 50% $H_2$ + 50% CO | 50% $H_2$ + 50% CO | 50% $H_2$ + 50% CO | — | 50% $H_2$ + 50% CO | 50% $H_2$ + 50% CO |
| | Amount of the atmosphere containing a reducing gas, $m^3$/ton/min | 5.5 | 4.0 | 5 | — | 5.5 | 5.5 |
| Amount of nitrogen, $m^3$/ton/min | | 4 | 12 | 8 | — | 4 | 4 |
| Total amount of atomizing and pre-lifting steam relative to hydrocarbon oils, wt % | | 5 | 5 | 8 | 8 | 10 | 10 |
| Whether it is introduced into heat exchanger 7 to carry out heat exchange | | Yes | Yes | Yes | Yes | Yes | Yes |
| Whether it is introduced into heat exchanger 27 to carry out heat exchange | | Yes | Yes | Yes | Yes | Yes | Yes |

TABLE 8

| | Example No. | | | | | |
|---|---|---|---|---|---|---|
| | 19 | 20 | 21 | DB2 | 22 | 23 |
| Catalyst No. | C1 | C2 | C3 | C3 | C4 | C5 |
| Product distribution, wt % | | | | | | |
| Dry gas | 4.96 | 4.36 | 3.95 | 3.76 | 4.15 | 3.93 |
| LPG | 13.92 | 13.64 | 13.48 | 12.82 | 13.4 | 12.27 |
| Gasoline | 49.55 | 49.46 | 49.26 | 45.1 | 49.75 | 49.73 |
| Diesel oil | 23.17 | 24.47 | 24.54 | 24.57 | 24.68 | 24.39 |
| Heavy oil | 4.03 | 4.48 | 5.03 | 7.63 | 4.1 | 5.52 |
| Coke | 4.29 | 3.47 | 3.65 | 6.02 | 3.83 | 4.09 |
| Loss | 0.08 | 0.12 | 0.09 | 0.1 | 0.09 | 0.07 |

It can be seen from Table 8 that compared with the reference process, when an essentially sulfur-free hydrocarbon oil is catalytically cracked by the process of the present invention, the LPG content and gasoline content in the cracked products are increased prominently, and the heavy oil content and coke content are decreased prominently. This shows that the process of the present invention is also suitable for catalytically cracking sulfur-free hydrocarbon oils, and the process of the present invention has much higher ability of cracking heavy oils and is suitable for high production of LPG and gasoline.

Examples 24 to 27

The following examples describe the process of the present invention. This group of examples aims mainly at high production of diesel oil.

The catalytically cracking of a mixed oil of 50 wt % of feedstock oil 2# and 50 wt % of feedstock oil 1# as shown in Table 4 was carried out according to the scheme shown in FIG. 3. The catalyst used was catalyst C6-C9 prepared in examples 6-9 respectively. The heat exchanger 7 was a hot air heater. Said reactor was a conventional equal-diameter riser reactor. The reactor was 4000 mm high and had a pre-lifting section with a height of 500 mm and an inner diameter of 14 mm. The first reaction zone 11 was 1200 mm high and had a second reaction zone 12 with a height of 1550 mm. The inner diameters of the first reaction zone and the second reaction zone were all 20 mm respectively. The outlet zone had an inner diameter of 14 mm and a height of 750 mm. The first reaction zone 9 was below the region connecting line 28 with the reactor, the second reaction zone 14 was above the region connecting line 28 with the reactor, and the outlet zone 15 was above the region connecting line 29 with the reactor.

A part of catalyst that had contacted with the atmosphere containing a reducing gas from reduction reactor 3 was optionally introduced into heat exchanger 7 via line 6 to carry out heat-exchange. The optionally heat-exchanged catalyst was introduced into the pre-lifting section of the reactor via line 8, and then driven by pre-lifting steam from line 10 to move upward into the first reaction zone 9. Meanwhile, the preheated hydrocarbon oil from line 11 and the atomizing steam from line 12 were mixed and introduced into the first reaction zone 9, where said hydrocarbon oil contacted with the catalyst to carry out a first cracking reaction. A chilling agent was injected into the region connecting the first reaction zone 9 with the second reaction zone 14 from line 13 (at a place having a height of 1800 mm from the bottom of the riser reactor). The chilling agent was a crude gasoline at room temperature with a distillation range of 121-250° C. and was used in such an amount that the reaction temperature of reaction stream at the second reaction zone 14 was decreased to that shown in Table 9. The reaction stream continued to move upward to mix with the chilling agent and enter the second reaction zone 14, meanwhile, the other part of the catalyst that had contacted with the atmosphere containing a reducing gas from reduction reactor 3 was optionally introduced into heat exchanger 27 via line 26 to carry out heat-exchange. The optionally heat-exchanged catalyst was introduced into the second reaction zone 14 via line 28. In the second reaction zone 14, the reaction stream from the first reaction zone 9 contacted with the catalyst from line 28 to carry out a second reaction. After the second reaction, the stream continued to move upward through outlet zone 15 into settler 17 of the separation system via horizontal pipe 16, and in settler 17 the catalyst and cracked products were separated by the cyclone separator. The separated catalyst was introduced into stripper 18 of the separation system to contact in counter flow with steam from line 19, and cracked products remained on the catalyst were stripped out to obtain a spent catalyst. The cracked products obtained by separation and stripped products were mixed, and then discharged from line 20, and continued to be separated into various distillates in the separation system. The spent catalyst was introduced into regenerator 22 via sloped tube 21. In regenerator 22, the spent catalyst contacted with excess air from line 23 to remove coke thereon, and the flue gas formed was vented out from line 24. The regenerated catalyst was introduced into reduction reactor 3 via line 25, in reduction reactor 3 the regenerated catalyst contacted with the atmosphere containing a reducing gas from line 4 under reduction conditions. After reaction, the waste gas was vented out via line 5. Operation conditions are shown in Table 9 and the compositions of products are shown in Table 10.

TABLE 9

| | | Example No. | | | |
|---|---|---|---|---|---|
| | | 24 | 25 | 26 | 27 |
| Catalyst No. | | C6 | C7 | C8 | C9 |
| Temperature, ° C. | First reaction zone 9 | 510 | 515 | 515 | 515 |
| | Second reaction zone 14 | 485 | 490 | 490 | 490 |
| | Outlet zone 15 | 475 | 475 | 475 | 475 |
| Pressure, Mpa | First reaction zone 9 | 0.25 | 0.25 | 0.25 | 0.25 |
| | Second reaction zone 14 | 0.20 | 0.20 | 0.20 | 0.20 |
| Contact time, sec | First reaction zone 9 | 3.0 | 0.8 | 0.8 | 1.0 |
| | Second reaction zone 14 | 6.5 | 6.2 | 6.2 | 6.5 |
| | Outlet zone 15 | 0.5 | 0.3 | 0.3 | 0.5 |
| Catalyst/oil weight ratio | First reaction zone 9 | 5.0 | 5.5 | 5.5 | 6.0 |
| | Times of the Catalyst/oil weight ratio of second reaction zone 14 to the Catalyst/oil weight ratio of first reaction zone 9 | 1.18 | 1.3 | 1.18 | 1.17 |
| Temperature of regenerator 22, ° C. | | 650 | 700 | 680 | 680 |
| Reduction reactor 3 | Temperature, ° C | 500 | 480 | 450 | 500 |
| | Time, min | 20 | 3 | 1 | 30 |
| | Pressure, MPa | 0.23 | 0.23 | 0.23 | 0.23 |
| | Atmosphere containing a reducing gas | 50% $H_2$ + 50% dry gas | 50% $H_2$ + 50% dry gas | 50% $H_2$ + 50% dry gas | 50% $H_2$ + 50% dry gas |
| | Amount of the atmosphere containing a reducing gas, $m^3$/ton/min | 7 | 8 | 8 | 7 |
| Total amount of atomizing and pre-lifting steam relative to hydrocarbon oils, wt % | | 8 | 5 | 5 | 8 |
| Whether it is introduced into heat exchanger 7 to carry out heat exchange | | Yes | Yes | Yes | Yes |
| Whether it is introduced into heat exchanger 27 to carry out heat exchange | | Yes | Yes | Yes | No |

TABLE 10

| | Example No. | | | |
|---|---|---|---|---|
| | 24 | 25 | 26 | 27 |
| Catalyst No. | C6 | C7 | C8 | C9 |
| Product distribution, wt % | | | | |
| Dry gas | 3.36 | 3.38 | 3.86 | 3.12 |
| LPG | 13.12 | 13.30 | 13.07 | 12.82 |
| Gasoline | 42.61 | 42.11 | 42.23 | 42.92 |
| Diesel oil | 26.94 | 26.54 | 26.62 | 26.33 |

TABLE 10-continued

| | Example No. | | | |
|---|---|---|---|---|
| | 24 | 25 | 26 | 27 |
| Heavy oil | 6.53 | 6.81 | 6.58 | 7.07 |
| Coke | 7.36 | 7.74 | 7.56 | 7.65 |
| Loss | 0.08 | 0.12 | 0.08 | 0.09 |
| Sulfur content in gasoline, mg/L | 250 | 200 | 150 | 300 |

Examples 28 to 31

The following examples describe the process of the present invention.

The catalytic cracking of feedstock oil 2# shown in Table 4 was carried out according to the scheme shown in FIG. 4. The catalysts used were catalysts C10-C13 prepared in examples 10-13. Said reactor was the same reactor as described in examples 24-27.

A part of catalyst that had contacted with the atmosphere containing a reducing gas from reduction reactor 3 was optionally introduced into heat exchanger 7 via line 6 to carry out heat-exchange. The optionally heat-exchanged catalyst was introduced into the pre-lifting section of the reactor via line 8, and then driven by pre-lifting steam from line 10 to move upward into the first reaction zone 9. Meanwhile, the preheated hydrocarbon oil from line 11 and the atomizing steam from line 12 were mixed and introduced into the first reaction zone 9, where said hydrocarbon oil contacted with the catalyst to carry out a first cracking reaction. A chilling agent was injected into the region connecting the first reaction zone 11 with the second reaction zone 14 from line 13 (at a place having a height of 1800 mm from the bottom of the riser reactor), the chilling agent was a crude gasoline at room temperature with a distillation range of 121-250° C. and was used in such an amount that the reaction temperature of reaction stream at the second reaction zone 14 was decreased to that shown in Table 11. The reaction stream continued to move upward to mix with the chilling agent and enter the second reaction zone 14, meanwhile, the other part of the catalyst that had contacted with the atmosphere containing a reducing gas from reduction reactor 3 was optionally introduced into heat exchanger 27 via line 26 to carry out heat-exchange. The optionally heat-exchanged catalyst was introduced into the second reaction zone 14 via line 28. In the second reaction zone 14, the reaction stream from the first reaction zone 9 contacted with the catalyst from line 28 to carry out a second reaction. A terminator was added via line 29 into the region connecting the second reaction zone with the outlet zone (at the place having a height of 3400 mm from the bottom of the riser reactor). The terminator was a crude gasoline at room temperature with a distillation range of 121 to 250° C. and was used in such an amount that the temperature of the outlet zone was decreased to that shown in Table 11. After the second reaction, the stream continued to move upward to mix with the terminator and pass through outlet zone 15 via line 16 into settler 17 of the separation system, in settler 17 the catalyst and cracked products were separated by the cyclone separator. The separated catalyst was introduced into stripper 18 of the separation system to contact in counter flow with steam from line 19, and cracked products remained on the catalyst were stripped out to obtain a spent catalyst. The cracked products obtained by separation and stripped products were mixed, and then discharged from line 20, and continued to be separated into various distillates in the separation system. The spent catalyst was introduced into regenerator 22 via sloped tube 21. In regenerator 22, the spent catalyst contacted with excess air from line 23 to remove coke thereon, and the flue gas formed was vented out from line 24. The regenerated catalyst was introduced via line 25 into gas displacement tank 30, where the air entrained by a mixture of the regenerated catalyst and a fresh catalyst in a weight relative to 5 wt % of the regenerated catalyst from storage tank 1 via line 2 was displaced with helium from line 31. The displacing gas used was vented out via line 32. The gas-displaced catalyst was introduced into reduction reactor 3 via line 33 to contact with the atmosphere containing a reducing gas from line 4 under reduction conditions. After reaction, the waste gas was vented out via line 5. Operation conditions are shown in Table 11 and the compositions of products are shown in Table 12.

TABLE 11

| | | Example No. | | | |
|---|---|---|---|---|---|
| | | 28 | 29 | 30 | 31 |
| Catalyst No. | | C10 | C11 | C12 | C13 |
| Temperature, ° C. | First reaction zone 9 | 510 | 510 | 510 | 510 |
| | Second reaction zone 14 | 487 | 487 | 487 | 487 |
| | Outlet zone 15 | 470 | 470 | 470 | 470 |
| Pressure, MPa | First reaction zone 9 | 0.15 | 0.15 | 0.15 | 0.15 |
| | Second reaction zone 14 | 0.13 | 0.13 | 0.13 | 0.13 |
| Contact time, sec | First reaction zone 9 | 0.8 | 0.8 | 0.8 | 0.8 |
| | Second reaction zone 14 | 6.0 | 6.0 | 6.0 | 6.0 |
| | Outlet zone 15 | 0.3 | 0.3 | 0.3 | 0.3 |
| Catalyst/oil weight ratio | First reaction zone 9 | 9 | 6 | 6 | 6 |
| | Times of the Catalyst/oil weight ratio of second reaction zone 14 to the Catalyst/oil weight ratio of first reaction zone 9 | 1.18 | 1.17 | 1.17 | 1.17 |
| Temperature of regenerator 22, ° C. | | 680 | 700 | 700 | 700 |
| Reduction reactor 3 | Temperature, ° C. | 520 | 650 | 650 | 650 |
| | Time, min | 20 | 20 | 20 | 20 |
| | Pressure, MPa | 0.12 | 0.12 | 0.12 | 0.12 |
| | Atmosphere containing a reducing gas | 50% $H_2$ + 50% dry gas | 50% $H_2$ + 50% dry gas | 50% $H_2$ + 50% dry gas | 50% $H_2$ + 50% dry gas |
| | Amount of the atmosphere containing a reducing gas, $m^3$/ton/min | 5 | 6 | 6 | 6 |
| Amount used of helium, $m^3$/ton/min | | 8 | 3 | 3 | 3 |
| Total amount of atomizing and pre-lifting steam relative to hydrocarbon oils, wt % | | 8 | 10 | 10 | 10 |
| Whether it is introduced into heat exchanger 7 to carry out heat exchange | | No | Yes | Yes | Yes |
| Whether it is introduced into heat exchanger 27 to carry out heat exchange | | Yes | Yes | Yes | Yes |

TABLE 12

| | Example No. | | | |
|---|---|---|---|---|
| | 28 | 29 | 30 | 31 |
| Catalyst No. | C10 | C11 | C12 | C13 |
| Product distribution, wt % | | | | |
| Dry gas | 3.17 | 3.18 | 3.12 | 3.02 |
| LPG | 12.03 | 11.4 | 11.15 | 11.32 |
| Gasoline | 42.14 | 41.97 | 41.93 | 42.29 |
| Diesel oil | 25.73 | 25.98 | 26.32 | 26.33 |
| Heavy oil | 8.0 | 8.31 | 8.64 | 8.3 |
| Coke | 8.85 | 9.04 | 8.76 | 8.65 |
| Loss | 0.08 | 0.12 | 0.08 | 0.09 |
| Sulfur content in gasoline, mg/L | 50 | 80 | 70 | 46 |

Examples 32-35

The following examples describe the process of the present invention. This group of examples aims mainly at high production of diesel oil.

The catalytic cracking of a mixed oil of 20 wt % of feedstock oil 1# and 80 wt % of feedstock oil 2# shown in Table 4 was carried out according to the scheme shown in FIG. 2. Said reactor was a diameter-changing riser reactor as disclosed in CN1078094. The reactor had a total height of 15 m and the pre-lifting section has a height of 1.5 m with a diameter of 0.25 m. The first reaction zone 9 had a height of 4 m with a diameter of 0.25 m. The second reaction zone 14 had a height of 6.5 m with a diameter of 0.5 m. The outlet zone had a diameter of 0.25 m and a height of 3 m. The region connecting the first reaction zone with the second reaction zone had a 45° top angle α of isosceles trapezoid in longitudinal section, and the region connecting the second reaction zone and the outlet zone also had a 45° base angle β of isosceles trapezoid in longitudinal section.

The catalysts used were respectively: (1) C14, a catalyst under a commercial trademark of MLC-500 containing rare-earth oxide, ultra-stable Y-molecular sieve, alumina and kaolin, in which the content of rare-earth oxide was 3.2 wt %; (2) C15, a catalyst under a commercial trademark of CR022 comprising a phosphor- and rare-earth-containing HY molecular sieve, ultra-stable Y molecular sieve, a zeolite having MFI structure, alumina and kaolin, in which the content of rare-earth oxide was 3.0 wt %, the content of phosphorus pentoxide was 1.0 wt %; (3) C16, a catalyst mixture consisting of 95 wt % of a catalyst under a commercial trademark of HGY-2000R and 5 wt % of catalyst C1 prepared in example 1, wherein said catalyst under a commercial trademark of HGY-2000R contained rare-earth Y-molecular sieve, ultra-stable Y-molecular sieve, alumina and kaolin, in which the content of rare-earth oxide was 2.1 wt; (4) C17, a mixture of 85 wt % of a catalyst under a commercial trademark GOR-II and 15 wt % of catalyst C5 prepared in example 5, wherein said catalyst under a commercial trademark of HGY-2000R contained rare earth Y-molecular sieve, ultra-stable Y-molecular sieve, a zeolite having MFI structure, alumina, kaolin, in which the content of rare earth oxide was 2.5 wt %.

A part of catalyst that had contacted with the atmosphere containing a reducing gas from reduction reactor 3 was optionally introduced into heat exchanger 7 via line 6 to carry out heat-exchange. The optionally heat-exchanged catalyst was introduced into the pre-lifting section of the reactor via line 8, and then driven by pre-lifting steam from line 10 to move upward into the first reaction zone 9. Meanwhile, the preheated hydrocarbon oil from line 11 and the atomizing steam from line 12 were mixed and introduced into the first reaction zone 9, where said hydrocarbon oil contacted with the catalyst to carry out a first cracking reaction. A chilling agent was injected into the region connecting the first reaction zone 9 with the second reaction zone 14 from line 13 (at a place having a height of 6.2 mm from the bottom of the riser reactor). The chilling agent was a crude gasoline at room temperature with a to distillation range of 121-250° C. and was used in such an amount that the reaction temperature of reaction stream at the second reaction zone 14 was decreased to that shown in Table 13. The reaction stream continued to move upward to mix with the chilling agent and enter the second reaction zone 14, meanwhile, the other part of the catalyst that had contacted with the atmosphere containing a reducing gas from reduction reactor 3 was optionally introduced into heat exchanger 27 via line 26 to carry out heat-exchange. The optionally heat-exchanged catalyst was introduced into the second reaction zone 14 via line 28. In the second reaction zone 14, the reaction stream from the first reaction zone 9 contacted with the catalyst from line 28 to carry out a second reaction. A terminator was added via line 29 into the region connecting the second reaction zone with outlet zone (at the place having a height of 12.3 mm from the bottom of the riser reactor). The terminator was a crude gasoline at room temperature with a distillation range of 121 to 250° C. and was used in such an amount that the temperature of the outlet zone was decreased to that shown in Table 13. After the second reaction, the stream continued to move upward to mix with the terminator and pass through outlet zone 15 via line 16 into settler 17 of the separation system. The catalyst and cracked products were separated in settler 17 by the cyclone separator. The separated catalyst was introduced into stripper 18 of the separation system to contact in counter flow with steam from line 19, and cracked products remained on the catalyst were stripped out to obtain a spent catalyst. The cracked products obtained by separation and stripped products were mixed, and then discharged via line 20, and continued to be separated into various distillates in the separation system. The spent catalyst was introduced into regenerator 22 via sloped tube 21. In regenerator 22, the spent catalyst contacted with excess air from line 23 to remove coke thereon, and the flue gas formed was vented out from line 24. The regenerated catalyst was introduced via line 25 into gas displacement tank 30, where the air entrained by the regenerated catalyst was displaced with nitrogen from line 31. The displacing gas used was vented out via line 32 and the gas-displaced catalyst was introduced into reduction reactor 3 via line 33 to contact with the atmosphere containing a reducing gas from line 4 under reduction conditions. After reaction, the waste gas was vented out via line 5. Operation conditions are shown in Table 13 and the compositions of products are shown in Table 14.

Comparative Example 3

DB3

This comparative example describes a reference process for cracking olefin oils.

The same feedstock oil was catalytically cracked by the same catalyst according to the process used in example 32, except that the catalyst entering reduction reactor 3 did not contact with the atmosphere containing a reducing gas, namely that no atmosphere containing a reducing gas was introduced from line 4 into the reactor. Operation conditions are shown in Table 13 and the compositions of products are shown in Table 14.

Comparative Example 4

DB4

This comparative example describes a reference process for cracking olefin oils.

The same feedstock oil was catalytically cracked by the same catalyst according to the process used in example 35, except that the catalyst entering reduction reactor 3 did not contact with the atmosphere containing a reducing gas namely that no atmosphere containing a reducing gas was introduced from line 4 into the reactor. The compositions of products are shown in Table 14.

TABLE 13

| | | Example No. | | | | | |
|---|---|---|---|---|---|---|---|
| | | 32 | DB3 | 33 | 34 | 35 | DB4 |
| Catalyst No. | | C14 | C14 | C15 | C16 | C17 | C17 |
| Temperature, ° C. | First reaction zone 9 | 510 | 510 | 510 | 510 | 510 | 510 |
| | Second reaction zone 14 | 490 | 490 | 490 | 490 | 490 | 490 |
| | Outlet zone 15 | 480 | 480 | 480 | 480 | 480 | 480 |
| Pressure, Mpa | First reaction zone 9 | 0.15 | 0.15 | 0.15 | 0.15 | 0.15 | 0.15 |
| | Second reaction zone 14 | 0.13 | 0.13 | 0.13 | 0.13 | 0.13 | 0.13 |
| Contact time, sec | First reaction zone 9 | 1.0 | 1.0 | 0.8 | 0.8 | 1.0 | 1.0 |
| | Second reaction zone 14 | 5.5 | 5.5 | 5.2 | 5.2 | 5.5 | 5.5 |
| | Outlet zone 15 | 0.5 | 0.5 | 0.3 | 0.3 | 0.5 | 0.5 |
| Catalyst/oil weight ratio | First reaction zone 9 | 5.0 | 5.0 | 5.5 | 5.5 | 6.0 | 6.0 |
| | Times of the Catalyst/oil weight ratio of second reaction zone 14 to the Catalyst/oil weight ratio of first reaction zone 9 | 1.3 | 1.3 | 1.18 | 1.18 | 1.17 | 1.17 |
| Temperature of regenerator 22, ° C. | | 650 | 650 | 680 | 680 | 690 | 690 |
| Reduction reactor 3 | Temperature, ° C. | 520 | — | 520 | 520 | 700 | — |
| | Time, min | 30 | — | 20 | 20 | 5 | — |
| | Pressure, MPa | 0.12 | — | 0.12 | 0.12 | 0.12 | — |
| | Atmosphere containing a reducing gas | 50% $H_2$ + 50% CO | — | 50% $H_2$ + 50% CO | 70% $H_2$ + 30% CO | 70% $H_2$ + 30% CO | — |
| | Amount of the atmosphere containing a reducing gas, $m^3$/ton/min | 5 | — | 6 | 6 | 6 | — |
| Amount of nitrogen, $m^3$/ton/min | | 8 | — | 3 | 3 | 3 | — |
| Total amount of atomizing and pre-lifting steam relative to hydrocarbon oils, wt % | | 8 | 8 | 8 | 8 | 10 | 10 |
| Whether it is introduced into heat exchanger 7 to carry out heat exchange | | No | Yes | No | No | Yes | Yes |
| Whether it is introduced into heat exchanger 27 to carry out heat exchange | | Yes | Yes | Yes | Yes | Yes | Yes |

TABLE 14

| | Example No. | | | | | |
|---|---|---|---|---|---|---|
| | 32 | DB3 | 33 | 34 | 35 | DB4 |
| Catalyst No. | C14 | C14 | C15 | C16 | C17 | C17 |
| Product distribution, wt % | | | | | | |
| Dry gas | 3.16 | 3.65 | 3.02 | 3.13 | 3.95 | 3.28 |
| LPG | 12.62 | 12.18 | 12.58 | 12.22 | 12.00 | 11.72 |
| Gasoline | 41.35 | 42.06 | 41.96 | 41.50 | 41.15 | 41.23 |
| Diesel oil | 27.87 | 22.34 | 27.04 | 27.90 | 27.68 | 22.61 |
| Heavy oil | 7.03 | 10.03 | 7.28 | 7.13 | 7.00 | 11.80 |
| Coke | 7.89 | 9.65 | 8.00 | 8.02 | 8.13 | 9.29 |
| Loss | 0.08 | 0.09 | 0.12 | 0.1 | 0.09 | 0.07 |
| Sulfur content in gasoline, mg/L | 100 | 310 | 90 | 80 | 115 | 350 |

It can be seen from Table 14 that compared with the reference process in which the step of reduction is not carried out, when the sulfur-containing hydrocarbon oil is catalytically cracked according to the process of the present invention, the content of diesel oil in cracking products is also increased, the content of heavy oil and coke are reduced prominently, and the sulfur content in gasoline is decreased in a large extent. This shows further that the process of the present invention has much higher ability of cracking and desulfurizing heavy oil, and that it is suitable for high production of diesel oil.

Examples 36-40

The following examples describe the process of the present invention. This group of examples aims mainly at high production of gasoline.

The catalytic cracking of feedstock oil 1# shown in Table 4 was carried out in accordance with the scheme shown in FIG. 5. The catalysts used were catalysts C1-C5 prepared in examples 1-5 respectively. Said reactor was that described in examples 14-18.

The catalyst that had contacted with the atmosphere of reduction gas was introduced into the pre-lifting section of the reactor via line 8, and then driven by pre-lifting steam from line 10 to move upward into the first reaction zone 9. Meanwhile, the preheated hydrocarbon oil from line 11 and the atomizing steam from line 12 were mixed and introduced into the first reaction zone 9, where said hydrocarbon oil contacted with the catalyst to carry out a first cracking reaction. The reaction stream continued to move upward to the second reaction zone 14 to contact with the spent catalyst from line 28 to carry out a second reaction. After second reaction was carried out, the stream continued to move upward through outlet zone 15 into settler 17 of separation system via a horizontal pipe 16, in settler 17 the catalyst and cracked products were separated by cyclone separator. The separated catalyst was introduced into stripper 18 to contact in counter flow with steam from line 19, and cracked products remained on the catalyst were stripped out to obtain a spent catalyst. The cracked products obtained by separation and stripped products were mixed, and then discharged via line 20, and continued to be separated into various distillates in the separation system. The spent catalyst was introduced into regenerator 22 via sloped tube 21. In regenerator 22, a part of the spent catalyst contacted with excess air from line 23 to remove coke thereon, and the flue gas formed was vented out from line 24. The regenerated catalyst was introduced via line 25 into reduction reactor 3, where the regenerated catalyst contacted with the atmosphere containing a reducing gas from line 4 under reduction conditions. After reaction, the waste gas was vented out via line 5. The catalyst that had contacted with the atmosphere containing a reducing gas was optionally introduced into heat exchanger 7 via line 6 to carry out heat-exchange, the optionally heat-exchanged catalyst was introduced into the pre-lifting section of the reactor via line 8. The other part of the spent catalyst was introduced into regenerator 22, and then rapidly optionally introduced into heat exchanger 27 via line 26. The optionally heat-exchanged spent catalyst was introduced into the second reaction zone via line 28 to contact and react with the reaction product from the first reaction zone 9. Operation conditions are shown in Table 15 and the compositions of products are shown in Table 16.

Comparative Example 5

DB5

This comparative example describes a reference process for cracking olefin oils.

The same feedstock oil was catalytically cracked by the same catalyst according to the process used in example 40, except that the catalyst entering reduction reactor 3 did not contact with the atmosphere containing a reducing gas, namely that no atmosphere containing a reducing gas was introduced from line 4 into the reactor. Operation conditions are shown in Table 15 and the compositions of products are shown in Table 16.

TABLE 15

| | | Example No. | | | | | |
|---|---|---|---|---|---|---|---|
| | | 36 | 37 | 38 | 39 | 40 | DB5 |
| Catalyst No. | | C1 | C2 | C3 | C4 | C5 | C5 |
| Temperature, ° C. | First reaction zone 9 | 520 | 520 | 600 | 525 | 520 | 520 |
| | Second reaction zone 14 | 500 | 505 | 580 | 505 | 500 | 500 |
| | Outlet zone 15 | 475 | 480 | 560 | 480 | 480 | 480 |
| Pressure, Mpa | First reaction zone 9 | 0.18 | 0.18 | 0.15 | 0.18 | 0.18 | 0.18 |
| | Second reaction zone 14 | 0.15 | 0.15 | 0.13 | 0.15 | 0.15 | 0.15 |
| Contact time, sec | First reaction zone 9 | 2.2 | 1.2 | 1.0 | 1.0 | 1.0 | 1.0 |
| | Second reaction zone 14 | 6.2 | 6.2 | 6 | 5.8 | 5.8 | 5.8 |
| | Outlet zone 15 | 0.5 | 0.5 | 0.3 | 0.5 | 0.5 | 0.5 |
| Catalyst/oil weight ratio | First reaction zone 9 | 6.0 | 5.2 | 4.3 | 5.5 | 6.0 | 6.0 |
| | Times of the Catalyst/oil weight ratio of second reaction zone 14 to the Catalyst/oil weight ratio of first reaction zone 9 | 1.51 | 1.35 | 1.2 | 1.18 | 1.17 | 1.17 |
| Temperature of regenerator 22, ° C. | | 690 | 680 | 680 | 690 | 700 | 700 |
| Reduction reactor 3 | Temperature, ° C. | 600 | 600 | 600 | 680 | 650 | — |
| | Time, min | 30 | 20 | 10 | 20 | 20 | — |
| | Pressure, Mpa | 0.13 | 0.13 | 0.13 | 0.13 | 0.13 | — |
| | Atmosphere containing a reducing gas | $H_2$ | $H_2$ | $H_2$ | $H_2$ | $H_2$ | — |
| | Amount of the atmosphere containing a reducing gas, $m^3$/ton/min | 7 | 7 | 7 | 7 | 7 | — |
| Total amount of atomizing and pre-lifting steam relative to hydrocarbon oils, wt % | | 5 | 5 | 10 | 10 | 5 | 5 |
| Whether it is introduced into heat exchanger 7 to carry out heat exchange | | Yes | Yes | No | Yes | Yes | Yes |
| Whether it is introduced into heat exchanger 27 to carry out heat exchange | | Yes | Yes | Yes | Yes | Yes | Yes |

TABLE 16

| | Example No. | | | | | |
|---|---|---|---|---|---|---|
| | 36 | 37 | 38 | 39 | 40 | DB5 |
| Catalyst No. | C1 | C2 | C3 | C4 | C5 | C5 |
| Product distribution, wt % | | | | | | |
| Dry gas | 3.54 | 3.61 | 4.02 | 3.76 | 3.61 | 4.24 |
| LPG | 13.21 | 13.24 | 13.66 | 12.83 | 12.94 | 12.83 |
| Gasoline | 48.96 | 49.26 | 49.65 | 48.18 | 48.16 | 44.17 |
| Diesel oil | 24.81 | 24.73 | 23.48 | 25.31 | 25.18 | 24.67 |
| Heavy oil | 5.03 | 4.86 | 4.00 | 5.20 | 5.27 | 7.83 |
| Coke | 4.36 | 4.16 | 5.10 | 4.60 | 4.74 | 6.13 |
| Loss | 0.09 | 0.14 | 0.09 | 0.12 | 0.1 | 0.13 |
| Sulfur content in gasoline, mg/L | 340 | 310 | 330 | 520 | 530 | 1200 |

It can be seen from Table 16 that compared with the reference process, when the sulfur-containing hydrocarbon oil is catalytically cracked by the process of the present invention, the content of gasoline in cracked products is increased prominently, the content of diesel oil is also increased, the content of heavy oil is decreased prominently, the coke content is reduced prominently, and the sulfur content in gasoline is decreased in a large extent. This shows that the process of the present invention has much higher ability of cracking and desulfurizing heavy oil, so it is suitable for high production of gasoline.

Examples 41 to 45

The following examples describe the process of the present invention. This group of examples aims mainly at high production of LPG and gasoline.

The catalytic cracking of feedstock oil 3# shown in Table 4 was carried out according to FIG. 6. The catalysts used were catalysts C1-C5 prepared in examples 1-5 respectively. Said reactor was that described in examples 14-18.

The catalyst that had contacted with the atmosphere containing a reducing gas was introduced into the pre-lifting section of the reactor from line 8, and then driven by pre-lifting steam from line 10 to move upward into the first reaction zone 9. Meanwhile, the preheated hydrocarbon oil from line 11 and the atomizing steam from line 12 were mixed and introduced into the first reaction zone 9, where said hydrocarbon oil contacted with the catalyst to carry out a first cracking reaction. The reaction stream continued to move upward to the second reaction zone 14, where it contacted with the spent catalyst from line 28 to carry out a second reaction. After the second reaction, the stream continued to move upward through outlet zone 15 into settler 17 of the separation system via horizontal pipe 16, in settler 17 the catalyst and cracked products were separated by the cyclone separator. The separated catalyst was introduced into stripper 18 of the separation system to contact in counter flow with steam from line 19, and cracked products remained on the catalyst were stripped out to obtain the spent catalyst. The cracked products obtained by separation and stripped products were mixed, and then discharged from line 20, and continued to be separated into various distillates in the separation system. The spent catalyst was introduced into regenerator 22 via sloped tube 21. In regenerator 22, a part of the spent catalyst contacted with excess air from line 23 to remove coke thereon, and the flue gas formed was vented out from line 24. The regenerated catalyst was introduced via line 25 into gas displacement tank 30, where the oxygen-containing gas entrained by the regenerated catalyst was displaced with nitrogen from line 31. The displacing gas used was vented out via line 32 and the gas-displaced catalyst was introduced into reduction reactor 3 via line 33. In reduction reactor 3, the regenerated catalyst contacted with the atmosphere containing a reducing gas from line 4 under reduction conditions. After reaction, the waste gas was vented out via line 5. The catalyst that had contacted with the atmosphere containing a reducing gas was optionally introduced into heat exchanger 7 via line 6 to carry out heat-exchange, the optionally heat-exchanged catalyst was introduced into the pre-lifting section of the reactor via line 8. The other part of the spent catalyst was introduced into regenerator 22, and then rapidly optionally introduced into heat exchanger 27 via line 26. The optionally heat-exchanged spent catalyst was introduced into the second reaction zone via line 28 to contact and react with the reaction product from the first reaction zone 9. Operation conditions are shown in Table 17 and the compositions of products are shown in Table 18.

Comparative Example 6

DB6

This comparative example describes a reference process for cracking olefin oils.

The same feedstock oil was catalytically cracked by the same catalyst according to the process in example 43, except that the catalyst entering reduction reactor 3 did not contact with the atmosphere containing a reducing gas, namely that no atmosphere containing a reducing gas was introduced from line 4 into the reactor. Operation conditions are shown in Table 17 and the compositions of products are shown in Table 18.

TABLE 17

| | | Example No. | | | | | |
|---|---|---|---|---|---|---|---|
| | | 41 | 42 | 43 | DB6 | 44 | 45 |
| Catalyst No. | | C1 | C2 | C3 | C3 | C4 | C5 |
| Temperature, ° C. | First reaction zone 9 | 570 | 510 | 510 | 510 | 520 | 520 |
| | Second reaction zone 14 | 555 | 490 | 500 | 500 | 490 | 490 |
| | Outlet zone 15 | 530 | 480 | 480 | 480 | 480 | 480 |
| Pressure, Mpa | First reaction zone 9 | 0.18 | 0.15 | 0.20 | 0.20 | 0.25 | 0.25 |
| | Second reaction zone 14 | 0.15 | 0.13 | 0.17 | 0.17 | 0.23 | 0.23 |
| Contact time, sec | First reaction zone 9 | 1.0 | 1.5 | 1.5 | 1.5 | 1.3 | 1.5 |
| | Second reaction zone 14 | 6.0 | 6.4 | 6.4 | 6.4 | 6.4 | 6.4 |
| | Outlet zone 15 | 0.5 | 0.5 | 0.3 | 0.3 | 0.5 | 0.5 |
| Catalyst/oil weight ratio | First reaction zone 9 | 4.5 | 5.0 | 5.0 | 5.0 | 5.5 | 4.5 |
| | Times of the Catalyst/oil weight ratio of second reaction zone 14 to the Catalyst/oil weight ratio of first reaction zone 9 | 1.2 | 1.3 | 1.6 | 1.6 | 1.4 | 1.5 |
| Temperature of regenerator 22, ° C. | | 690 | 690 | 680 | 680 | 700 | 700 |
| Reduction reactor 3 | Temperature, ° C. | 680 | 620 | 650 | — | 600 | 600 |
| | Time, min | 10 | 20 | 20 | — | 30 | 30 |
| | Pressure, Mpa | 0.13 | 0.13 | 0.16 | — | 0.23 | 0.25 |
| | Atmosphere containing a reducing gas | 50% $H_2$ + 50% CO | 50% $H_2$ + 50% CO | 50% $H_2$ + 50% CO | — | 50% $H_2$ + 50% CO | 50% $H_2$ + 50% CO |
| | Amount of the atmosphere containing a reducing gas, $m^3$/ton/min | 5.5 | 4.0 | 5.5 | — | 5.5 | 5.0 |

TABLE 17-continued

| | Example No. | | | | | |
|---|---|---|---|---|---|---|
| | 41 | 42 | 43 | DB6 | 44 | 45 |
| Amount of nitrogen, $m^3$/ton/min | 4 | 12 | 8 | — | 4 | 4 |
| Total amount of atomizing and pre-lifting steam relative to hydrocarbon oils, wt % | 5 | 5 | 8 | 8 | 10 | 10 |
| Whether it is introduced into heat exchanger 7 to carry out heat exchange | Yes | Yes | Yes | Yes | Yes | Yes |
| Whether it is introduced into heat exchanger 27 to carry out heat exchange | Yes | Yes | Yes | Yes | Yes | Yes |

TABLE 18

| | Example No. | | | | | |
|---|---|---|---|---|---|---|
| | 41 | 42 | 43 | DB6 | 44 | 45 |
| Catalyst No. | C1 | C2 | C3 | C3 | C4 | C5 |
| Product distribution, wt % | | | | | | |
| Dry gas | 4.67 | 4.25 | 3.84 | 3.58 | 4.03 | 3.84 |
| LPG | 13.83 | 13.51 | 13.32 | 12.71 | 13.21 | 12.08 |
| Gasoline | 49.86 | 49.37 | 49.17 | 45.03 | 49.62 | 49.62 |
| Diesel oil | 23.18 | 24.63 | 24.68 | 24.77 | 24.79 | 24.53 |
| Heavy oil | 4.08 | 4.59 | 5.16 | 7.84 | 4.34 | 5.68 |
| Coke | 4.33 | 3.52 | 3.72 | 5.94 | 3.93 | 4.16 |
| Loss | 0.05 | 0.13 | 0.11 | 0.13 | 0.08 | 0.09 |

It can be seen from Table 18 that compared with the reference process when a sulfur-free hydrocarbon oil is catalytically cracked by the process of the present invention, the content of LPG and gasoline in cracked products is increased prominently, and the content of heavy oil and coke is decreased prominently. This shows that the process of the present invention is also suitable for use in the catalytic cracking of sulfur-free hydrocarbon oil, and the process of the present invention has much higher ability of cracking heavy oil, and it is suitable for high production of LPG and gasoline.

Examples 46-49

The following examples describe the process of the present invention. This group of examples aims mainly at high production of diesel oil.

The catalytic cracking of a mixed oil of 50 wt % of feedstock oil 2# and 50 wt % of feedstock oil 1# as shown in Table 4 was carried out according to the scheme shown in FIG. 7. The catalysts used were catalysts C6-C9 prepared in example 6-9 respectively. Said heat exchanger 7 was a hot air heater. Said reactor was that described in examples 24-27.

The catalyst that had contacted with the atmosphere containing a reducing gas was introduced into the pre-lifting section of the reactor from line 8, and then driven by pre-lifting steam from line 10 to move upward into the first reaction zone 9. Meanwhile, the preheated hydrocarbon oil from line 11 and the atomizing steam from line 12 were mixed and introduced into the first reaction zone 9, where said hydrocarbon oil contacted with the catalyst to carry out a first cracking reaction. A chilling agent was continuously injected via line 13 into the region connecting the first reaction zone 9 with the second reaction zone 14 (at a place having a height of 1800 mm from the bottom of the riser reactor). The chilling agent was a crude gasoline at room temperature with a distillation range of 121-250° C. and was used in such an amount that the reaction temperature of reaction stream at the second reaction zone 14 was decreased to that shown in Table 9. The reaction stream continued to move upward to mix the chilling agent and enter the second reaction zone 14, where it contacted with the spent catalyst from line 28 to carry out a second reaction. After the second reaction, the stream continued to move upward through outlet zone 15 into settler 17 of the separation system via horizontal pipe 16, in settler 17 the catalyst and cracked products were separated by the cyclone separator. The separated catalyst was introduced into stripper 18 of the separation system to contact in counter flow with steam from line 19, and cracked products remained on the catalyst were stripped out to obtain a spent catalyst. The cracked products obtained by separation and stripped products were mixed, and then discharged from line 20, and continued to be separated into various distillates in the separation system. The spent catalyst was introduced into regenerator 22 via sloped tube 21. In regenerator 22, a part of the spent catalyst contacted with excess air from line 23 to remove coke thereon, and the flue gas formed was vented out from line 24. The regenerated catalyst was introduced into reduction reactor 3 via line 25, in reduction reactor 3 the regenerated catalyst contacted with the atmosphere containing a reducing gas from line 4 under reduction conditions. After reaction, the waste gas was vented out via line 5. The catalyst that had contacted with the atmosphere containing a reducing gas was optionally introduced into heat exchanger 7 via line 6 to carry out heat-exchange, the optionally heat-exchanged catalyst was introduced into the pre-lifting section of the reactor via line 8. The other part of the spent catalyst was introduced into regenerator 22, and then rapidly optionally introduced into heat exchanger 27 via line 26. The optionally heat-exchanged spent catalyst was introduced into the second reaction zone via line 28 to contact and react with the reaction product from the first reaction zone 9. Operation conditions are shown in Table 19 and the compositions of products are shown in Table 20.

TABLE 19

| | | Example No. | | | |
|---|---|---|---|---|---|
| | | 46 | 47 | 48 | 49 |
| Catalyst No. | | C6 | C7 | C8 | C9 |
| Temperature, ° C. | First reaction zone 9 | 515 | 520 | 520 | 520 |
| | Second reaction zone 14 | 490 | 495 | 495 | 495 |
| | Outlet zone 15 | 475 | 475 | 475 | 475 |
| Pressure, Mpa | First reaction zone 9 | 0.25 | 0.25 | 0.25 | 0.25 |
| | Second reaction zone 14 | 0.20 | 0.20 | 0.20 | 0.20 |
| Contact time, sec | First reaction zone 9 | 3.0 | 1.0 | 1.0 | 1.3 |
| | Second reaction zone 14 | 6.2 | 6.5 | 6.5 | 6.2 |
| | Outlet zone 15 | 0.5 | 0.5 | 0.5 | 0.5 |
| Catalyst/oil weight ratio | First reaction zone 9 | 5.5 | 6.0 | 5.5 | 6.0 |
| | Times of the Catalyst/oil weight ratio of second reaction zone 14 to the Catalyst/oil weight ratio of first reaction zone 9 | 1.17 | 1.17 | 1.27 | 1.17 |
| Temperature of regenerator 22, ° C. | | 650 | 700 | 680 | 680 |
| Reduction reactor 3 | Temperature, ° C. | 500 | 480 | 450 | 500 |
| | Time, min | 20 | 3 | 1 | 30 |
| | Pressure, Mpa | 0.23 | 0.23 | 0.23 | 0.23 |
| | Atmosphere containing a reducing gas | 50% $H_2$ + 50% dry gas | 50% $H_2$ + 50% dry gas | 50% $H_2$ + 50% dry gas | 50% $H_2$ + 50% dry gas |
| | Amount of the atmosphere containing a reducing gas, $m^3$/ton/min | 7 | 8 | 8 | 7 |
| Total amount of atomizing and pre-lifting steam relative to hydrocarbon oils, wt % | | 8 | 5 | 5 | 8 |
| Whether it is introduced into heat exchanger 7 to carry out heat exchange | | Yes | Yes | Yes | Yes |
| Whether it is introduced into heat exchanger 27 to carry out heat exchange | | Yes | Yes | Yes | Yes |

TABLE 20

| | Example No. | | | |
|---|---|---|---|---|
| | 46 | 47 | 48 | 49 |
| Catalyst No. | C6 | C7 | C8 | C9 |
| Product distribution, wt % | | | | |
| Dry gas | 3.21 | 3.24 | 3.61 | 3.06 |
| LPG | 13.07 | 13.14 | 12.97 | 12.71 |
| Gasoline | 42.57 | 42.03 | 42.14 | 42.63 |
| Diesel oil | 27.07 | 26.73 | 26.78 | 26.59 |
| Heavy oil | 6.59 | 6.94 | 6.68 | 7.17 |
| Coke | 7.39 | 7.79 | 7.72 | 7.71 |
| Loss | 0.1 | 0.13 | 0.1 | 0.13 |
| Sulfur content in gasoline, mg/L | 300 | 260 | 200 | 350 |

Examples 50-53

The following examples describe the process of the present invention.

The catalytic cracking of feedstock oil 2# shown in Table 4 was carried out according to FIG. 8. The catalysts used were catalysts C10-C13 prepared in examples 10-13. Said reactor was that described in examples 24-27.

The catalyst that had contacted with the atmosphere containing a reducing gas was introduced into the pre-lifting section of the reactor from line 8, and driven by pre-lifting steam from line 10 to move upward into the first reaction zone 9. Meanwhile, the preheated hydrocarbon oil from line 11 and the atomizing steam from line 12 were mixed and introduced into the first reaction zone 9, where said hydrocarbon oil contacted with the catalyst to carry out a first cracking reaction. A chilling agent was continuously injected via line 13 into the region connecting the first reaction zone 9 with the second reaction zone 14 (at a place having a height of 1800 mm from the bottom of the riser reactor). The chilling agent was a crude gasoline at room temperature with a distillation range of 121-250° C. and was used in such an amount that the reaction temperature of reaction stream at the second reaction zone 14 was decreased to that shown in Table 11. The reaction stream continued to move upward to mix the chilling agent and enter the second reaction zone 14, where it contacted with the spent catalyst from line 28 to carry out a second reaction. A terminator was added via line 29 into the region connecting the second reaction zone with outlet zone (at the place having a height of 3400 mm from the bottom of the riser reactor). The terminator was a crude gasoline at room temperature with a distillation range of 121 to 250° C. and was used in such an amount that the temperature of the outlet zone was decreased to that shown in Table 11. After the second reaction, the stream continued to move upward to mix with the terminator and pass through outlet zone 15 into settler 17 of the separation system via horizontal pipe 16. In settler 17 the catalyst and cracked products were separated by the cyclone separator, the separated catalyst was introduced into stripper 18 to contact in counter flow with steam from line 19, and cracked products remained on the catalyst were stripped out to obtain a spent catalyst. The cracked products obtained by separation and stripped products were mixed, and then discharged from line 20, and continued to be separated into various distillates in the separation system. The spent catalyst was introduced into regenerator 22 via sloped tube 21. In regenerator 22, a part of the spent catalyst contacted with excess air from line 23 to remove coke thereon, and the flue gas formed was vented out from line 24. The regenerated catalyst was introduced via line 25 into gas displacement tank 30, where the oxygen-containing gas entrained by a mixture of the regenerated catalyst and a fresh catalyst (which was in a weight corresponding to 5 wt % of the regenerated catalyst) from storage tank 1 via line 2 was displaced with helium from line 31. The displacing gas used was vented out via line 32 and the gas-displaced catalyst was introduced into reduction reactor 3 via line 33. In reduction reactor 3, the regenerated catalyst contacted with the atmosphere containing a reducing gas from line 4 under reduction conditions. After reaction, the waste gas was vented out via line 5. The catalyst that had contacted with the atmosphere containing a reducing gas was optionally introduced into heat exchanger 7 via line 6 to carry out heat-exchange, the optionally heat-exchanged catalyst was introduced into the pre-lifting section of the reactor via line 8. The other part of the spent catalyst was introduced into regenerator 22, and then rapidly optionally introduced into heat exchanger 27 via line 26. The optionally heat-exchanged spent catalyst was introduced into the second reaction zone via line 28 to contact and react with the reaction product from the first reaction zone 9. Operation conditions are shown in Table 21 and the compositions of products are shown in Table 22

TABLE 21

| | | Example No. | | | |
|---|---|---|---|---|---|
| | | 50 | 51 | 52 | 53 |
| Catalyst No. | | C10 | C11 | C12 | C13 |
| Temperature, ° C. | First reaction zone 9 | 515 | 515 | 515 | 515 |
| | Second reaction zone 14 | 490 | 490 | 490 | 490 |
| | Outlet zone 15 | 470 | 470 | 470 | 470 |
| Pressure, Mpa | First reaction zone 9 | 0.15 | 0.15 | 0.15 | 0.15 |
| | Second reaction zone 14 | 0.13 | 0.13 | 0.13 | 0.13 |
| Contact time, sec | First reaction zone 9 | 1.0 | 1.0 | 1.0 | 1.0 |
| | Second reaction zone 14 | 6.0 | 6.0 | 6.0 | 6.0 |
| | Outlet zone 15 | 0.5 | 0.5 | 0.5 | 0.5 |
| Catalyst/oil weight ratio | First reaction zone 9 | 10 | 6.5 | 6.5 | 6.5 |
| | Times of the Catalyst/oil weight ratio of second reaction zone 14 to the Catalyst/oil weight ratio of first reaction zone 9 | 1.17 | 1.1 | 1.1 | 1.1 |
| Temperature of regenerator 22, ° C. | | 680 | 700 | 700 | 700 |
| Reduction reactor3 | Temperature, ° C. | 520 | 650 | 650 | 650 |
| | Time, min | 20 | 20 | 20 | 20 |
| | Pressure, MPa | 0.12 | 0.12 | 0.12 | 0.12 |
| | Atmosphere containing a reducing gas | 50% $H_2$ + 50% dry gas | 50% $H_2$ + 50% dry gas | 50% $H_2$ + 50% dry gas | 50% $H_2$ + 50% dry gas |
| | Amount of the atmosphere containing a reducing gas, $m^3$/ton/min | 5 | 6 | 6 | 6 |
| Amount used of helium, $m^3$/ton/min | | 8 | 3 | 3 | 3 |
| Total amount of atomizing and pre-lifting steam relative to hydrocarbon oils, wt % | | 8 | 10 | 10 | 10 |
| Whether it is introduced into heat exchanger 7 to carry out heat exchange | | No | Yes | Yes | Yes |
| Whether it is introduced into heat exchanger 27 to carry out heat exchange | | Yes | Yes | Yes | Yes |

TABLE 22

| | Example No. | | | |
|---|---|---|---|---|
| | 50 | 51 | 52 | 53 |
| Catalyst No. | C10 | C11 | C12 | C13 |
| Product distribution, wt % | | | | |
| Dry gas | 3.24 | 3.07 | 3.04 | 2.94 |
| LPG | 11.89 | 11.34 | 11.07 | 11.26 |
| Gasoline | 42.33 | 41.82 | 41.73 | 42.23 |
| Diesel oil | 25.39 | 26.07 | 26.51 | 26.57 |
| Heavy oil | 8.09 | 8.43 | 8.79 | 8.24 |
| Coke | 8.96 | 9.13 | 8.74 | 8.67 |
| Loss | 0.1 | 0.14 | 0.12 | 0.09 |
| Sulfur content in gasoline, mg/L | 90 | 120 | 110 | 80 |

Examples 54-57

The following examples describe the process of the present invention.

The catalytic cracking of a mixed oil of 20 wt % of feedstock oil 1# and 80 wt % of feedstock oil 2# as shown in Table 4 was carried out according to the scheme shown in FIG. 6. Said reactor was that described in examples 32-35. The catalysts used were Catalyst C14, C15, C16 and C17 respectively.

The catalyst that had contacted with the atmosphere containing a reducing gas was introduced into the pre-lifting section of the reactor from line 8, and driven by pre-lifting steam from line 10 to move upward into the first reaction zone 9. Meanwhile, the preheated hydrocarbon oil from line 11 and the atomizing steam from line 12 were mixed and introduced into the first reaction zone 9, where said hydrocarbon oil contacted with the catalyst to carry out a first cracking reaction. A chilling agent was continuously injected via line 13 into the region connecting the first reaction zone 9 with the second reaction zone 14 (at a place having a height of 6.2 m from the bottom of the riser reactor). The chilling agent was a crude gasoline at room temperature with a distillation range of 121-250° C. and was used in such an amount that the reaction temperature of reaction stream at the second reaction zone 14 was decreased to that shown in Table 9. The reaction stream continued to move upward to mix the chilling agent and enter the second reaction zone 14, where it contacted with the spent catalyst from line 28 to carry out a second reaction. A terminator was injected via line 29 into the region connecting the second reaction zone 14 with outlet zone 15 (at a place having a height of 12.3 m from the bottom of the riser reactor), the terminator was a crude gasoline at room temperature with a distillation range of 121-250° C., and was used in such an amount that the temperature of the reaction stream at outlet zone was decreased to that shown in Table 13. The reaction stream continued to move upward to mix with the terminator via outlet zone 15 and horizontal pipe 16 and enter settler 17 of the separation system, in settler 17 the catalyst and cracked products were separated by the cyclone separator. The separated catalyst was introduced into stripper 18 to contact in counter flow with steam from line 19, and cracked products remained on the catalyst were stripped out to obtain a spent catalyst. The cracked products obtained by separation and stripped products were mixed, and then discharged from line 20, and continued to be separated into various distillates in the separation system. The spent catalyst was introduced into regenerator 22 via sloped tube 21. In regenerator 22, a part of the spent catalyst contacted with excess air from line 23 to remove coke thereon, and the flue gas formed was vented out from line 24. The regenerated catalyst was introduced via line 25 into gas displacement tank 30, where the oxygen-containing gas entrained by the regenerated catalyst was displaced with nitrogen from line 31. The displacing gas used was vented out via line 32, and the gas-displaced catalyst was introduced into reduction reactor 3 via line 33. In reduction reactor 3, the regenerated catalyst contacted with the atmosphere containing a reducing gas from line 4 under reduction conditions. After reaction, the waste gas was vented out via line 5. The catalyst that had contacted with the atmosphere containing a reducing gas was optionally introduced into heat exchanger 7 via line 6 to carry out heat-exchange, the optionally heat-exchanged catalyst was introduced into the pre-lifting section of the reactor via line 8. The other part of the spent catalyst was introduced into regenerator 22, and then rapidly optionally introduced into heat exchanger 27 via line 26. After optionally heat-exchanged, the spent catalyst was introduced into the second reaction zone via line 28 to contact and react with the reaction product from the first reaction zone 9. Operation conditions are shown in Table 23 and the compositions of products are shown in Table 24.

Comparative Example 7

DB7

This comparative example describes a reference process for cracking olefin oils.

The same feedstock oil was catalytically cracked by the same catalyst according to the process used in example 54, except that the catalyst entering reduction reactor 3 did not contact with the atmosphere containing a reducing gas, namely that no atmosphere containing a reducing gas was introduced from line 4 into the reactor. Operation conditions are shown in Table 23 and the compositions of products are shown in Table 24.

Comparative Example 8

DB8

This comparative example describes a reference process for cracking olefin oils.

The same feedstock oil was catalytically cracked by the same catalyst according to the process used in example 57, except that the catalyst entering reduction reactor 3 did not contact with the atmosphere containing a reducing gas, namely that no atmosphere containing a reducing gas was introduced from line 4 into the reactor. Operation conditions are shown in Table 23 and the compositions of products are shown in Table 24.

TABLE 23

| | | Example No. | | | | | |
|---|---|---|---|---|---|---|---|
| | | 54 | DB7 | 55 | 56 | 57 | DB8 |
| Catalyst No. | | C14 | C14 | C15 | C16 | C17 | C17 |
| Temperature, ° C. | First reaction zone 9 | 515 | 515 | 515 | 515 | 515 | 515 |
| | Second reaction zone 14 | 495 | 495 | 495 | 495 | 495 | 495 |
| | Outlet zone 15 | 480 | 480 | 480 | 480 | 480 | 480 |
| Pressure, Mpa | First reaction zone 9 | 0.15 | 0.15 | 0.15 | 0.15 | 0.15 | 0.15 |
| | Second reaction zone 14 | 0.13 | 0.13 | 0.13 | 0.13 | 0.13 | 0.13 |
| Contact time, sec | First reaction zone 9 | 1.2 | 1.2 | 1.0 | 1.0 | 1.2 | 1.2 |
| | Second reaction zone 14 | 6.5 | 6.5 | 6.5 | 6.5 | 6.5 | 6.5 |
| | Outlet zone 15 | 0.8 | 0.8 | 0.5 | 0.5 | 0.8 | 0.8 |
| Catalyst/oil weight ratio | First reaction zone 9 | 4.5 | 4.5 | 5.5 | 5.5 | 6.0 | 6.0 |
| | Times of the Catalyst/oil weight ratio of second reaction zone 14 to the Catalyst/oil | 1.23 | 1.23 | 1.18 | 1.18 | 1.17 | 1.17 |

TABLE 23-continued

| | | Example No. | | | | | |
|---|---|---|---|---|---|---|---|
| | | 54 | DB7 | 55 | 56 | 57 | DB8 |
| | weight ratio of first reaction zone 9 | | | | | | |
| Temperature of regenerator 22, ° C. | | 650 | 650 | 680 | 680 | 690 | 690 |
| Reduction reactor 3 | Temperature, ° C. | 520 | — | 520 | 520 | 700 | — |
| | Time, min | 30 | — | 20 | 20 | 5 | — |
| | Pressure, MPa | 0.12 | — | 0.12 | 0.12 | 0.12 | — |
| | Atmosphere containing a reducing gas | 50% $H_2$ + 50% CO | — | 50% $H_2$ + 50% CO | 70% $H_2$ + 30% CO | 70% $H_2$ + 30% CO | — |
| | Amount of the atmosphere containing a reducing gas, $m^3$/ton/min | 5 | — | 6 | 6 | 6 | — |
| Amount of nitrogen, $m^3$/ton/min | | 8 | — | 3 | 3 | 3 | — |
| Total amount of atomizing and pre-lifting steam relative to hydrocarbon oils, wt % | | 8 | 8 | 8 | 8 | 10 | 10 |
| Whether it is introduced into heat exchanger 7 to carry out heat exchange | | No | Yes | No | No | Yes | Yes |
| Whether it is introduced into heat exchanger 27 to carry out heat exchange | | Yes | Yes | Yes | Yes | Yes | Yes |

TABLE 24

| | Example No. | | | | | |
|---|---|---|---|---|---|---|
| | 54 | DB7 | 55 | 56 | 57 | DB8 |
| Catalyst No. | C14 | C14 | C15 | C16 | C17 | C17 |
| Product distribution, wt % | | | | | | |
| Dry gas | 3.07 | 3.54 | 2.97 | 3.05 | 3.84 | 3.17 |
| LPG | 12.54 | 12.06 | 12.37 | 12.08 | 12.16 | 11.59 |
| Gasoline | 41.29 | 42.09 | 41.76 | 41.68 | 41.26 | 41.36 |
| Diesel oil | 27.96 | 22.41 | 27.3 | 27.98 | 27.59 | 22.83 |
| Heavy oil | 7.13 | 10.15 | 7.49 | 7.05 | 6.93 | 11.61 |
| Coke | 7.91 | 9.63 | 7.98 | 8.07 | 8.11 | 9.35 |
| Loss | 0.1 | 0.12 | 0.13 | 0.09 | 0.11 | 0.09 |
| Sulfur content in gasoline, mg/L | 130 | 350 | 120 | 130 | 150 | 380 |

It can be seen from Table 24 that compared with the reference process in which the step of reduction is not carried out, when a sulfur-containing hydrocarbon oil is catalytically cracked by the process of the present invention, the content of diesel oil in cracked products is increased prominently, the content of heavy oil and coke content is reduced prominently, the sulfur content in gasoline is decreased in a large extent. This shows further that the process of the present invention has much higher ability of cracking and desulfurizing heavy oil and it is suitable for high production of diesel oil.

Examples 58-62

The following examples describe the process of the present invention. This group of examples aims mainly at high production of gasoline.

The catalytic cracking of feedstock oil 1# shown in Table 4 was carried out in accordance with the scheme shown in FIG. 9. The catalysts used were catalysts C1-C5 prepared in examples 1-5 respectively. Said reactor was that described in examples 14-18.

The catalyst that had contacted with the atmosphere containing a reducing gas was introduced into the pre-lifting section of the reactor from line 8, and driven by pre-lifting steam from line 10 to move upward into the first reaction zone 9. Meanwhile, the preheated hydrocarbon oil from line 11 was mixed with the atomizing steam from line 12 and introduced into the first reaction zone 9, where said hydrocarbon oil contacted with the catalyst to carry out a first cracking reaction. The reaction stream continued to move upward to the second reaction zone 14, where it contacted with the regenerated catalyst from line 28 to carry out a second reaction. After the second reaction, the stream continued to move upward through outlet zone 15 into settler 17 of separation system via a horizontal pipe 16, in settler 17 the catalyst and cracked products were separated by the cyclone separator. The separated catalyst was introduced into stripper 18 to contact in counter flow with steam from line 19, and cracked products remained on the catalyst were stripped out to obtain a spent catalyst. The cracked products obtained by separation and stripped products were mixed, and then discharged from line 20, and continued to be separated into various distillates in the separation system. The spent catalyst was introduced into regenerator 22 via sloped tube 21. In regenerator 22, the spent catalyst contacted with excess air atmosphere from line 23 at a regeneration temperature to remove coke thereon, and the flue gas formed was vented out from line 24. A part of the regenerated catalyst was introduced into reduction reactor 3 via line 25, in reduction reactor 3 the regenerated catalyst contacted with the atmosphere containing a reducing gas from line 4 under reduction conditions. After reaction, the waste gas was vented out via line 5. The catalyst that had contacted with the atmosphere containing a reducing gas was optionally introduced into heat exchanger 7 via line 6 to carry out heat-exchange, the optionally heat-exchanged catalyst was introduced into the pre-lifting section of the reactor. The other part of the regenerated catalyst was optionally introduced into heat exchanger 27 via line 26 to carry out heat-exchange. After optionally heat-exchanged, the regenerated catalyst was introduced into the second reaction zone via line 28. Operation conditions are shown in Table 25 and the compositions of products are shown in Table 26.

Comparative Example 9

DB9

This comparative example describes a reference process for cracking olefin oils.

The same feedstock oil was catalytically cracked by the same catalyst according to the process used in example 58, except that the catalyst entering reduction reactor 3 did not contact with the atmosphere containing a reducing gas, namely that no atmosphere containing a reducing gas was introduced from line 4 into the reactor. Operation conditions are shown in Table 25 and the compositions of products are shown in Table 26.

TABLE 25

| | | Example No. | | | | | |
|---|---|---|---|---|---|---|---|
| | | 58 | 59 | 60 | 61 | 62 | DB9 |
| Catalyst No. | | C1 | C2 | C3 | C4 | C5 | C5 |
| Temperature, ° C. | First reaction zone 9 | 520 | 520 | 610 | 525 | 525 | 525 |
| | Second reaction zone 14 | 500 | 500 | 570 | 505 | 500 | 500 |
| | Outlet zone 15 | 480 | 480 | 550 | 485 | 480 | 480 |
| Pressure, Mpa | First reaction zone 9 | 0.15 | 0.18 | 0.15 | 0.18 | 0.18 | 0.18 |
| | Second reaction zone 14 | 0.13 | 0.15 | 0.13 | 0.15 | 0.15 | 0.15 |
| Contact time, sec | First reaction zone 9 | 2.0 | 1.2 | 0.8 | 1.2 | 1.0 | 1.0 |
| | Second reaction zone 14 | 6.5 | 6.7 | 6 | 6.7 | 6.5 | 6.5 |
| | Outlet zone 15 | 0.3 | 0.3 | 0.3 | 0.5 | 0.5 | 0.5 |
| Catalyst/oil weight ratio | First reaction zone 9 | 4.5 | 5.0 | 4.0 | 6.0 | 6.0 | 6.0 |
| | Times of the Catalyst/oil weight ratio of second reaction zone 14 to the Catalyst/oil weight ratio of first reaction zone 9 | 1.33 | 1.4 | 1.2 | 1.1 | 1.2 | 1.2 |
| Temperature of regenerator 22, ° C. | | 690 | 690 | 690 | 690 | 700 | 700 |
| Reduction reactor 3 | Temperature, ° C. | 600 | 600 | 600 | 680 | 650 | — |
| | Time, min | 30 | 20 | 10 | 20 | 20 | — |
| | Pressure, MPa | 0.13 | 0.13 | 0.13 | 0.13 | 0.13 | — |
| | Atmosphere containing a reducing gas | $H_2$ | $H_2$ | $H_2$ | $H_2$ | $H_2$ | — |
| | Amount of the atmosphere containing a reducing gas, $m^3$/ton/min | 7 | 7 | 7 | 7 | 7 | — |
| Total amount of atomizing and pre-lifting steam relative to hydrocarbon oils, wt % | | 8 | 8 | 10 | 10 | 5 | 5 |
| Whether it is introduced into heat exchanger 7 to carry out heat exchange | | Yes | Yes | No | Yes | Yes | Yes |
| Whether it is introduced into heat exchanger 27 to carry out heat exchange | | Yes | Yes | Yes | Yes | Yes | Yes |

TABLE 26

| | Example No. | | | | | |
|---|---|---|---|---|---|---|
| | 58 | 59 | 60 | 61 | 62 | DB9 |
| Catalyst No. | C1 | C2 | C3 | C4 | C5 | C5 |
| Product distribution, wt % | | | | | | |
| Dry gas | 3.93 | 3.86 | 4.56 | 4.02 | 3.91 | 4.36 |
| LPG | 13.49 | 13.62 | 13.97 | 13.41 | 13.24 | 13.14 |
| Gasoline | 49.38 | 49.47 | 49.82 | 48.98 | 48.37 | 45.84 |
| Diesel oil | 24.57 | 24.42 | 23.06 | 24.56 | 24.83 | 24.49 |

TABLE 26-continued

| | Example No. | | | | | |
|---|---|---|---|---|---|---|
| | 58 | 59 | 60 | 61 | 62 | DB9 |
| Heavy oil | 4.21 | 4.48 | 3.55 | 4.47 | 4.94 | 6.48 |
| Coke | 4.36 | 4.05 | 4.99 | 4.48 | 4.66 | 5.62 |
| Loss | 0.06 | 0.1 | 0.05 | 0.08 | 0.05 | 0.07 |
| Sulfur content in gasoline, mg/L | 330 | 310 | 320 | 500 | 510 | 1100 |

It can be seen from Table 26 that compared with the reference process, when a sulfur-containing hydrocarbon oil is catalytically cracked by the process of the present invention, the content of gasoline in cracked products is increased prominently, the content of heavy oil and coke is reduced prominently and the sulfur content in gasoline is decreased in a large extent. This shows that the process of the present invention has much higher ability of cracking and desulfurizing heavy oil, so it is suitable for high production of gasoline.

Examples 63-67

The following examples describe the process of the present invention. This group of examples aims mainly at high production of LPG and gasoline.

The catalytic cracking of feedstock oil 3# shown in Table 4 was carried out according to FIG. 10. The catalysts used were catalysts C1-C5 prepared in examples 1-5 respectively. Said reactor was that described in examples 14-18.

The catalyst that had contacted with the atmosphere containing a reducing gas was introduced into the pre-lifting section of the reactor from line 8, and driven by pre-lifting steam from line 10 to move upward into the first reaction zone 9. Meanwhile, the preheated hydrocarbon oil from line 11 was mixed with the atomizing steam from line 12 and introduced into the first reaction zone 9, where said hydrocarbon oil contacted with the catalyst to carry out a first cracking reaction. The reaction stream continued to move upward to the second reaction zone 14, where it contacted with the regenerated catalyst from line 28 to carry out a second reaction. After the second reaction, the stream continued to move upward through outlet zone 15 into settler 17 of separation system via a horizontal pipe 16, in settler 17 the catalyst and cracked products were separated by the cyclone separator. The separated catalyst was introduced into stripper 18 to contact in counter flow with steam from line 19, and cracked products remained on the catalyst were stripped out to obtain a spent catalyst. The cracked products obtained by separation and stripped products were mixed and discharged via line 20, and continued to be separated into various distillates in the separation system. The spent catalyst was introduced into regenerator 22 via sloped tube 21. In regenerator 22, the spent catalyst contacted with excess air atmosphere from line 23 at a regeneration temperature to remove coke thereon, and the flue gas formed was vented out from line 24. A part of the regenerated catalyst was introduced via line 25 into gas displacement tank 30, where the oxygen-containing gas entrained by the part of the regenerated catalyst was displaced with nitrogen from line 31. The displacing gas used was vented out via line 32, and the gas-displaced catalyst was introduced into reduction reactor 3 via line 33. In reduction reactor 3, said catalyst contacted with the atmosphere containing a reducing gas from line 4 under reduction conditions. After reaction, the waste gas was vented out via line 5. The catalyst that had contacted with the atmosphere containing a reducing gas was optionally introduced into heat exchanger 7 via line 6 to carry out heat-exchange, the optionally heat-exchanged catalyst was introduced into the pre-lifting section of the reactor. The other part of the regenerated catalyst was optionally introduced into heat exchanger 27 via line 26 to carry out heat-exchange. After optionally heat-exchanged, the regenerated catalyst was introduced into the second reaction zone via line 28. Operation conditions are shown in Table 27 and the compositions of products are shown in Table 28.

Comparative Example 10

DB10

This comparative example describes a reference process for cracking olefin oils.

The same feedstock oil was catalytically cracked by the same catalyst according to the process used in example 65, except that the catalyst entering reduction reactor 3 did not contact with the atmosphere containing a reducing gas, namely that no atmosphere containing a reducing gas was introduced from line 4 into the reactor. Operation conditions are shown in Table 27 and the compositions of products are shown in Table 28.

TABLE 27

| | | Example No. | | | | | |
|---|---|---|---|---|---|---|---|
| | | 63 | 64 | 65 | DB10 | 66 | 67 |
| Catalyst No. | | C1 | C2 | C3 | C3 | C4 | C5 |
| Temperature, ° C. | First reaction zone 9 | 570 | 515 | 515 | 515 | 525 | 525 |
| | Second reaction zone 14 | 555 | 490 | 500 | 500 | 495 | 495 |
| | Outlet zone 15 | 530 | 480 | 480 | 480 | 485 | 485 |
| Pressure, Mpa | First reaction zone 9 | 0.18 | 0.18 | 0.20 | 0.20 | 0.25 | 0.25 |
| | Second reaction zone 14 | 0.15 | 0.17 | 0.17 | 0.17 | 0.23 | 0.23 |
| Contact time, sec | First reaction zone 9 | 1.5 | 1.5 | 1.5 | 1.5 | 1.0 | 1.0 |
| | Second reaction zone 14 | 5.3 | 6.6 | 6.6 | 6.6 | 6.2 | 6.2 |
| | Outlet zone 15 | 0.5 | 0.5 | 0.3 | 0.3 | 0.3 | 0.3 |
| Catalyst/oil weight ratio | First reaction zone 9 | 5.0 | 4.5 | 5.0 | 5.0 | 5.5 | 5.5 |
| | Times of the Catalyst/oil weight ratio of second reaction zone 14 to the Catalyst/oil weight ratio of first reaction zone 9 | 1.3 | 1.3 | 1.2 | 1.2 | 1.17 | 1.18 |
| Temperature of regenerator 22, ° C. | | 680 | 680 | 680 | 680 | 700 | 700 |
| Reduction reactor 3 | Temperature, ° C. | 680 | 620 | 650 | — | 600 | 600 |
| | Time, min | 10 | 20 | 20 | — | 30 | 30 |
| | Pressure, MPa | 0.13 | 0.17 | 0.16 | — | 0.23 | 0.25 |
| | Atmosphere containing a reducing gas | 50% $H_2$ + 50% CO | 50% $H_2$ + 50% CO | 50% $H_2$ + 50% CO | — | 50% $H_2$ + 50% CO | 50% $H_2$ + 50% CO |
| | Amount of the atmosphere containing a reducing gas, $m^3$/ton/min | 5.5 | 4.0 | 5 | — | 5.5 | 5.5 |

TABLE 27-continued

| | Example No. | | | | | |
|---|---|---|---|---|---|---|
| | 63 | 64 | 65 | DB10 | 66 | 67 |
| Amount of nitrogen, $m^3$/ton/min | 4 | 12 | 8 | — | 6 | 6 |
| Total amount of atomizing and pre-lifting steam relative to hydrocarbon oils, wt % | 5 | 5 | 8 | 8 | 10 | 10 |
| Whether it is introduced into heat exchanger 7 to carry out heat exchange | Yes | Yes | Yes | Yes | Yes | Yes |
| Whether it is introduced into heat exchanger 27 to carry out heat exchange | Yes | Yes | Yes | Yes | Yes | Yes |

TABLE 28

| | Example No. | | | | | |
|---|---|---|---|---|---|---|
| | 63 | 64 | 65 | DB10 | 66 | 67 |
| Catalyst No. | C1 | C2 | C3 | C3 | C4 | C5 |
| Product distribution, wt % | | | | | | |
| Dry gas | 4.92 | 4.57 | 4.23 | 3.72 | 4.16 | 3.94 |
| LPG | 13.93 | 13.82 | 13.69 | 12.94 | 13.79 | 12.47 |
| Gasoline | 49.96 | 49.75 | 49.52 | 46.27 | 49.71 | 49.37 |
| Diesel oil | 23.01 | 24.12 | 24.46 | 24.02 | 24.59 | 24.78 |
| Heavy oil | 3.75 | 4.15 | 4.52 | 7.36 | 4.05 | 5.31 |
| Coke | 4.35 | 3.49 | 3.5 | 5.6 | 3.64 | 4.06 |
| Loss | 0.08 | 0.1 | 0.08 | 0.09 | 0.06 | 0.07 |

It can be seen from Table 28 that compared with the reference process, when a sulfur-free hydrocarbon oil is catalytically cracked by the process of the present invention, the content of LPG and gasoline is increased prominently, the content of heavy oil and coke is decreased prominently. This shows that the process of the present invention is also suitable for use in the catalytic cracking of sulfur-free hydrocarbon oil, and the process of the present invention has much higher ability of cracking heavy oil, so it is suitable for high production of LPG and gasoline.

Examples 68-71

The following examples describe the process of the present invention. This group of examples aims mainly at high production of diesel oil.

The catalytic cracking of a mixed oil of 50 wt % of feedstock oil 2# and 50 wt % of feedstock oil 1# as shown in Table 4 was carried out according to the scheme shown in FIG. 11. The catalysts used were catalysts C6-C9 prepared in example 6-9 respectively. Said heat exchanger 7 was a hot air heater. Said reactor was that described in examples 24-27.

The catalyst that had contacted with the atmosphere containing a reducing gas was introduced into the pre-lifting section of the reactor from line 8, and driven by pre-lifting steam from line 10 to move upward into the first reaction zone 9. Meanwhile, the preheated hydrocarbon oil from line 11 was mixed with the atomizing steam from line 12 and introduced into the first reaction zone 9, where said hydrocarbon oil contacted with the catalyst to carry out a first cracking reaction. A chilling agent was injected into the region connecting the first reaction zone 9 with the second reaction zone 14 from line 13 (at a place having a height of 1800 mm from the bottom of the riser reactor). The chilling agent was a crude gasoline at room temperature with a distillation range of 121-250° C. and was used in such an amount that the reaction temperature of reaction stream at the second reaction zone 14 was decreased to that shown in Table 9. The reaction stream continued to move upward to mix the chilling agent and enter the second reaction zone 14, where it contacted with the regenerated catalyst from line 28 to carry out a second reaction. After the second reaction, the stream continued to move upward through outlet zone 15 into settler 17 of separation system via a horizontal pipe 16, in settler 17 the catalyst and cracked products were separated by the cyclone separator. The separated catalyst was introduced into stripper 18 to contact in counter flow with steam from line 19, and cracked products remained on the catalyst were stripped out to obtain a spent catalyst. The cracked products obtained by separation and stripped products were mixed, and then discharged from line 20, and continued to be separated into various distillates in the separation system. The spent catalyst was introduced into regenerator 22 via sloped tube 21. In regenerator 22, the spent catalyst contacted with excess air atmosphere from line 23 at a regeneration temperature to remove coke thereon, and the flue gas formed was vented out from line 24. A part of the regenerated catalyst was introduced into reduction reactor 3 via line 25, in reduction reactor 3 the part of the regenerated catalyst contacted with the atmosphere containing a reducing gas from line 4 under reduction conditions. After reaction, the waste gas was vented out via line 5. The catalyst that had contacted with the atmosphere containing a reducing gas was optionally introduced into heat exchanger 7 via line 6 to carry out heat-exchange, the optionally heat-exchanged catalyst was introduced into the pre-lifting section of the reactor. The other part of the regenerated catalyst was optionally introduced into heat exchanger 27 to carry out heat-exchange via line 26. After optionally heat-exchanged, the regenerated catalyst was introduced into the second reaction zone via line 28. Operation conditions are shown in Table 29 and the compositions of products are shown in Table 30.

TABLE 29

| | Example No. | | | |
|---|---|---|---|---|
| | 68 | 69 | 70 | 71 |
| Catalyst No. | C6 | C7 | C8 | C9 |
| Temperature, First reaction zone 9 | 520 | 525 | 525 | 525 |

TABLE 29-continued

| | | Example No. | | | |
|---|---|---|---|---|---|
| | | 68 | 69 | 70 | 71 |
| ° C. | Second reaction zone 14 | 490 | 495 | 495 | 495 |
| | Outlet zone 15 | 475 | 470 | 470 | 470 |
| Pressure, Mpa | First reaction zone 9 | 0.25 | 0.25 | 0.25 | 0.25 |
| | Second reaction zone 14 | 0.20 | 0.20 | 0.20 | 0.20 |
| Contact time, sec | First reaction zone 9 | 3.0 | 1.0 | 0.8 | 1.2 |
| | Second reaction zone 14 | 6.6 | 6.0 | 6.0 | 6.3 |
| | Outlet zone 15 | 0.5 | 0.3 | 0.3 | 0.3 |
| Catalyst/oil weight ratio | First reaction zone 9 | 5.5 | 5.5 | 5.0 | 6.0 |
| | Times of the Catalyst/oil weight ratio of second reaction zone 14 to the Catalyst/oil weight ratio of first reaction zone 9 | 1.2 | 1.18 | 1.18 | 1.17 |
| Temperature of regenerator 22, ° C. | | 650 | 700 | 680 | 680 |
| Reduction Operation | Temperature, ° C. | 500 | 480 | 450 | 500 |
| | Time, min | 20 | 3 | 1 | 30 |
| | Pressure, MPa | 0.23 | 0.23 | 0.23 | 0.23 |
| Operation conditions | Atmosphere containing a reducing gas | 50% $H_2$ + 50% dry gas | 50% $H_2$ + 50% dry gas | 50% $H_2$ + 50% dry gas | 50% $H_2$ + 50% dry gas |
| | Amount of the atmosphere containing a reducing gas, $m^3$/ton/min | 7 | 8 | 8 | 7 |
| Total amount of atomizing and pre-lifting steam relative to hydrocarbon oils, wt % | | 8 | 5 | 5 | 8 |
| Whether it is introduced into heat exchanger 7 to carry out heat exchange | | Yes | Yes | Yes | Yes |
| Whether it is introduced into heat exchanger 27 to carry out heat exchange | | Yes | Yes | Yes | Yes |

TABLE 30

| | Example No. | | | |
|---|---|---|---|---|
| | 68 | 69 | 70 | 71 |
| Catalyst No. | C6 | C7 | C8 | C9 |
| Product distribution, wt % | | | | |
| Dry gas | 3.57 | 3.36 | 3.96 | 3.43 |
| LPG | 13.38 | 13.57 | 13.35 | 13.21 |
| Gasoline | 42.72 | 42.46 | 42.63 | 42.98 |
| Diesel oil | 26.82 | 26.14 | 26.27 | 26.42 |
| Heavy oil | 6.19 | 6.58 | 6.19 | 6.82 |
| Coke | 7.27 | 7.8 | 7.49 | 7.04 |
| Loss | 0.05 | 0.09 | 0.11 | 0.1 |
| Sulfur content in gasoline, mg/L | 260 | 220 | 180 | 330 |

Examples 72-75

The following examples describe the process of the present invention.

The catalytic cracking of feedstock oil 2# shown in Table 4 was carried out according to FIG. 12. The catalysts used were catalysts C10-C13 prepared in examples 10-13 respectively. Said reactor was that described in examples 24-27.

The catalyst that had contacted with the atmosphere containing a reducing gas was introduced into the pre-lifting section of the reactor from line 8, and driven by pre-lifting steam from line 10 to move upward into the first reaction zone 9. Meanwhile, the preheated hydrocarbon oil from line 11 was mixed with the atomizing steam from line 12 and introduced into the first reaction zone 9, where said hydrocarbon oil contacted with the catalyst to carry out a first cracking reaction. A chilling agent was injected into the region connecting the first reaction zone 9 with the second reaction zone 14 from line 13 (at a place having a height of 1800 mm from the bottom of the riser reactor). The chilling agent was a crude gasoline at room temperature with a distillation range of 121-250° C. and was used in such an amount that the reaction temperature of reaction stream at the second reaction zone 14 was decreased to that shown in Table 11. The reaction stream continued to move upward to mix with chilling agent and enter the second reaction zone 14, where it contacted with the regenerated catalyst from line 28 to carry out a second reaction. A terminator was added via line 29 into the region connecting the second reaction zone with outlet zone (at a place having a height of 3400 mm from the bottom of the riser reactor). The terminator was a crude gasoline at room temperature with a distillation range of 121 to 250° C. and was used in such an amount that the temperature of the outlet zone was decreased to that shown in Table 11. After the second reaction, the stream continued to move upward to mix with the terminator and pass through outlet zone 15 into settler 17 of the separation system via horizontal pipe 16. In settler 17 the catalyst and cracked products were separated by the cyclone separator. The separated catalyst was introduced into stripper 18 to contact in counter flow with steam from line 19, and cracked products remained on the catalyst were stripped out to obtain a spent catalyst. The cracked products obtained by separation and stripped products were mixed, and then discharged from line 20, and continued to be separated into various distillates in the separation system. The spent catalyst was introduced into regenerator 22 via sloped tube 21. In regenerator 22, the spent catalyst contacted with excess air from line 23 at a regeneration temperature to remove coke thereon, and the flue gas formed was vented out from line 24. A part of the regenerated catalyst was introduced via line 25 into gas displacement tank 30, where the oxygen-containing gas entrained by a mixture of the regenerated catalyst and a fresh catalyst (which was in a weight corresponding to 5 wt % of the regenerated catalyst) from tank 1 via line 2 was displaced with helium from line 31. The displacing gas used was vented out via line 32 and the gas-displaced catalyst was introduced into reduction reactor 3 via line 33. In reduction reactor 3, said catalyst contacted with the atmosphere containing a reducing gas from line 4 under reduction conditions. After reaction, the waste gas was vented out via line 5. The catalyst that had contacted with the atmosphere containing a reducing gas was optionally introduced into heat exchanger 7 via line 6 to carry out heat-exchange, the optionally heat-exchanged catalyst was introduced into the pre-lifting section of the reactor. The other part of the regenerated catalyst was optionally introduced into heat exchanger 27 to carry out heat-exchange via line 26. After optionally heat-exchanged the regenerated catalyst was introduced into the second reaction zone via line 28. Operation conditions are shown in Table 31 and the compositions of products are shown in Table 32.

TABLE 31

| | | Example No. | | | |
|---|---|---|---|---|---|
| | | 72 | 73 | 74 | 75 |
| Catalyst No. | | C10 | C11 | C12 | C13 |
| Temperature, ° C. | First reaction zone 9 | 525 | 525 | 525 | 525 |
| | Second reaction zone 14 | 490 | 490 | 490 | 490 |
| | Outlet zone 15 | 470 | 470 | 470 | 470 |
| Pressure, Mpa | First reaction zone 9 | 0.15 | 0.15 | 0.15 | 0.15 |
| | Second reaction zone 14 | 0.13 | 0.13 | 0.13 | 0.13 |
| Contact time, sec | First reaction zone 9 | 0.7 | 0.7 | 0.7 | 0.7 |
| | Second reaction zone 14 | 6.1 | 6.1 | 6.1 | 6.1 |
| | Outlet zone 15 | 0.3 | 0.3 | 0.3 | 0.3 |
| | First reaction zone 9 | 9.5 | 6 | 5.5 | 6 |
| Catalyst/oil weight ratio | First reaction zone 9 | 9.5 | 6 | 5.5 | 6 |
| | Times of the Catalyst/oil weight ratio of second reaction zone 14 to the Catalyst/oil weight ratio of first reaction zone 9 | 1.18 | 1.17 | 1.18 | 1.17 |
| Temperature of regenerator 22, ° C. | | 680 | 700 | 700 | 700 |
| Reduction reactor 3 | Temperature, ° C. | 520 | 650 | 650 | 650 |
| | Time, min | 20 | 20 | 20 | 20 |
| | Pressure, MPa | 0.12 | 0.12 | 0.12 | 0.12 |
| | Atmosphere containing a reducing gas | 50% $H_2$ + 50% dry gas | 50% $H_2$ + 50% dry gas | 50% $H_2$ + 50% dry gas | 50% $H_2$ + 50% dry gas |
| | Amount of the atmosphere containing a reducing gas, $m^3$/ton/min | 5 | 6 | 6 | 6 |
| Amount used of helium gas, $m^3$/ton/min | | 8 | 3 | 3 | 3 |
| Total amount of atomizing and pre-lifting steam relative to hydrocarbon oils, wt % | | 8 | 10 | 10 | 10 |
| Whether it is introduced into heat exchanger 7 to carry out heat exchange | | No | Yes | Yes | Yes |
| Whether it is introduced into heat exchanger 27 to carry out heat exchange | | Yes | Yes | Yes | Yes |

TABLE 32

| | Example No. | | | |
|---|---|---|---|---|
| | 72 | 73 | 74 | 75 |
| Catalyst No. | C10 | C11 | C12 | C13 |
| Product distribution, wt % | | | | |
| Dry gas | 3.12 | 3.15 | 3.34 | 3.32 |
| LPG | 12.04 | 11.49 | 11.39 | 11.73 |
| Gasoline | 42.15 | 42.17 | 42.08 | 42.63 |
| Diesel oil | 25.58 | 25.47 | 26.27 | 25.94 |
| Heavy oil | 8.09 | 8.42 | 8.23 | 8.23 |
| Coke | 8.95 | 9.19 | 8.62 | 8.05 |
| Loss | 0.07 | 0.11 | 0.07 | 0.1 |
| Sulfur content in gasoline, mg/L | 70 | 100 | 80 | 60 |

Examples 76-79

The following examples describe the process of the present invention. This group of examples aims mainly at high production of diesel oil.

The catalytic cracking of a mixed oil of 20 wt % of feedstock oil 1# and 80 wt % of feedstock oil 2# as shown in Table 4 was carried out according to the scheme shown in FIG. 10.

Said reactor was that described in examples 32-35. The catalysts used were C14, C15, C16 and C17 respectively.

The catalyst that had contacted with the atmosphere containing a reducing gas was introduced into the pre-lifting section of the reactor from line 8, and driven by pre-lifting steam from line 10 to move upward into the first reaction zone 9. Meanwhile, the preheated hydrocarbon oil from line 11 was mixed with the atomizing steam from line 12 and introduced into the first reaction zone 9, where said hydrocarbon oil contacted with the catalyst to carry out a first cracking reaction. A chilling agent was injected into the region connecting the first reaction zone 9 with the second reaction zone 14 from line 13 (at a place having a height of 6.2 m from the bottom of the riser reactor). The chilling agent was a crude gasoline at room temperature with a distillation range of 121-250° C. and was used in such an amount that the reaction temperature of reaction stream at the second reaction zone 14 was decreased to that shown in Table 13. The reaction stream continued to move upward to the second reaction zone 14, where it contacted with the regenerated catalyst from line 28 to carry out a second reaction. A terminator was injected into the region connecting the second reaction zone 14 and outlet zone 15 (at a place having a height of 12.3 m from the bottom of the riser reactor) from line 29. The terminator was a crude gasoline at room temperature with a distillation range of 121-250° C. and was used in such an amount that the reaction temperature of the reaction stream at outlet zone 15 was decreased to that shown in Table 13. After the second reaction, the stream continued to move upward to mix with the terminator and pass through outlet zone 15 into settler 17 of separation system via a horizontal pipe 16, in settler 17 the catalyst and cracked products were separated by the cyclone separator. The separated catalyst was introduced into stripper 18 to contact in counter flow with the steam from line 19, and cracked products remained on the catalyst were stripped out to obtain a spent catalyst. The cracked products obtained by separation and stripped products were mixed, and then discharged via line 20, and continued to be separated into various distillates in the separation system. The spent catalyst was introduced into regenerator 22 via sloped tube 21. In regenerator 22, the spent catalyst contacted with excess air from line 23 at a regeneration temperature to remove coke thereon, and the flue gas formed was vented out from line 24. A part of the regenerated catalyst was introduced via line 25 into gas displacement tank 30, where the oxygen-containing gas entrained by the part of the regenerated catalyst was displaced with nitrogen from line 31. The displacing gas used was vented out via line 32; the gas-displaced catalyst was introduced into reduction reactor 3 via line 33. In reduction reactor 3, said catalyst contacted with the atmosphere containing a reducing gas from line 4 under reduction conditions. After reaction, the waste gas was vented out via line 5. The catalyst that had contacted with the atmosphere containing a reducing gas was optionally introduced into heat exchanger 7 via line 6 to carry out heat-exchange, the optionally heat-exchanged catalyst was introduced into the pre-lifting section of the reactor. The other part of the regenerated catalyst was optionally introduced into heat exchanger 27 to carry out heat-exchange via line 26, the optionally heat-exchanged regenerated catalyst was introduced into the second reaction zone via line 28. Operation conditions are shown in Table 33 and the compositions of products are shown in Table 34.

Comparative Example 11

DB11

This comparative example describes a reference process for cracking olefin oils.

The same feedstock oil was catalytically cracked by the same catalyst according to the process used in example 76, except that the catalyst entering reduction reactor 3 did not contact with the atmosphere containing a reducing gas, namely that no atmosphere containing a reducing gas was introduced from line 4 into the reactor. Operation conditions are shown in Table 33 and the compositions of products are shown in Table 34.

Comparative Example 12

DB12

This comparative example describes a reference process for cracking olefin oils.

The same feedstock oil was catalytically cracked by the same catalyst according to the process used in example 79, except that the catalyst entering reduction reactor 3 did not contact with the atmosphere containing a reducing gas, namely that no atmosphere containing a reducing gas was introduced from line 4 into the reactor. Operation conditions are shown in Table 33 and the compositions of products are shown in Table 34.

TABLE 33

| | | Example No. | | | | | |
|---|---|---|---|---|---|---|---|
| | | 76 | DB11 | 77 | 78 | 79 | DB12 |
| Catalyst No. | | C14 | C14 | C15 | C16 | C17 | C17 |
| Temperature, ° C. | First reaction zone 9 | 520 | 520 | 520 | 520 | 520 | 520 |
| | Second reaction zone 14 | 495 | 495 | 495 | 495 | 495 | 495 |
| | Outlet zone 15 | 475 | 475 | 475 | 475 | 475 | 475 |
| Pressure, Mpa | First reaction zone 9 | 0.15 | 0.15 | 0.15 | 0.15 | 0.15 | 0.15 |
| | Second reaction zone 14 | 0.13 | 0.13 | 0.13 | 0.13 | 0.13 | 0.13 |
| Contact time, sec | First reaction zone 9 | 1.0 | 1.0 | 0.8 | 0.8 | 1.0 | 1.0 |
| | Second reaction zone 14 | 6.5 | 6.5 | 6.2 | 6.2 | 6.5 | 6.5 |
| | Outlet zone 15 | 0.5 | 0.5 | 0.5 | 0.5 | 0.5 | 0.5 |
| Catalyst/oil weight ratio | First reaction zone 9 | 4.0 | 4.0 | 5.0 | 5.0 | 6.0 | 6.0 |
| | Times of the Catalyst/oil weight ratio of second reaction zone 14 to the Catalyst/oil weight | 1.18 | 1.18 | 1.2 | 1.2 | 1.17 | 1.17 |

TABLE 33-continued

| | | Example No. | | | | | |
|---|---|---|---|---|---|---|---|
| | | 76 | DB11 | 77 | 78 | 79 | DB12 |
| | ratio of first reaction zone 9 | | | | | | |
| Temperature of regenerator 22, ° C. | | 650 | 650 | 680 | 680 | 690 | 690 |
| Reduction reactor 3 | Temperature, ° C. | 520 | — | 520 | 520 | 700 | — |
| | Time, min | 30 | — | 20 | 20 | 5 | — |
| | Pressure, MPa | 0.12 | — | 0.12 | 0.12 | 0.12 | — |
| | Atmosphere containing a reducing gas | 50% H2 + 50% CO | — | 50% H2 + 50% CO | 70% H2 + 30% CO | 70% H2 + 30% CO | — |
| | Amount of the atmosphere containing a reducing gas, $m^3$/ton/min | 5 | — | 6 | 6 | 6 | — |
| Amount of nitrogen, $m^3$/ton/min | | 8 | — | 3 | 3 | 3 | — |
| Total amount of atomizing and pre-lifting steam relative to hydrocarbon oils, wt % | | 8 | 8 | 8 | 8 | 10 | 10 |
| Whether it is introduced into heat exchanger 7 to carry out heat exchange | | No | Yes | No | No | Yes | Yes |
| Whether it is introduced into heat exchanger 27 to carry out heat exchange | | Yes | Yes | Yes | Yes | Yes | Yes |

TABLE 34

| | Example No. | | | | | |
|---|---|---|---|---|---|---|
| | 76 | DB11 | 77 | 78 | 79 | DB12 |
| Catalyst No. | C14 | C14 | C15 | C16 | C17 | C17 |
| Product distribution, wt % | | | | | | |
| Dry gas | 3.38 | 3.86 | 3.32 | 3.34 | 3.93 | 3.46 |
| LPG | 12.84 | 12.72 | 12.54 | 12.58 | 12.27 | 11.85 |
| Gasoline | 41.78 | 42.38 | 42.17 | 41.42 | 41.32 | 41.47 |
| Diesel oil | 27.51 | 22.57 | 27.31 | 27.93 | 27.89 | 22.86 |
| Heavy oil | 6.91 | 9.88 | 6.92 | 7.03 | 6.76 | 11.29 |
| Coke | 7.53 | 8.53 | 7.65 | 7.6 | 7.77 | 9.02 |
| Loss | 0.05 | 0.06 | 0.09 | 0.1 | 0.06 | 0.05 |
| Sulfur content in gasoline, mg/L | 110 | 330 | 100 | 90 | 120 | 360 |

It can be seen from Table 34 that compared with the reference process for which the reduction process was not carried out, when a sulfur-containing hydrocarbon oil is catalytically cracked by the process of the present invention, the content of diesel oil is increased prominently, the content of heavy oil and coke is reduced prominently, the sulfur content in gasoline is decreased in a large extent. This shows further that the process of the present invention has much higher ability of cracking and desulfurizing heavy oil, so it is suitable for high production of diesel oil.

Examples 80-84

The following examples describe the process of the present invention. This group of examples aims mainly at high production of gasoline.

The catalytic cracking of feedstock oil 1# shown in Table 4 was carried out in accordance with the scheme shown in FIG. 13. The catalysts used were catalysts C1-C5 prepared in examples 1-5 respectively. Said reactor was that described in examples 14-18.

A part of the regenerated catalyst from regenerator 22 was optionally introduced into heat exchanger 7 via line 6, the optionally heat-exchanged catalyst was introduced into the pre-lifting section of the reactor via line 8, and then driven by pre-lifting steam from line 10 to move upward into the first reaction zone 9. Meanwhile, the preheated hydrocarbon oil from line 11 was mixed with the atomizing steam from line 12 and introduced into the first reaction zone 9, where said hydrocarbon oil contacted with the catalyst to carry out a first cracking reaction. Then the reaction stream continued to move upward to the second reaction zone 14, meanwhile, the other part of the regenerated catalyst from regenerator 22 was introduced into reduction reactor 3 via line 25, in reduction reactor 3 the regenerated catalyst contacted with the atmosphere containing a reducing gas from line 4 under reduction conditions. After reaction, the waste gas was vented out via line 5. The catalyst that had contacted with atmosphere containing a reducing gas was optionally introduced into heat exchanger 27 via line 26, the optionally heat-exchanged catalyst was introduced into the second reaction zone 14 via line 28. In the second reaction zone 14, the reaction stream from the first reaction zone 9 contacted with the catalyst from line 28 to carry out a second reaction. After the second reaction, the stream continued to move upward through outlet zone 15 into settler 17 of the separation system via a horizontal pipe 16, in settler 17 the catalyst and cracked products were separated by the cyclone separator. The separated catalyst was introduced into stripper 18 of the separation system to contact in counter flow with the steam from line 19, and cracked products remained on the catalyst were stripped out to obtain a spent catalyst. The cracked products obtained by separation and stripped products were mixed, and then discharged from line 20, and continued to be separated into various distillates in the separation system. The spent catalyst was introduced into regenerator 22 via sloped tube 21. In regenerator 22, the spent catalyst contacted with excess air from line 23 at a regeneration temperature to remove coke thereon, and the flue gas formed was vented out from line 24. Operation conditions are shown in Table 35 and the compositions of products are shown in Table 36.

Comparative Example 13

DB13

This comparative example describes a reference process for cracking olefin oils.

The same feedstock oil was catalytically cracked by the same catalyst according to the process used in example 80, except that the catalyst entering reduction reactor 3 did not contact with the atmosphere containing a reducing gas, namely that no atmosphere containing a reducing gas was introduced from line 4 into the reactor. Operation conditions are shown in Table 35 and the compositions of products are shown in Table 36.

TABLE 35

| | | Example No. | | | | | |
|---|---|---|---|---|---|---|---|
| | | 80 | 81 | 82 | 83 | 84 | DB13 |
| Catalyst No. | | C1 | C2 | C3 | C4 | C5 | C5 |
| Temperature, ° C. | First reaction zone 9 | 510 | 520 | 600 | 515 | 520 | 520 |
| | Second reaction zone 14 | 490 | 500 | 570 | 500 | 505 | 505 |
| | Outlet zone 15 | 470 | 480 | 550 | 480 | 485 | 485 |
| Pressure, MPa | First reaction zone 9 | 0.18 | 0.18 | 0.15 | 0.18 | 0.18 | 0.18 |
| | Second reaction zone 14 | 0.15 | 0.15 | 0.13 | 0.15 | 0.15 | 0.15 |
| Contact time, sec | First reaction zone 9 | 2.0 | 1.0 | 0.8 | 1.0 | 1.0 | 1.0 |
| | Second reaction zone 14 | 5.5 | 5.5 | 6 | 6.5 | 6.5 | 6.5 |
| | Outlet zone 15 | 0.5 | 0.5 | 0.3 | 0.5 | 0.5 | 0.5 |
| Catalyst/oil weight ratio | First reaction zone 9 | 4.0 | 5.0 | 4.0 | 5.5 | 6.0 | 6.0 |
| | Times of the Catalyst/oil weight ratio of second reaction zone 14 to the Catalyst/oil weight ratio of first reaction zone 9 | 1.5 | 1.4 | 1.3 | 1.2 | 1.3 | 1.3 |
| Temperature of regenerator 22, ° C. | | 680 | 690 | 690 | 690 | 690 | 690 |
| Reduction reactor 3 | Temperature, ° C. | 600 | 600 | 600 | 680 | 650 | — |
| | Time, min | 30 | 20 | 10 | 20 | 20 | — |
| | Pressure, MPa | 0.13 | 0.13 | 0.13 | 0.13 | 0.13 | — |
| | Atmosphere containing a reducing gas | $H_2$ | $H_2$ | $H_2$ | $H_2$ | $H_2$ | — |
| | Amount of the atmosphere containing a reducing gas, $m^3$/ton/min | 7 | 7 | 7 | 7 | 7 | — |
| Total amount of atomizing and pre-lifting steam relative to hydrocarbon oils, wt % | | 5 | 5 | 5 | 10 | 10 | 10 |
| Whether it is introduced into heat exchanger 7 to carry out heat exchange | | Yes | Yes | No | Yes | Yes | Yes |
| Whether it is introduced into heat exchanger 27 to carry out heat exchange | | Yes | Yes | No | Yes | Yes | Yes |

TABLE 36

| | Example No. | | | | | |
|---|---|---|---|---|---|---|
| | 80 | 81 | 82 | 83 | 84 | DB13 |
| Catalyst No. | C1 | C2 | C3 | C4 | C5 | C5 |
| Product distribution, wt % | | | | | | |
| Dry gas | 3.86 | 3.74 | 4.16 | 3.98 | 3.86 | 4.21 |
| LPG | 13.35 | 13.46 | 13.65 | 13.21 | 13.17 | 13.07 |
| Gasoline | 49.24 | 49.39 | 49.97 | 48.59 | 48.26 | 45.48 |

TABLE 36-continued

| | Example No. | | | | | |
|---|---|---|---|---|---|---|
| | 80 | 81 | 82 | 83 | 84 | DB13 |
| Diesel oil | 24.47 | 24.64 | 23.09 | 24.92 | 25.03 | 24.26 |
| Heavy oil | 4.78 | 4.67 | 3.92 | 4.73 | 4.93 | 6.95 |
| Coke | 4.21 | 4.0 | 5.13 | 4.46 | 4.68 | 5.94 |
| Loss | 0.09 | 0.10 | 0.08 | 0.11 | 0.07 | 0.09 |
| Sulfur content in gasoline, mg/L | 345 | 310 | 320 | 510 | 520 | 1200 |

It can be seen from Table 36 that compared with the reference process, when a sulfur-containing hydrocarbon oil is catalytically cracked by the process of the present invention, the content of gasoline in cracked products is increased prominently, the content of diesel oil is also increased, the content of heavy oil is reduced prominently, and the sulfur content in gasoline is decreased in a large extent. This shows that the process of the present invention has much higher ability of cracking and desulfurizing heavy oil, so it is suitable for high production of gasoline.

Examples 85-89

The following examples describe the process of the present invention. This group of examples aims mainly at high production of LPG and gasoline.

The catalytic cracking of feedstock oil 3# shown in Table 4 was carried out according to FIG. 14. The catalysts used were catalysts C1-C5 prepared in examples 1-5 respectively. Said reactor was that described in examples 14-18.

A part of the regenerated catalyst from regenerator 22 was optionally introduced into heat exchanger 7 via line 6. The optionally heat-exchanged catalyst was introduced into the pre-lifting section of the reactor via line 8, and then driven by pre-lifting steam from line 10 to move upward into the first reaction zone 9. Meanwhile, the preheated hydrocarbon oil from line 11 was mixed with the atomizing steam from line 12 and introduced into the first reaction zone 9, where said hydrocarbon oil contacted with the catalyst to carry out a first cracking reaction. The reaction stream continued to move upward to the second reaction zone 14. Meanwhile, the other part of the regenerated catalyst from regenerator 22 was introduced via line 25 into gas displacement tank 30, where the oxygen-containing gas entrained by the regenerated catalyst was displaced with nitrogen from line 31. The displacing gas used was vented out via line 32, and the gas-displaced catalyst was introduced into reduction reactor 3 via line 33 to contact with the atmosphere containing a reducing gas from line 4 under reduction conditions. After reaction, the waste gas was vented out via line 5. The catalyst that had contacted with atmosphere containing a reducing gas was optionally introduced into heat exchanger 27 via line 26, the optionally heat-exchanged catalyst was introduced into the second reaction zone 14 via line 28. In the second reaction zone 14, the reaction stream from the first reaction zone 9 contacted with the catalyst from line 28 to carry out a second reaction. After the second reaction, the stream continued to move upward through outlet zone 15 into settler 17 of the separation system via horizontal pipe 16, in settler 17 the catalyst and cracked products were separated by the cyclone separator. The separated catalyst was introduced into stripper 18 of the separation system to contact in counter flow with steam from line 19, and cracked products remained on the catalyst were stripped out to obtain a spent catalyst. The cracked products obtained by separation and stripped products were mixed, and then discharged from line 20, and continued to be separated into various distillates in the separation system. The spent catalyst was introduced into regenerator 22 via sloped tube 21. In regenerator 22, the spent catalyst contacted with excess air from line 23 at a regeneration temperature to remove coke thereon, and the flue gas formed was vented out from line 24. Operation conditions are shown in Table 37 and the compositions of products are shown in Table 38.

Comparative Example 14

DB14

This comparative example describes a reference process for cracking olefin oils.

The same feedstock oil was catalytically cracked by the same catalyst according to the process used in example 87, except that the catalyst entering reduction reactor 3 did not contact with the atmosphere containing a reducing gas, namely that no atmosphere containing a reducing gas was introduced from line 4 into the reactor. Operation conditions are shown in Table 37 and the compositions of products are shown in Table 38.

TABLE 37

| | | Example No. | | | | | |
|---|---|---|---|---|---|---|---|
| | | 85 | 86 | 87 | DB14 | 88 | 89 |
| Catalyst No. | | C1 | C2 | C3 | C3 | C4 | C5 |
| Temperature, ° C. | First reaction zone 9 | 590 | 515 | 515 | 515 | 520 | 520 |
| | Second reaction zone 14 | 570 | 490 | 500 | 500 | 490 | 490 |
| | Outlet zone 15 | 550 | 480 | 480 | 480 | 480 | 480 |
| Pressure, Mpa | First reaction zone 9 | 0.18 | 0.15 | 0.20 | 0.20 | 0.25 | 0.25 |
| | Second reaction zone 14 | 0.15 | 0.13 | 0.17 | 0.17 | 0.23 | 0.23 |
| Contact time, sec | First reaction zone 9 | 1.3 | 1.3 | 1.5 | 1.5 | 1.5 | 1.5 |
| | Second reaction zone 14 | 5.8 | 6.2 | 6.2 | 6.2 | 6.2 | 6.2 |
| | Outlet zone 15 | 0.3 | 0.3 | 0.3 | 0.3 | 0.3 | 0.3 |
| Catalyst/oil weight ratio | First reaction zone 9 | 5.0 | 4.5 | 4.5 | 4.5 | 5.0 | 4.0 |
| | Times of the Catalyst/oil weight ratio of second reaction zone 14 to the Catalyst/oil weight ratio of first reaction zone 9 | 1.4 | 1.3 | 1.3 | 1.3 | 1.4 | 1.6 |
| Temperature of regenerator 22, ° C. | | 690 | 690 | 690 | 690 | 680 | 700 |
| Reduction reactor 3 | Temperature, ° C. | 680 | 620 | 650 | — | 600 | 600 |
| | Time, min | 10 | 20 | 20 | — | 30 | 30 |
| | Pressure, MPa | 0.13 | 0.13 | 0.16 | — | 0.23 | 0.25 |
| | Atmosphere containing a reducing gas | 50% $H_2$ + 50% CO | 50% $H_2$ + 50% CO | 50% $H_2$ + 50% CO | — | 50% $H_2$ + 50% CO | 50% $H_2$ + 50% CO |
| | Amount of the atmosphere containing a reducing gas, $m^3$/ton/min | 5.5 | 4.0 | 5 | — | 5.5 | 5.5 |

TABLE 37-continued

| | Example No. | | | | | |
|---|---|---|---|---|---|---|
| | 85 | 86 | 87 | DB14 | 88 | 89 |
| Amount of nitrogen, $m^3$/ton/min | 4 | 4 | 12 | — | 4 | 4 |
| Total amount of atomizing and pre-lifting steam relative to hydrocarbon oils, wt % | 8 | 5 | 8 | 8 | 8 | 10 |
| Whether it is introduced into heat exchanger 7 to carry out heat exchange | Yes | Yes | Yes | Yes | Yes | Yes |
| Whether it is introduced into heat exchanger 27 to carry out heat exchange | Yes | Yes | Yes | Yes | Yes | Yes |

TABLE 38

| | Example No. | | | | | |
|---|---|---|---|---|---|---|
| | 85 | 86 | 87 | DB14 | 88 | 89 |
| Catalyst No. | C1 | C2 | C3 | C3 | C4 | C5 |
| Product distribution, wt % | | | | | | |
| Dry gas | 4.84 | 4.49 | 4.12 | 3.63 | 4.02 | 3.87 |
| LPG | 13.93 | 13.76 | 13.5 | 12.96 | 13.63 | 12.32 |
| Gasoline | 49.89 | 49.68 | 49.31 | 46.16 | 49.53 | 49.23 |
| Diesel oil | 23.26 | 24.27 | 24.63 | 24.69 | 24.72 | 24.64 |
| Heavy oil | 4.03 | 4.16 | 4.79 | 6.81 | 4.24 | 5.48 |
| Coke | 3.94 | 3.51 | 3.57 | 5.63 | 3.76 | 4.4 |
| Loss | 0.11 | 0.13 | 0.08 | 0.12 | 0.1 | 0.06 |

It can be seen from Table 38 that compared with the reference process, when a sulfur-free hydrocarbon oil is catalytically cracked by the process of the present invention, the content of LPG and gasoline in cracked products is increased prominently, the content of heavy oil and coke is decreased prominently. This shows that the process of the present invention is also suitable for use in the catalytic cracking of sulfur-free hydrocarbon oil, and the process of the present invention has much higher ability of cracking heavy oil, so it is suitable for high production of LPG and gasoline.

Examples 90-93

The following examples describe the process of the present invention. This group of examples aims mainly at high production of diesel oil.

The catalytic cracking of a mixed oil of 50 wt % of feedstock oil 2# and 50 wt % of feedstock oil 1# as shown in Table 4 was carried out according to FIG. 15. The catalysts used were catalysts C6-C9 prepared in example 6-9 respectively. Said heat exchanger 27 was a hot air heater. Said reactor was that described in examples 24-27.

A part of the regenerated catalyst from regenerator 22 was optionally introduced into heat exchanger 7 via line 6. The optionally heat-exchanged catalyst was introduced into the pre-lifting section of the reactor via line 8 and driven by pre-lifting steam from line 10 to move upward into the first reaction zone 9. Meanwhile, the preheated hydrocarbon oil from line 11 was mixed with the atomizing steam from line 12 and introduced into the first reaction zone 9, where said hydrocarbon oil contacted with the catalyst to carry out a first cracking reaction. A chilling agent was injected into the region connecting the first reaction zone 9 with the second reaction zone 14 from line 13 (at a place having a height of 1800 mm from the bottom of the riser reactor). The chilling agent was a crude gasoline at room temperature with a distillation range of 121-250° C. and was used in such an amount that the reaction temperature of reaction stream at the second reaction zone 14 was decreased to that shown in Table 9. The reaction stream continued to move upward to mix with the chilling agent and enter the second reaction zone 14. Meanwhile, the other part of the regenerated mixture from regenerator 22 was introduced into reduction reactor 3 via line 25. In reduction reactor 3 the regenerated catalyst or the mixture of the regenerated catalyst with the fresh catalyst from tank 1 via line 2 contacted with the atmosphere containing a reducing gas from line 4 under reduction conditions. After reaction, the waste gas was vented out via line 5. The catalyst that had contacted with the atmosphere containing a reducing gas was optionally introduced into heat exchanger 27 via line 26, the optionally heat-exchanged catalyst was introduced into the second reaction zone 14 via line 28. In the second reaction zone 14, the reaction stream from the first reaction zone 9 contacted with the catalyst from line 28 to carry out a second reaction. After the second reaction, the stream continued to move upward through outlet zone 15 into settler 17 of the separation system via a horizontal pipe 16, in settler 17 the catalyst and cracked products were separated by the cyclone separator. The separated catalyst was introduced into stripper 18 of the separation system to contact in counter flow with the steam from line 19, and cracked products remained on the catalyst were stripped out to obtain a spent catalyst. The cracked products obtained by separation and stripped products were mixed, and then discharged via line 20, and continued to be separated into various distillates in the separation system. The spent catalyst was introduced into regenerator 22 via sloped tube 21. In regenerator 22, the spent catalyst contacted with excess air from line 23 at a regeneration temperature to remove coke thereon. The flue gas formed was vented out from line 24. Operation conditions are shown in Table 39 and the compositions of products are shown in Table 40.

TABLE 39

| | Example No. | | | |
|---|---|---|---|---|
| | 90 | 91 | 92 | 93 |
| Catalyst No. | C6 | C7 | C8 | C9 |
| Temperature, First reaction zone 9 | 505 | 510 | 510 | 510 |

TABLE 39-continued

| | | Example No. | | | |
|---|---|---|---|---|---|
| | | 90 | 91 | 92 | 93 |
| ° C. | Second reaction zone 14 | 485 | 490 | 490 | 490 |
| | Outlet zone 15 | 475 | 475 | 470 | 470 |
| Pressure, Mpa | First reaction zone 9 | 0.25 | 0.23 | 0.23 | 0.23 |
| | Second reaction zone 14 | 0.20 | 0.20 | 0.20 | 0.20 |
| | First reaction zone 9 | 2.9 | 0.8 | 0.8 | 0.8 |
| Contact time, sec | First reaction zone 9 | 2.9 | 0.8 | 0.8 | 0.8 |
| | Second reaction zone 14 | 7 | 6.0 | 6.0 | 6.2 |
| | Outlet zone 15 | 0.5 | 0.3 | 0.3 | 0.5 |
| Catalyst/oil weight ratio | First reaction zone 9 | 5.0 | 5.5 | 5.5 | 6.0 |
| | Times of the Catalyst/oil weight ratio of second reaction zone 14 to the Catalyst/oil weight ratio of first reaction zone 9 | 1.4 | 1.18 | 1.18 | 1.17 |
| Temperature of regenerator 22, ° C. | | 650 | 650 | 700 | 680 |
| Reduction reactor 3 | Temperature, ° C. | 500 | 480 | 450 | 500 |
| | Time, min | 20 | 3 | 1 | 30 |
| | Pressure, MPa | 0.23 | 0.23 | 0.23 | 0.23 |
| | Atmosphere containing a reducing gas | 50% $H_2$ + 50% dry gas | 50% $H_2$ + 50% dry gas | 50% $H_2$ + 50% dry gas | 50% $H_2$ + 50% dry gas |
| | Amount of the atmosphere containing a reducing gas, $m^3$/ton/min | 7 | 8 | 8 | 7 |
| Total amount of atomizing and pre-lifting steam relative to hydrocarbon oils, wt % | | 8 | 8 | 5 | 5 |
| Whether it is introduced into heat exchanger 7 to carry out heat exchange | | Yes | Yes | Yes | Yes |
| Whether it is introduced into heat exchanger 27 to carry out heat exchange | | No | No | Yes | No |

TABLE 40

| | Example No. | | | |
|---|---|---|---|---|
| | 90 | 91 | 92 | 93 |
| Catalyst No. | C6 | C7 | C8 | C9 |
| Product distribution, wt % | | | | |
| Dry gas | 3.42 | 3.28 | 3.94 | 3.37 |
| LPG | 13.24 | 13.49 | 13.24 | 12.98 |
| Gasoline | 42.52 | 42.33 | 42.53 | 42.92 |
| Diesel oil | 27.02 | 26.39 | 26.38 | 26.53 |
| Heavy oil | 6.36 | 6.63 | 6.32 | 6.92 |
| Coke | 7.38 | 7.77 | 7.47 | 7.15 |
| Loss | 0.06 | 0.11 | 0.12 | 0.13 |
| Sulfur content in gasoline, mg/L | 280 | 240 | 190 | 350 |

Examples 94-97

The following examples describe the process of the present invention.

The catalytic cracking of feedstock oil 2# shown in Table 4 was carried out according to FIG. 16. The catalysts used were catalysts C10-C13 prepared in examples 10-13 respectively. Said reactor was that described in examples 24-27.

A part of the regenerated catalyst from regenerator 22 was optionally introduced into heat exchanger 7 via line 6. The optionally heat-exchanged catalyst was introduced into the pre-lifting section of the reactor via line 8, and driven by pre-lifting steam from line 10 to move upward into the first reaction zone 9. Meanwhile, the preheated hydrocarbon oil from line 11 and the atomizing steam from line 12 were mixed and introduced into the first reaction zone 9, where said hydrocarbon oil contacted with the catalyst to carry out a first cracking reaction. A chilling agent was injected into the region connecting the first reaction zone 9 with the second reaction zone 14 from line 13 (at a place having a height of 1800 mm from the bottom of the riser reactor). The chilling agent was a crude gasoline at room temperature with a distillation range of 121-250° C. and was used in such an amount that the reaction temperature of reaction stream at the second reaction zone 14 was decreased to that shown in Table 11. The reaction stream continued to move upward to mix with the chilling agent and enter the second reaction zone. Meanwhile, the other part of the regenerated catalyst from regenerator 22 was introduced via line 25 into gas displacement tank 30, where the oxygen-containing gas entrained by the mixture of the regenerated catalyst and the fresh catalyst (which was in an amount corresponding to 5 wt % of the regenerated catalyst) from tank 1 via line 2 was displaced with helium from line 31. The displacing gas used was vented out via line 32. The gas-displaced catalyst was introduced into reduction reactor 3 via line 33 to contact with the atmosphere containing a reducing gas from line 4 under reduction conditions. After reaction, the waste gas was vented out via line 5. The catalyst that had contacted with atmosphere containing a reducing gas was optionally introduced into heat exchanger 27 via line 26. The optionally heat-exchanged catalyst was introduced into the second reaction zone 14 via line 28, in the second reaction zone 14 the reaction stream from the first reaction zone 9 contacted with the catalyst from line 28 to carry out a second reaction. A terminator was added via line 29 into the region connecting the second reaction zone with outlet zone (at a place having a height of 3400 mm from the bottom of the riser reactor). The terminator was a crude gasoline at room temperature with a distillation range of 121 to 250° C. and was used in such an amount that the temperature of the outlet zone was decreased to that shown in Table 11. After the second reaction, the stream continued to move upward to mix with the terminator and pass through outlet zone 15 into settler 17 of the separation system via horizontal pipe 16, in settler 17 the catalyst and cracked products were separated by the cyclone separator. The separated catalyst was introduced into stripper 18 of the separation system to contact in counter flow with steam from line 19, and cracked products remained on the catalyst were stripped out to obtain a spent catalyst. The cracked products obtained by separation and stripped products were mixed, and then discharged from line 20, and continued to be separated into various distillates in the separation system. The spent catalyst was introduced into regenerator 22 via sloped tube 21. In regenerator 22, the spent catalyst contacted with excess air from line 23 at a regeneration temperature to remove coke thereon. The flue gas formed was vented out from line 24. Operation conditions are shown in Table 41 and the compositions of products are shown in Table 42.

TABLE 41

| | | Example No. | | | |
|---|---|---|---|---|---|
| | | 94 | 95 | 96 | 97 |
| Catalyst No. | | C10 | C11 | C12 | C13 |
| Temperature, ° C. | First reaction zone 9 | 510 | 520 | 520 | 520 |
| | Second reaction zone 14 | 495 | 495 | 495 | 495 |
| | Outlet zone 15 | 470 | 470 | 470 | 470 |
| Pressure, Mpa | First reaction zone 9 | 0.15 | 0.15 | 0.15 | 0.15 |
| | Second reaction zone 14 | 0.13 | 0.13 | 0.13 | 0.13 |
| Contact time, sec | First reaction zone 9 | 0.8 | 0.8 | 1.0 | 1.0 |
| | Second reaction zone 14 | 6.0 | 6.0 | 6.0 | 6.0 |
| | Outlet zone 15 | 0.3 | 0.3 | 0.3 | 0.3 |
| Catalyst/oil weight ratio | First reaction zone 9 | 10 | 6 | 6 | 6 |
| | Times of the Catalyst/oil weight ratio of second reaction zone 14 to the Catalyst/oil weight ratio of first reaction zone 9 | 1.18 | 1.17 | 1.17 | 1.17 |
| Temperature of regenerator 22, ° C. | | 700 | 680 | 700 | 700 |
| Reduction reactor 3 | Temperature, ° C. | 520 | 650 | 650 | 650 |
| | Time, min | 20 | 20 | 20 | 20 |
| | Pressure, MPa | 0.12 | 0.12 | 0.12 | 0.12 |
| | Atmosphere containing a reducing gas | 50% $H_2$ + 50% dry gas | 50% $H_2$ + 50% dry gas | 50% $H_2$ + 50% dry gas | 50% $H_2$ + 50% dry gas |
| | Amount of the atmosphere containing a reducing gas, $m^3$/ton/min | 5 | 6 | 6 | 6 |
| Amount used of Helium, $m^3$/ton/min | | 8 | 3 | 3 | 3 |
| Total amount of atomizing and pre-lifting steam relative to hydrocarbon oils, wt % | | 8 | 10 | 10 | 10 |
| Whether it is introduced into heat exchanger 7 to carry out heat exchange | | Yes | Yes | Yes | Yes |
| Whether it is introduced into heat exchanger 27 to carry out heat exchange | | No | Yes | Yes | Yes |

TABLE 42

| | Example No. | | | |
|---|---|---|---|---|
| | 94 | 95 | 96 | 97 |
| Catalyst No. | C10 | C11 | C12 | C13 |
| Product distribution, wt % | | | | |
| Dry gas | 3.16 | 3.07 | 3.25 | 3.18 |
| LPG | 11.92 | 11.38 | 11.26 | 11.52 |
| Gasoline | 42.22 | 42.03 | 41.97 | 42.53 |
| Diesel oil | 26.12 | 25.79 | 26.41 | 26.11 |
| Heavy oil | 8.01 | 8.47 | 8.42 | 8.46 |
| Coke | 8.47 | 9.11 | 8.63 | 8.12 |
| Loss | 0.1 | 0.15 | 0.06 | 0.08 |
| Sulfur content in gasoline, mg/L | 80 | 110 | 100 | 70 |

Examples 98-101

The following examples describe the process of the present invention. This group of examples aims mainly at high production of diesel oil.

The catalytic cracking of a mixed oil of 20 wt % of feedstock oil 1# and 80 wt % of feedstock oil 2# as shown in Table 4 was carried out according to FIG. 14. Said reactor was that described in examples 32-35. The catalysts used were C14, C15, C16 and C17 respectively.

A part of the regenerated catalyst from regenerator 22 was optionally introduced into heat exchanger 7 via line 6. The optionally heat-exchanged catalyst was introduced into the pre-lifting section of the reactor via line 8, and driven by pre-lifting dry gas from line 10 to move upward into the first reaction zone 9. Meanwhile, the preheated hydrocarbon oil from line 11 and the atomizing steam from line 12 were mixed and introduced into the first reaction zone 9, where said hydrocarbon oil contacted with the catalyst to carry out a first cracking reaction. A chilling agent was injected into the region connecting the first reaction zone 9 with the second reaction zone 14 from line 13 (at a place having a height of 6.2 m from the bottom of the riser reactor). The chilling agent was a crude gasoline at room temperature with a distillation range of 121-250° C. and was used in such an amount that the reaction temperature of reaction stream at the second reaction zone 14 was decreased to that shown in Table 13. The reaction stream continued to move upward to mix with the chilling agent and enter the second reaction zone 14. Meanwhile, the other part of the regenerated catalyst from regenerator 22 was introduced via line 25 into gas displacement tank 30, where the oxygen-containing gas entrained by the regenerated catalyst was displaced with nitrogen from line 31. The displacing gas used was vented out via line 32; the gas-displaced catalyst was introduced into reduction reactor 3 via line 33. The gas-displaced catalyst was introduced into reduction reactor 3 via line 33 to contact with the atmosphere containing a reducing gas from line 4 under reduction conditions. After reaction, the waste gas was vented out via line 5. The catalyst that had contacted with atmosphere containing a reducing gas was optionally introduced into heat exchanger 27 via line 26. The optionally heat-exchanged catalyst was introduced into the second reaction zone 14 via line 28, in the second reaction zone 14 the reaction stream from the first reaction zone 9 contacted with the catalyst from line 28 to carry out a second reaction. A terminator was added via line 29 into the region connecting the second reaction zone with outlet zone (at a place having a height of 12.3 m from the bottom of the riser reactor). The terminator was a crude gasoline at room temperature with a distillation range of 121 to 250° C. and was used in such an amount that the temperature of the outlet zone was decreased to that shown in Table 13. After the second reaction, the stream continued to move upward and mix with the terminator and pass through outlet zone 15 into settler 17 of separation system via a horizontal pipe 16, in settler 17 the catalyst and cracked products were separated by the cyclone separator. The separated catalyst was introduced into stripper 18 of the separation system to contact in counter flow with the steam from line 19, and cracked products remained on the catalyst were stripped out to obtain a spent catalyst. The cracked products obtained by separation and stripped products were mixed, and then discharged via line 20, and continued to be separated into various distillates in the separation system. After stripped, the spent catalyst was introduced into regenerator 20 via sloped tube 19, where the spent catalyst contacted with excess air from line 23 to remove coke thereon, and the flue gas formed was vented off via line 22. Operation conditions are shown in Table 43 and the compositions of products are shown in Table 44.

Comparative Example 15

DB15

This comparative example describes a reference process for cracking olefin oils.

The same feedstock oil was catalytically cracked by the same catalyst according to the process used in example 98, except that the catalyst entering reduction reactor 3 did not contact with the atmosphere containing a reducing gas, namely that no atmosphere containing a reducing gas was introduced from line 4 into the reactor. Operation conditions are shown in Table 43 and the compositions of products are shown in Table 44.

Comparative Example 16

DB16

This comparative example describes a reference process for cracking olefin oils.

The same feedstock oil was catalytically cracked by the same catalyst according to the process used in example 101, except that the catalyst entering reduction reactor 3 did not contact with the atmosphere containing a reducing gas, namely that no atmosphere containing a reducing gas was introduced from line 4 into the reactor. Operation conditions are shown in Table 43 and the compositions of products are shown in Table 44.

TABLE 43

| | | Example No. | | | | | |
|---|---|---|---|---|---|---|---|
| | | 98 | DB15 | 99 | 100 | 101 | DB16 |
| Catalyst No. | | C14 | C14 | C15 | C16 | C17 | C17 |
| Temperature, ° C. | First reaction zone 9 | 520 | 520 | 520 | 520 | 520 | 520 |
| | Second reaction zone 14 | 500 | 500 | 500 | 500 | 500 | 500 |
| | Outlet zone 15 | 480 | 480 | 480 | 480 | 480 | 480 |
| Pressure, Mpa | First reaction zone 9 | 0.15 | 0.15 | 0.15 | 0.15 | 0.15 | 0.15 |
| | Second reaction zone 14 | 0.13 | 0.13 | 0.13 | 0.13 | 0.13 | 0.13 |
| | First reaction zone 9 | 1.0 | 1.0 | 0.8 | 0.8 | 1.0 | 1.0 |
| Contact time, sec | First reaction zone 9 | 1.0 | 1.0 | 0.8 | 0.8 | 1.0 | 1.0 |
| | Second reaction zone 14 | 6.2 | 6.2 | 6.0 | 6.0 | 6.2 | 6.2 |
| | Outlet zone 15 | 0.3 | 0.3 | 0.3 | 0.3 | 0.3 | 0.3 |
| Catalyst/oil weight ratio | First reaction zone 9 | 4.0 | 4.0 | 5.5 | 5.5 | 6.0 | 6.0 |
| | Times of the Catalyst/oil weight ratio of second reaction zone 14 to the Catalyst/oil weight ratio of first reaction zone 9 | 1.3 | 1.3 | 1.18 | 1.18 | 1.17 | 1.17 |

TABLE 43-continued

| | | Example No. | | | | | |
|---|---|---|---|---|---|---|---|
| | | 98 | DB15 | 99 | 100 | 101 | DB16 |
| Temperature of regenerator 22, ° C. | | 650 | 650 | 700 | 680 | 690 | 690 |
| Reduction reactor 3 | Temperature, ° C. | 520 | — | 520 | 520 | 700 | — |
| | Time, min | 30 | — | 20 | 20 | 5 | — |
| | Pressure, MPa | 0.12 | — | 0.12 | 0.12 | 0.12 | — |
| | Atmosphere containing a reducing gas | 50% $H_2$ + 50% CO | — | 50% $H_2$ + 50% CO | 70% $H_2$ + 30% CO | 70% $H_2$ + 30% CO | — |
| | Amount of the atmosphere containing a reducing gas, $m^3$/ton/min | 5 | — | 6 | 6 | 6 | — |
| Amount of nitrogen, $m^3$/ton/min | | 8 | — | 3 | 3 | 3 | — |
| Total amount of atomizing and pre-lifting steam relative to hydrocarbon oils, wt % | | 8 | 8 | 8 | 8 | 10 | 10 |
| Whether it is introduced into heat exchanger 7 to carry out heat exchange | | Yes | Yes | Yes | Yes | Yes | Yes |
| Whether it is introduced into heat exchanger 27 to carry out heat exchange | | No | Yes | No | No | Yes | Yes |

TABLE 44

| | Example No. | | | | | |
|---|---|---|---|---|---|---|
| | 98 | DB15 | 99 | 100 | 101 | DB16 |
| Catalyst No. | C14 | C14 | C15 | C16 | C17 | C17 |
| Product distribution, wt % | | | | | | |
| Dry gas | 3.21 | 3.72 | 3.24 | 3.29 | 3.89 | 3.32 |
| LPG | 12.78 | 12.26 | 12.62 | 12.42 | 12.18 | 11.76 |
| Gasoline | 41.62 | 42.37 | 42.03 | 41.39 | 41.24 | 41.35 |
| Diesel oil | 27.81 | 22.48 | 27.29 | 27.89 | 27.72 | 22.71 |
| Heavy oil | 6.92 | 9.97 | 7.06 | 7.21 | 6.91 | 11.47 |
| Coke | 7.6 | 9.12 | 7.66 | 7.68 | 7.96 | 9.31 |
| Loss | 0.06 | 0.08 | 0.1 | 0.12 | 0.1 | 0.08 |
| Sulfur content in gasoline, mg/L | 120 | 350 | 110 | 110 | 140 | 380 |

It can be seen from Table 44 that compared with the reference process for which the reduction process was not carried out, when a sulfur-containing hydrocarbon oil is catalytically cracked by the process of the present invention, the content of diesel oil in cracked products is increased prominently, the content of heavy oil and coke is reduced prominently, the sulfur content in gasoline is decreased in a large extent. This shows further that the process of the present invention has much higher ability of cracking and desulfurizing heavy oil, it is also suitable for high production of diesel oil.

The present application claims priority under 35 U.S.C. §119 of Chinese Patent Application Nos. 200310100429.X filed on Oct. 16, 2003, 200310100430.2 filed on Oct. 16, 2003, 200310100431.7 filed on Oct. 16, 2003, and 200310100432.1 filed on Oct. 16, 2003. The disclosure of the foregoing applications are expressly incorporated by reference herein in their entirety.

The invention claimed is:

1. A process for cracking hydrocarbon oils comprising:

a.) contacting a hydrocarbon oil feedstock with only a single catalyst in a single reactor, said single reactor having two reaction zones therein including a first reaction zone, and a second reaction zone which is after the first reaction zone, the hydrocarbon oil feedstock introduced into the single reactor by being the only hydrocarbon feedstock and being fed only to the first reaction zone, under cracking reaction conditions, wherein the cracking reaction conditions for the first reaction zone are different from those of the second reaction zone;

b.) separating the reaction products and the catalyst, only after the second reaction zone, to obtain separated spent catalyst;

c.) regenerating all of the separated spent catalyst to obtain regenerated catalyst;

d.) contacting the regenerated catalyst, or a mixture of the regenerated catalyst and fresh catalyst, with an atmosphere containing a reducing gas to obtain reduced catalyst;

e.) recirculating a first portion of the reduced catalyst to the first reaction zone to contact the hydrocarbon oil feedstock under cracking reaction conditions to obtain a first reaction zone product;

f.) recirculating a second portion of the reduced catalyst to the second reaction zone to contact the first reaction zone product under cracking reaction conditions to obtain a second reaction zone product.

2. The process of claim 1 wherein said reactor is a riser reactor, a fixed-bed reactor, a fluidized bed reactor, a moving-bed reactor, each used alone or in any combination thereof.

3. The process of claim 1 wherein said cracking conditions include a reaction temperature of 350-700° C., a reaction pressure of 0.1-0.8 MPa, and a catalyst to oil ratio of from 1 to 30.

4. The process of claim 3 wherein said cracking reaction conditions include a reaction temperature of 400-650° C., a reaction pressure of 0.1-0.5 MPa, and a catalyst to oil ratio of from 2 to 15.

5. The process of claim 1 wherein said reactor is a riser reactor having a first reaction zone and a second reaction zone, and the spent catalyst is circulated to a regenerator to be regenerated;

a reduction reactor is set between the regenerator and riser reactor, and the regenerated catalyst, or a mixture of the regenerated catalyst with a fresh catalyst, is introduced into the reduction reactor and contacted with said atmosphere containing a reducing gas.

6. A process for cracking hydrocarbon oils comprising:

a.) contacting a hydrocarbon oil feedstock with only a single catalyst in a single reactor, said single reactor having two reaction zones therein including a first reaction zone, and a second reaction zone which is after the first reaction zone, the hydrocarbon oil feedstock introduced into the single reactor by being the only hydrocarbon feedstock and being fed only to the first reaction zone, under cracking reaction conditions, wherein said cracking reaction conditions include a reaction temperature of 400-650° C., a reaction pressure of 0.1-0.5 MPa, and a catalyst to oil ratio of from 2 to 15, wherein the cracking reaction conditions for the first reaction zone are different from those of the second reaction zone;

b.) separating the reaction products and the catalyst, only after the second reaction zone, to obtain separated spent catalyst;

c.) regenerating a portion of the separated spent catalyst to obtain regenerated catalyst;

d.) contacting the regenerated catalyst, or a mixture of the regenerated catalyst and fresh catalyst, with an atmosphere containing a reducing gas to obtain reduced catalyst;

e.) recirculating the reduced catalyst to the first reaction zone to contact the hydrocarbon oil feedstock under cracking reaction conditions to obtain a first reaction zone product;

f.) recirculating the portion of the spent catalyst that was not regenerated to the second reaction zone to contact the first reaction zone product under cracking reaction conditions to obtain a second reaction zone product.

7. The process of claim 6 wherein said reactor is a riser reactor, a fixed-bed reactor, a fluidized bed reactor, a moving-bed reactor, each used alone or in any combination thereof.

8. The process of claim 6 wherein said reactor is a riser reactor having a first reaction zone and a second reaction zone, and a part of the spent catalyst is circulated to a regenerator to be regenerated;

wherein a reduction reactor is set between the regenerator and riser reactor, and the regenerated catalyst, or a mixture of the regenerated catalyst and a fresh catalyst, is circulated to the reduction reactor to be contacted with said atmosphere containing a reducing gas.

9. A process for cracking hydrocarbon oils comprising:

a.) contacting a hydrocarbon oil feedstock with only a single catalyst in a single reactor, said single reactor having two reaction zones therein including a first reaction zone, and a second reaction zone which is after the first reaction zone, the hydrocarbon oil feedstock introduced into the single reactor by being the only hydrocarbon feedstock and being fed only to the first reaction zone, under cracking reaction conditions, wherein the cracking reaction conditions for the first reaction zone are different from those of the second reaction zone;

b.) separating the reaction products and the catalyst, only after the second reaction zone, to obtain separated spent catalyst;

c.) regenerating all of the separated spent catalyst to obtain regenerated catalyst;

d.) contacting a portion of the regenerated catalyst, or a mixture of a portion of the regenerated catalyst and fresh catalyst, with an atmosphere containing a reducing gas to obtain reduced catalyst;

e.) recirculating the reduced catalyst to the first reaction zone to contact the hydrocarbon oil feedstock under cracking reaction conditions to obtain a first reaction zone product;

f.) recirculating the portion of the regenerated catalyst that was not contacted with an atmosphere containing a reducing gas to the second reaction zone to contact the first reaction zone product under cracking reaction conditions to obtain a second reaction zone product.

10. The process of claim 9 wherein said reactor is a riser reactor, a fixed-bed reactor, a fluidized bed reactor, a moving-bed reactor, each used alone or in any combination thereof.

11. The process of claim 9 wherein said cracking conditions include a reaction temperature of 350-700° C., a reaction pressure of 0.1-0.8 MPa, and a catalyst to oil ratio of from 1 to 30.

12. The process of claim 11 wherein said cracking reaction conditions include a reaction temperature of 400-650° C., a reaction pressure of 0.1-0.5 MPa, and a catalyst to oil ratio of from 2 to 15.

13. The process of claim 9 wherein said reactor is a riser reactor having a first reaction zone and a second reaction zone, and the spent catalyst is circulated to a regenerator to be regenerated;

wherein a reduction reactor is set between the regenerator and the riser reactor, and a part of the regenerated catalyst, or a mixture of a part of the regenerated catalyst with fresh catalyst, is circulated to the reduction reactor to be contacted with said atmosphere containing a reducing gas.

14. A process for cracking hydrocarbon oils comprising:

a.) contacting a hydrocarbon oil feedstock with only a single catalyst in a single reactor, said single reactor having two reaction zones therein including a first reaction zone, and a second reaction zone which is after the first reaction zone, the hydrocarbon oil feedstock introduced into the single reactor by being the only hydrocarbon feedstock and being fed only to the first reaction zone, under cracking reaction conditions, wherein the cracking reaction conditions for the first reaction zone are different from those of the second reaction zone;

b.) separating the reaction products and the catalyst, only after the second reaction zone, to obtain separated spent catalyst;

c.) regenerating all of the separated spent catalyst to obtain regenerated catalyst;

d.) contacting a first portion of the regenerated catalyst and fresh catalyst, with an atmosphere containing a reducing gas to obtain reduced catalyst;

e.) recirculating the portion of the regenerated catalyst that was not contacted with an atmosphere containing a reducing gas to the first reaction zone to contact the hydrocarbon oil feedstock under cracking reaction conditions to obtain a first reaction zone product;

f.) recirculating the reduced catalyst to the second reaction zone to contact the first reaction zone product under cracking reaction conditions to obtain a second reaction zone product.

15. The process of claim 14 wherein said reactor is a riser reactor having a first reaction zone and a second reaction zone, and the spent catalyst is circulated to a regenerator to be regenerated;

wherein a reduction reactor is set between the regenerator and the riser reactor, a part of the regenerated catalyst is circulated to the first reaction zone to be contacted and reacted with the hydrocarbon oil feedstock; and the other part of the regenerated catalyst, or a mixture of the other part of the regenerated catalyst with fresh catalyst, is circulated to the reduction reactor to contact with said atmosphere containing a reducing gas.

16. The process of claim 14 wherein, the catalyst contacts with the atmosphere containing a reducing gas at a temperature of 400-700° C. for 10 seconds to 1 hr;

the volume of the reducing gas is 0.05-15 cubic meters of reducing gas per ton of the cracking catalyst containing metal component; and the catalyst contacts with the atmosphere containing a reducing gas at a pressure of 0.1-0.3 MPa, wherein said atmosphere containing a reducing gas is pure reducing gas or an atmosphere containing a reducing gas and an inert gas.

17. The process of claim 16 wherein said pure reducing gas includes one of more gases selected from the group consisting of: hydrogen, carbon monoxide and hydrocarbons containing 1-5 carbon atoms;

and said atmosphere containing a reducing gas and an inert gas includes a mixture of one or more gases selected from the group consisting of: hydrogen, carbon monoxide and hydrocarbons containing 1-5 carbon atom with one or more inert gases, and a dry gas from a refining factory.

18. The process of claim 16 wherein the content of the reducing gas in said atmosphere containing a reducing gas is at least 10 vol %.

19. The process of claim 1 further comprising moving the first reaction zone product to the second reaction zone.

20. The process of claim 9 further comprising moving the first reaction zone product to the second reaction zone.

21. The process of claim 14 further comprising moving the first reaction zone product to the second reaction zone.

22. The process of claim 16 wherein the hydrocarbon oil feedstock is selected from the group consisting of a crude oil, a distillate of a crude oil, or a combination thereof.

23. The process of claim 22 wherein the hydrocarbon oil feedstock is a crude oil and a distillate thereof with an initial boiling range higher than 330° C.

* * * * *

UNITED STATES PATENT AND TRADEMARK OFFICE

CERTIFICATE OF CORRECTION

PATENT NO. : 9,163,182 B2
APPLICATION NO. : 12/027123
DATED : October 20, 2015
INVENTOR(S) : Jun Long et al.

It is certified that error appears in the above-identified patent and that said Letters Patent is hereby corrected as shown below:

On the title page item (63)

Should Read:

Related U.S. Application Data

Continuation of application No. 10/964,644, filed on October 15, 2004.

Signed and Sealed this
Second Day of August, 2016

Michelle K. Lee

Michelle K. Lee
*Director of the United States Patent and Trademark Office*